US005252447A

United States Patent [19]

Ohtani et al.

[11] Patent Number: 5,252,447

[45] Date of Patent: Oct. 12, 1993

[54] SILVER HALIDE COLOR PHOTOGRAPHIC MATERIAL

[75] Inventors: Shigeaki Ohtani; Shigeru Ohno, both of Kanagawa, Japan

[73] Assignee: Fuji Photo Film Co., Ltd., Kanagawa, Japan

[21] Appl. No.: 27,576

[22] Filed: Mar. 5, 1993

Related U.S. Application Data

[63] Continuation of Ser. No. 609,509, Nov. 6, 1990, abandoned.

[30] Foreign Application Priority Data

Nov. 7, 1989 [JP] Japan ..... 1-289309
Nov. 14, 1989 [JP] Japan ..... 1-297219

[51] Int. Cl.[5] ..... G03C 1/84; G03C 1/87; G03C 7/16; G03C 7/20

[52] U.S. Cl. ..... 430/522; 430/523; 430/536; 430/538; 430/517; 430/519; 430/521; 430/545; 430/546; 430/507

[58] Field of Search ..... 430/538, 536, 523, 522, 430/519, 517, 521, 545, 546, 507

[56] References Cited

U.S. PATENT DOCUMENTS 4,130,430 12/1978 Sugiyama et al. ..... 430/522
4,179,294 12/1979 Sugiyama et al. ..... 430/522
4,203,716 5/1980 Chen ..... 430/545
4,389,455 6/1983 Asao ..... 430/538
4,572,893 2/1986 Asao ..... 430/538
4,857,449 8/1989 Ogawa et al. ..... 430/546
5,035,986 7/1991 Sakai et al. ..... 430/522
5,055,386 10/1991 Hirano et al. ..... 430/546
5,057,404 10/1991 Waki et al. ..... 430/544
5,057,405 10/1991 Shiba et al. ..... 430/538
5,151,345 9/1992 Hasebe ..... 430/525
5,173,395 12/1992 Asami ..... 430/522

*Primary Examiner*—Richard L. Schilling
*Attorney, Agent, or Firm*—Sughrue, Mion, Zinn, Macpeak & Seas

[57] ABSTRACT

A silver halide color photographic material comprising:
a reflective support having thereon
at least one light-sensitive silver halide emulsion layer,
wherein the reflective support comprises a support substrate covered with a water resisting resin layer,
wherein the water resisting resin layer, on the side of the silver halide light-sensitive layer, contains titanium oxide grains in an amount of 14 wt % or more,
wherein the photographic material has an optical reflection density of 0.70 or above at 680 nm, and
wherein the light-sensitive silver halide emulsion layer contains at least one nondiffusible oil-soluble coupler, which forms a dye on coupling with the oxidation product of an aromatic primary amine color developing agent, dispersed therein together with at least one water-insoluble homo- or copolymer.

9 Claims, No Drawings

SILVER HALIDE COLOR PHOTOGRAPHIC MATERIAL

This is a continuation of application Ser. No. 07/609,509 filed Nov. 6, 1990, now abandoned.

FIELD OF THE INVENTION

The present invention relates to a silver halide color photographic material and, more particularly, to a silver halide color photographic material which has excellent sharpness and whiteness after photographic processing, and undergoes only a slight change in sensitivity upon long range storage.

BACKGROUND OF THE INVENTION

A wide variety of silver halide color photographic materials are on the market today, and image formation using these photographic materials is carried out in various ways. Thus, their utilization can be seen in every field. Though the properties required of photographic materials are diverse depending on their individual uses, high sharpness is required of every silver halide-utilizing photographic light-sensitive material. In a so-called silver salt photographic material, a capability of "high density recording" is the most excellent characteristic among advantages inherent therein. In order to fully achieve such a capability, it is also necessary for the silver salt photographic material to have high sharpness. Consequently, various techniques to enhance sharpness have been developed depending on the requirements imposed on each photographic material and the form of its practical use.

Main factors lowering sharpness in photographic materials involve two phenomena, one is halation attributable to reflection of incident light at the emulsion layer-support interface or the support-air interface and the other is irradiation attributable to the scattering of light by the silver halide grains themselves.

Prevention measures against aggravation of sharpness include a method of providing a white pigment-containing layer on a support. Examples of such a method are disclosed in JP-B-58-43734 (the term "JP-B" as used herein refers to an "examined Japanese patent publication"), JP-A-58-17433, JP-A-58-14830, JP-A-61-259246 (the term "JP-A" as used herein refers to a "published unexamined Japanese patent application") and so on. However, the effects conventionally achieved are insufficient.

Also, coloring the constituent layer(s) of a photographic material with dyes or the like is effective to improve sharpness. This approach is disclosed, e.g,. in JP-A-1-188850, but the use of dyes alone is still insufficient to enhance sharpness.

The characteristics required of dyes for antihalation or antiirradiation include:

(1) spectral absorption answering their purpose in use,
(2) a rapid removability in the course of photographic processing,
(3) no harmful effects on photographic properties of a silver halide emulsion, such as desensitization, generation of fog and so on,
(4) retention of the stabilities of the photographic materials during the production and the storage thereof, and so on.

As can be seen from the above, there is a very large demand for photographic materials with high sharpness. In processing silver halide color photographic materials, on the other hand, demands for a shortening of processing completion time and a reduction in environmental pollution due to waste solutions used for photographic processing have recently become very strong. Under these circumstances, when rapid processing or low replenishment processing is performed, an increase in coverage of dyes with the intention of heightening the sharpness of image results in a marked generation of undesirable color stain due to the dyes remaining after the photographic processing, and this results in an extreme deterioration of image quality.

Techniques for decreasing the amount of replenisher to be used in each processing step, and low replenishment in the bleach fix, and washing and/or stabilizing steps increase in dark thermal discoloration and photodiscoloration attributable to residual color developing, bleaching and fixing ingredients which are brought about by low replenishment, and alleviation of these difficulties are disclosed in JP-A-59-184343, JP-A-60-239749, JP-A-61-118751, JP-A-60-228832 and JP-A-60-262161. However, the amount of dyes remaining where dyes are used in quantity, as in the present invention, and methods of reducing the amount of residual dyes have not yet been studied in detail.

In addition, it has turned out that photographic speed varies where permeation of incident light into a photographic material is reduced by a large amount of dye, where dyes are decomposed during a long range storage to greatly change the spectrum of incident light. Further, it has been found that there are problems in increase in stain and change in gradation which were caused by decomposition products of dyes upon long range storage.

SUMMARY OF THE INVENTION

Therefore, an object of the present invention is to provide a silver halide color photographic material which has excellent sharpness and whiteness after processing, and which undergoes a slight change in sensitivity even when stored for a long time.

As a result of concentration on realization of this object, it has now been found that this object can be attained in the following manner.

That is, the present invention provides a silver halide color photographic material, which has at least one silver halide light-sensitive layer on a reflective support comprising a support substrate covered with a water resisting resin layer, with the water resisting resin layer provided on the side of the silver halide light-sensitive layer containing titanium oxide grains in an amount of 14 wt % (based on the sum weight of the water resisting resin and the titanium oxide) or more, the photographic material being designed to have an optical reflection density of 0.70 or above at 680 nm, and the silver halide light-sensitive layer containing at least one nondiffusible oil-soluble coupler, which forms a dye upon coupling with the oxidation product of an aromatic primary amine color developing agent, and with the oil-soluble coupler being dispersed therein together with at least one water-insoluble homo- or copolymer. Thus, the present invention has been achieved.

DETAILED DESCRIPTION OF THE INVENTION

The term "optical reflection density" as used in the present invention refers to the optical density which is measured with a reflection densitometer generally used in the art, and it is defined as follows. Since it is necessary to avoid any error produced by light transmitted by the sample upon measurement, a standard reflection board is placed on the back side of the sample.

$$\textit{Optical reflection density} = \log_{10}(F_0/F)$$

$F_0$: Flux of light reflected from a standard white board
F: Flux of light reflected from the sample It is essential to the present invention that the optical reflection density of the photographic material is adjusted to 0.70 or above, preferably from 0.70 to 2.0, more preferably from 0.8 to 1.9, and most preferably from 1.0 to 1.8, at a wavelength of 680 nm. In addition, it is desired that the ratio between the optical reflection density at 550 nm and that at the 680 nm should be 1 or less, preferably 0.8 or less, more preferably 0.6 or less, and most preferably 0.5 or less. Moreover, it is also desirable that the optical reflection density at 470 nm should be 0.2 or more, particularly 0.3 or more.

In order to obtain the optical reflection densities specified by the present invention, the dyes illustrated below should be employed in controlled amounts. These dyes may be used alone, or as a mixture of two or more thereof. Further, these dyes are not particularly limited with respect to the layer to which they are to be added. Examples of layers to which the dyes can be added include a layer provided between the lowest light-sensitive layer and the support, light-sensitive layers, interlayers, protective layers, a layer provided between a protective layer and the topmost light-sensitive layer, and so on.

Dyes for accomplishing the above described purpose are chosen from those which do not spectrally sensitize, in a substantial sense, silver halides.

These dyes can be employed in a conventional manner. For instance, they can be dissolved in water or an alcohol such as methanol or so on prior to addition.

As to the amount of dyes to be added, the amounts described below serve as a guide.

| | |
|---|---|
| Cyan dyes: | from 20 to 10 mg/m$^2$ (the most desirable amounts) |
| Magenta dyes: | from 0 to 50 mg/m$^2$ (desirable amounts)<br>from 0 to 10 mg/m$^2$ (the most desirable amounts) |
| Yellow dyes: | from 0 to 30 mg/m$^2$ (desirable amount)<br>from 5 to 20 mg/m$^2$ (the most desirable amounts) |

It is more desirable for the dyes to be added to some of the above described layers that they are present so that they diffuse throughout the layers during the preparation of a photographic material, from coating to drying, than that they are fixed in one particular layer, because in the former case the effect of the present invention is more marked and production cost does not increase due to the necessity to form a specific layer containing them.

Suitable examples of dyes include oxonol dyes containing pyrazolone or barbituric acid nuclei, as disclosed, e.g., in British Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-11640, JP-B-39-22069, JP-B-43-13168, JP-B-62-273527, and U.S. Pat. Nos. 3,247,127, 3,469,985 and 4,078,933; other oxonol dyes as disclosed, e.g., in U.S. Pat. Nos. 2,533,472 and 3,379,533, and British Patents 1,278,621; azo dyes as disclosed, e.g., in British Patents 575,691, 680,631, 599,623, 786,907, 907,125 and 1,045,609, U.S. Pat. No. 4,255,326, and JP-A-59-211043; azomethine dyes as disclosed, e.g,. in JP-A-50-100116, JP-A-54-118247, and British Patents 2,014,598 and 750,031; anthraquinone dyes disclosed in U.S. Pat. No. 2,865,752; arylidene dyes as disclosed, e.g., in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286, and JP-B-59-37303; styryl dyes as disclosed, e.g., in JP-B-28-3082, JP-B-44-16594 and JP-B-59-28898; triarylmethane dyes as disclosed, e.g., in British Patents 446,583 and 1,335,422, and JP-A-59-228250; merocyanine dyes as disclosed, e.g, in British Patents 1,075,653, 1,153,341, 1,284,730, 1,475,228 and 1,542,807; and cyanine dyes as disclosed, e.g., in U.S. Pat. Nos. 2,843,486 and 3,294,539.

Of these dyes, those dyes which are particularly preferably used in the present invention are dyes represented by the following general formula (I), (II), (III), (IV), (V) or (VI).

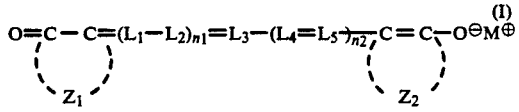

(I)

In the above formula, $Z_1$ and $Z_2$ may be the same or different, each represents the nonmetal atoms necessary to complete a hetero ring; $L_1$, $L_2$, $L_3$, $L_4$ and $L_5$ each represents a methine group; $n_1$ and $n_2$ each represents 0 or 1; and $M^{\oplus}$ represents a hydrogen ion, or another monovalent cation.

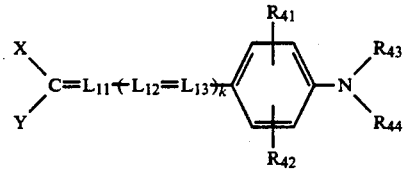

(II)

In the above formula, X and Y may be the same or different, and they each represent an electron-attracting group or they may combine with each other to form a ring; $R_{41}$ and $R_{42}$ may be the same or different, and each represents a hydrogen atom, a halogen atom, an alkyl group, an alkoxy group, a hydroxyl group, a carboxyl group, a substituted amino group, a carbamoyl group, a sulfamoyl group, an alkoxycarbonyl group, or a sulfo group; $R_{43}$ and $R_{44}$ may be the same or different, and they each represent a hydrogen atom, an alkyl group, an alkenyl group, an aryl group, an acyl group or a sulfonyl group, or they may combine with each other to complete a 5- or 6-membered hetero ring; and further, $R_{41}$ and $R_{43}$, or/and $R_{42}$ and $R_{44}$ may combine with each other to complete a 5- or 6-membered ring; and furthermore, at least one of X, Y, $R_{41}$, $R_{42}$, $R_{43}$ and $R_{44}$ contains at least one sulfo or carboxyl group as a substituent group; $L_{11}$, $L_{12}$ and $L_{13}$ each represents a methine group; and k represents 0 or 1.

$$Ar_1-N=N-Ar_2 \qquad \text{(III)}$$

In the above formula, $Ar_1$ and $Ar_2$ may be the same or different, and each represents an aryl group or a heterocyclic group.

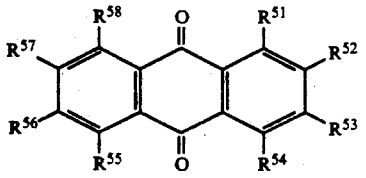

(IV)

In the above formula, $R^{51}$, $R^{54}$, $R^{55}$ and $R^{58}$ may be the same or different, and each represents a hydrogen atom, a hydroxyl group, an alkoxy group, an aryloxy group, a carbamoyl group, or an amino group of the formula, —NR'R", wherein R' and R" may be the same or different, and each is a hydrogen atom, or an alkyl or aryl group containing at least one sulfo or carboxyl group; $R^{52}$, $R^{53}$, $R^{56}$ and $R^{57}$ may be the same or different, and each represents a hydrogen atom, a sulfo group, a carboxyl group, or an alkyl or aryl group containing at least one sulfo or carboxyl group.

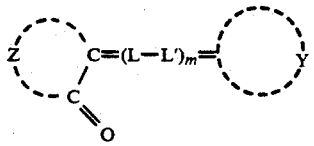

(V)

In the above formula, L and L' each represents a substituted or unsubstituted methine group, or a nitrogen atom; m represents 0, 1, 2 or 3; Z represents the nonmetal atoms necessary to complete a pyrazolone nucleus, a hydroxypyridone nucleus, a barbituric acid nucleus, a thiobarbituric acid nucleus, a dimedone nucleus, an indane-1,3-dione nucleus, a rhodanine nucleus, a thiohydantoin nucleus, an oxazolidine-4-one-2-thione nucleus, a homophthalimide nucleus, a pyrimidine-2,4-dione nucleus, or a 1,2,3,4-tetrahydroquinoline-2,4-dione nucleus; and Y represents the nonmetal atoms necessary to complete an oxazole nucleus, a benzoxazole nucleus, a naphthoxazole nucleus, a thiazole nucleus, a benzothiazole nucleus, a naphthothiazole nucleus, a benzoselenazole nucleus, a pyridine nucleus, a quinoline nucleus, a benzimidazole nucleus, a naphthoimidazole nucleus, an imidazoquinoxaline nucleus, an indolenine nucleus, an isoxazole nucleus, a benzoisoxazole nucleus, a naphthoisoxazole nucleus, or an acrizine nucleus; and further, the rings completed by Z and Y may be substituted.

(VI)-(A)

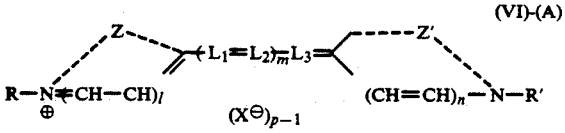

(VI)-(B)

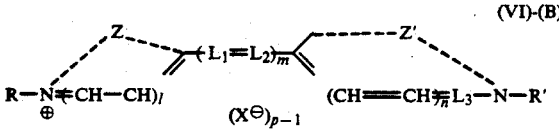

In the above formulae, R and R' may be the same or different, and each represents a substituted or unsubstituted alkyl group; $L_1$, $L_2$ and $L_3$ may be the same or different, and each represents a substituted or unsubstituted methine group; m represents 0, 1, 2 or 3; Z and Z' may be the same or different, and each represents the nonmetal atoms necessary to complete a substituted or unsubstituted 5- or 6-membered hetero ring; l and n each represents 0 or 1; $X^{\ominus}$ represents an anion; p represents 1 or 2, but p is 1 when the dye forms an inner salt.

Each of these dyes are described below in greater detail.

Hetero rings completed by the nonmetal atoms represented by $Z_1$ and $Z_2$ in the general formula (I) are preferably 5- and 6-membered rings, which may be a single ring or condensed rings. Examples of suitable hetero rings are 5-pyrazolone, 6-hydroxypyridone, pyrazolo-[3,4-b]pyridine-3,6-dione, barbituric acid, pyrazolidinedione, thiobarbituric acid, rhodanine, imidazopyridine, pyrazolopyrimidine, pyrrolidone, and pyrazoloimidazole.

The methine group represented by $L_1$, $L_2$, $L_3$, $L_4$ and $L_5$ each may be substituted (e.g., with methyl, ethyl, phenyl, chlorine, sulfoethyl, carboxyethyl, dimethylamino, cyano). A pair of such substituent groups may combine with each other to complete a 5- or 6-membered ring (e.g., cyclohexene, cyclopentene, 5,5-dimethylcyclohexene).

Examples of a monovalent cation represented by $M^{\oplus}$ other than hydrogen ion include $Na^{\oplus}$, $K^{\oplus}$, $HN^{\oplus}(C_2H_5)_3$, pyridinium ion, $Li^{61}$, and so on.

Of the dyes represented by the general formula (I) are those having the following formulae (I-a), (I-b), (I-c), (I-d) and (I-e), respectively, and these are particularly preferred.

(I-a)

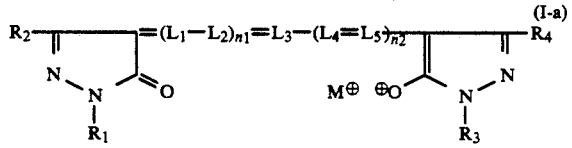

In the above formula, $R_1$ and $R_3$ each represents an aliphatic, aromatic or heterocyclic group; $R_2$ and $R_4$ each represents an aliphatic group, an aromatic group, $—OR_5$, $—COOR_5$, $—NR_5R_6$, $—CONR_5R_6$, $—NR_5CONHR_5R_6$, $—SO_2R_7$, $—COR_7$, $—NR_6COR_7$, $—NR_6SO_2R_7$, or a cyano group (wherein $R_5$ and $R_6$ each represents a hydrogen atom, or an aliphatic or aromatic group; $R_7$ represents an aliphatic or aromatic group; and further, $R_5$ and $R_6$, or $R_6$ and $R_7$ may combine with each other to complete a 5- or 6-membered ring); and $L_1$, $L_2$, $L_3$, $L_4$, $L_5$, $n_1$, $n_2$ and $M^{\oplus}$ have the same meaning as in the general formula (I), respectively.

(I-b)

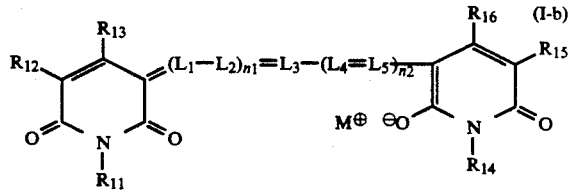

In the above formula, $R_{11}$ and $R_{14}$ each represents a hydrogen atom, an aliphatic group, an aromatic group, a heterocyclic group, $—NR_{17}R_{18}$, $—NR_{17}CONR_{17}R_{18}$, $—NR_{18}COR_{19}$, or $—NR_{18}SO_2R_{19}$; $R_{12}$ and $R_{15}$ each represents a hydrogen atom, an aliphatic group, an aromatic group, a heterocyclic group, a cyano group, a sulfo group, $—NR_{17}R_{18}$, $—NR_{18}COR_{19}$, $—NR_{18}SO_2R_{19}$, $—NR_{17}CONR_{17}R_{18}$, $—COOR_{17}$, $—CONR_{17}R_{18}$, $—COR_{19}$, $—SO_2R_{19}$ or $-SO_2NR_{17}R_{18}$; $R_{13}$ and $R_{16}$ each represents a hydrogen atom, an aliphatic group, an aromatic group, a heterocyclic group, $-OR_{17}$, $-COR_{17}$, $-COR_{19}$, $-CONR_{17}R_{18}$, $-NR_{17}R_{18}$, $-NR_{18}COR_{19}$, $-NR_{18}SO_2R_{19}$, $-NR_{17}CONR_{17}R_{18}$, $-SO_2R_{19}$, $-SO_2NR_{17}R_{18}$, $-OR_7$, or a cyano group (wherein $R_{17}$ and $R_{18}$ each represents a hydrogen atom, an aliphatic group, or an aromatic group; $R_{19}$ represents an aliphatic or aromatic group; and further, $R_{17}$ and $R_{18}$, or $R_{18}$ and $R_{19}$ may combine with each other to complete a 5- or 6-membered ring); $L_1$, $L_2$, $L_3$, $L_4$, $L_5$, $n_1$, $n_2$ and $M^{\oplus}$ have the sam meaning as in the general formula (I), respectively.

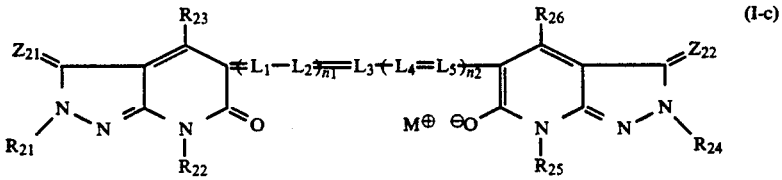

(I-c)

In the above formula, $R_{21}$ and $R_{24}$ each represents an aliphatic, aromatic or heterocyclic group; $R_{22}$ and $R_{25}$ each represents a hydrogen atom, an aliphatic group, an aromatic group, a heterocyclic group, $-COR_{29}$, or $-SO_2R_{29}$; $R_{23}$ and $R_{26}$ each represents a hydrogen atom, a cyano group, an alkyl group, an aryl group, $-COOR_{27}$, $-OR_{27}$, $-NR_{27}R_{28}$, $-N(R_{28})COR_{29}$, $-N(R_{28})SO_2R_{29}$, $-CONR_{27}R_{28}$ or $-N(R_{27})CONR_{27}R_{28}$ (where $R_{29}$ represents an aliphatic or aromatic group; and $R_{27}$ and $R_{28}$ each represents a hydrogen atom, or an aliphatic or aromatic group); $Z_{21}$ represents an oxygen atom or $-NR_{30}$, and $Z_{22}$ represents an oxygen atom, or $-NR_{31}$ (where $R_{30}$ and $R_{31}$ represent non-metal atoms necessary to complete 5-membered rings by combining with $R_{21}$ and $R_{22}$, respectively); $L_1$, $L_2$, $L_3$, $L_4$, $L_5$, $n_1$, $n_2$ and $M^{\oplus}$ have the same meaning as in the general formula (I), respectively; and further, at least one of the substituents, $R_{21}$, $R_{22}$, $R_{23}$, $R_{24}$, $R_{25}$, $R_{26}$, $L_1$, $L_2$, $L_3$, $L_4$ and $L_5$, contains at least one carboxyl or sulfo group.

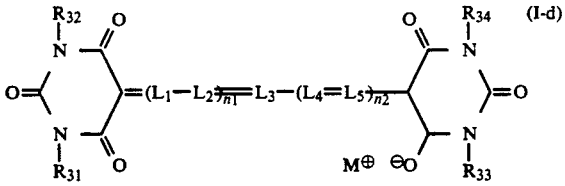

(I-d)

In the above formula, $R_{31}$, $R_{32}$, $R_{33}$ and $R_{34}$ each represents a hydrogen atom, an aliphatic group, an aromatic group, or a heterocyclic group; and $L_1$, $L_2$, $L_3$, $L_4$, $L_5$, $n_1$, $n_2$ and $M^{\oplus}$ have the same meaning as in the general formula (I), respectively.

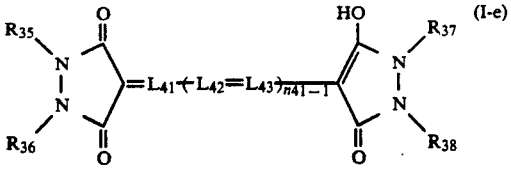

(I-e)

In the above formula, $R_{35}$, $R_{36}$, $R_{37}$ and $R_{38}$ each represents an aliphatic, aromatic or hetero ring residue; $L_{41}$, $L_{42}$ and $L_{43}$ each represents a methine group; and $n_{41}$ represents 1, 2 or 3. Therein, however, some of the substituents, $R_{35}$, $R_{36}$, $R_{37}$ and $R_{38}$, contain(s) carboxyl or sulfo group(s), and the number of such acidic groups must amount to at least 2 in all.

The compounds of the general formula (I-a) are described in greater detail below.

Aliphatic groups represented by $R_1$, $R_2$, $R_3$, $R_4$, $R_5$, $R_6$ and $R_7$ include straight chain, branched and cyclic alkyl, aralkyl and alkenyl groups. Specific examples thereof are methyl, ethyl, n-butyl, benzyl, 2-sulfoethyl, 4-sulfoethyl, 2-sulfobenzyl, 2-carboxyethyl, carboxymethyl, trifluoromethyl, dimethylaminoethyl, 2-hydroxyethyl, and so on.

Specific examples of aromatic groups represented by $R_1$, $R_2$, $R_3$, $R_4$, $R_5$, $R_6$ and $R_7$ include phenyl, naphthyl, 4-sulfophenyl, 3-sulfophenyl, 2,5-disulfophenyl, 4-carboxyphenyl, 5,7-disulfo-3-naphthyl, and so on.

In special cases where $n_1$ is 1 or 2, and $n_2$ is 0, it is preferred for $R_1$ and $R_2$ each to be a phenyl group containing at least two sulfo groups.

Heterocyclic groups represented by $R_1$ and $R_2$ include residues of 5- and 6-membered nitrogen-containing rings (including condensed rings), such as 5-sulfopyridine-2-yl, 5-sulfobenzothiazole-2-yl, etc.

Examples of 5- or 6-membered rings completed by combining $R_5$ with $R_6$, or $R_6$ with $R_7$ include a pyrrolidine ring, a piperidine ring, a pyrrolidone ring, a morpholine ring, and so on.

Specific examples of dyes represented by the general formula (I-a) are illustrated below. However, the present invention should not be construed as being limited to these examples.

| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| I-a-1 | 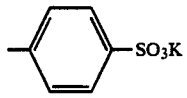 | $-CH_3$ | $=CH-$ | H |
| I-a-2 | 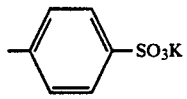 | $-CONHC_3H_7(n)$ | $=CH-$ | H |

-continued

| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| I-a-3 | 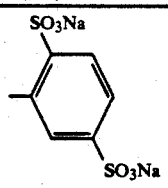 | $-OH$ | $=CH-CH=CH-$ | Na |
| I-a-4 | 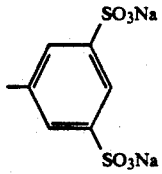 | $-OC_2H_5$ | $=CH\leftarrow CH=CH\rightarrow_2$ | Na |
| I-a-5 | $-CH_2CH_2SO_3K$ | $-COOC_2H_5$ | $=CH-CH=CH-$ | H |
| I-a-6 | 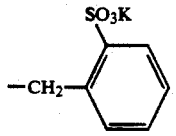 | $-CONHC_4H_9(n)$ | $=CH-CH=CH-$ | H |
| I-a-7 | $-CH_2CH_2SO_3K$ | $-COOK$ | $=CH\leftarrow CH=CH\rightarrow_2$ | H |
| I-a-8 | 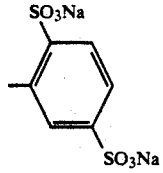 | $-COCH_3$ | $=CH\leftarrow CH=CH\rightarrow_2$ | Na |
| I-a-9 | 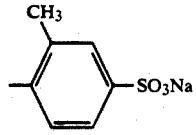 | $-CF_3$ | $=(CH\leftarrow CH=CH\rightarrow_2$ | H |
| I-a-10 | 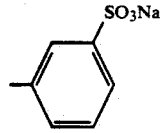 | $-NHCOCH_3$ | $=CH-CH=CH-$ | H |
| I-a-11 | 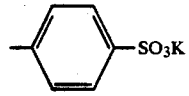 | $-COOC_2H_5$ | $=CH\leftarrow CH=CH\rightarrow_2$ | H |
| I-a-12 | 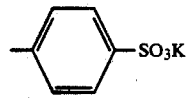 | $-COOK$ | $=CH-CH=CH-$ | H |
| I-a-13 | 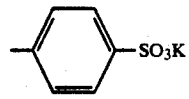 | $-NHCONHCH_3$ | $=CH-CH=CH-$ | H |
| I-a-14 | $-(CH_2)_4SO_3K$ | $-OH$ | $=CH-$ | H |
| I-a-15 | 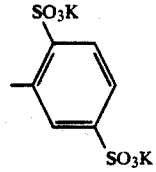 | $-COOK$ | $=CH-CH=CH-$ | K |

-continued

| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| I-a-16 | 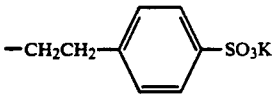 | $-C_6H_5$ | $=CH-CH=CH-$ | H |
| I-a-17 | 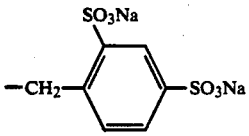 | $-COOC_2H_5$ | $=CH(CH=CH)_2$ | Na |
| I-a-18 | 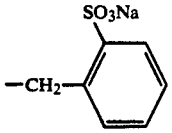 | $-CONHCH_2CH_2OH$ | $=CH(CH=CH)_2$ | H |
| I-a-19 | 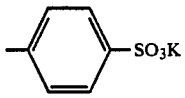 | $-CONHCH_2CH_2SO_3K$ | $=CH(CH=CH)_2$ | H |
| I-a-20 | $-(CH_2)_3SO_3K$ | $-CONHC_7H_{15}(n)$ | $=CH-CH=CH-$ | H |
| I-a-21 | $-CH_2COOK$ | $-COOK$ | $=CH-CH=CH-$ | K |
| I-a-22 | $-CH_2CH_2SO_3K$ | $-N(CH_3)_2$ | $=CH(CH=CH)_2$ | H |
| I-a-23 | $-(CH_2)_3SO_3K$ | $-CN$ | $=CH(CH=CH)_2$ | H |
| I-a-24 | 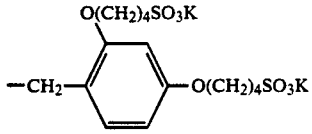 | $-CH_2Cl$ | $=CH(CH=CH)_2$ | H |
| I-a-25 | $-(CH_2)_2SO_3Na$ | $-OH$ | $=CH(CH=CH)_2$ | H |
| I-a-26 | 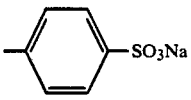 | $-CH_3$ | $=CH-C(CH_3)=CH-$ | Na |
| I-a-27 | 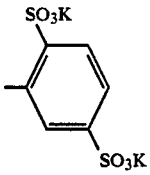 | $-COOC_2H_5$ | $=CH(CH=CH)_2$ | H |
| I-a-28 | 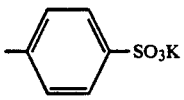 | $-CONHC_2H_5$ | $=CH-CH=CH-$ | H |
| I-a-29 | 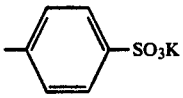 | $-NHCOC_3H_7(i)$ | $=CH-CH=CH-$ | H |
| I-a-30 | $-CH_2CH_2SO_3K$ | 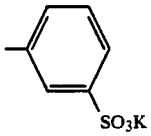 | $=CH-CH=CH-$ | H |

-continued
| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| I-a-31 | 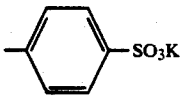 | $-CH_3$ | $=C(CH_3)-CH=CH-$ | H |
| I-a-32 | 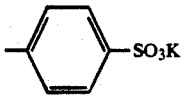 | $-C_4H_9(t)$ | $=CH-CH=CH-$ | H |
| I-a-33 | 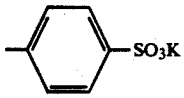 | $-CN$ | $=CH(CH=CH)_2$ | H |
| I-a-34 | 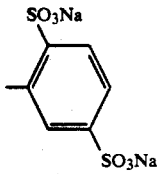 | $-COCH_3$ | $=CH-CH=C(CH_3)-CH=CH-$ | Na |
| I-a-35 | 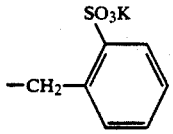 | $-COOK$ | $=CH(CH=CH)_2$ | H |
| I-a-36 | 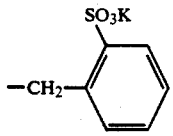 | $-COOK$ | $=CH-CH=CH-$ | H |
| I-a-37 | 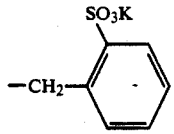 | $-CONHC_4H_9(i)$ | $=CH(CH=CH)_2$ | H |
| I-a-38 | 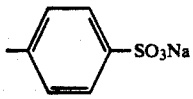 | $-NHSO_2CH_3$ | $=CH(CH=CH)_2$ | H |
| I-a-39 | 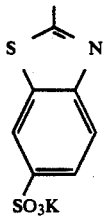 | $-CN$ | $=CH(CH=CH)_2$ | H |
| I-a-40 | 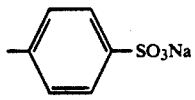 | $-OC_2H_5$ | $=CH(CH=CH)_2$ | H |

-continued

| No. | $R_1$, $R_3$ | $R_2$, $R_4$ | $=(L_1-L_2)_{n1}=L_3-(L_4=L_5)_{n2}$ | $M^{\oplus}$ |
|---|---|---|---|---|
| I-a-41 | 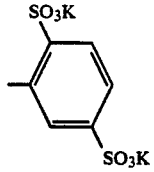 | —CN | $=CH+CH=CH\rangle_2$ | H |

The above cited dyes can be synthesized using methods as disclosed in British Patents 506,385, 1,177,429, 1,338,799, 1,385,371, 1,467,214, 1,433,102 and 1,553,516, JP-A-48-85130, JP-A-55-161233, JP-A-52-20330, JP-A-59-111640, JP-A-62-273527.

The dyes represented by the general formula (I-b) are described in greater detail below.

Specific examples of an aliphatic group represented by $R_{11}$, $R_{12}$, $R_{13}$, $R_{14}$, $R_{15}$, $R_{16}$, $R_{17}$, $R_{18}$ or $R_{19}$ include methyl, ethyl, isopropyl, 2-chloroethyl, trifluoromethyl, benzyl, 2-sulfobenzyl, 4-sulfophenethyl, carboxymethyl, 2-carboxyethyl, 2-sulfoethyl, 2-hydroxyethyl, dimethylaminoethyl, cyclopentyl, and so on.

Specific examples of an aromatic group represented by $R_{11}$, $R_{12}$, $R_{13}$, $R_{14}$, $R_{15}$, $R_{16}$, $R_{17}$, $R_{18}$ or $R_{19}$ include phenyl, naphthyl, 3-sulfophenyl, 4-sulfophenyl, 2,5-disulfophenyl, 4-(3-sulfopropyloxy)phenyl, 3-carboxyphenyl, 2-carboxyphenyl, and so on.

Specific examples of a heterocyclic group represented by $R_{11}$, $R_{12}$, $R_{13}$, $R_{14}$, $R_{15}$ or $R_{16}$ include 2-pyridyl, morpholino, 5-sulfobenzimidazole-2-yl, and so on.

Specific examples of 5- or 6-membered ring completed by combining $R_{17}$ with $R_{18}$, or $R_{18}$ with $R_{19}$ include a piperidine ring, a pyrrolidine ring, a morpholine ring, a pyrrolidone ring, and so on.

Specific examples of dyes represented by the general formula (I-b) are illustrated below. However, the present invention should not be construed as being limited to these examples.

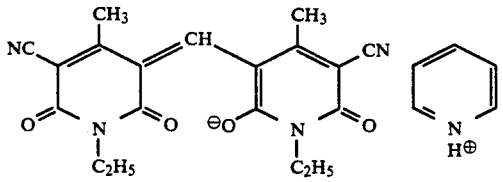

(I-b-1)

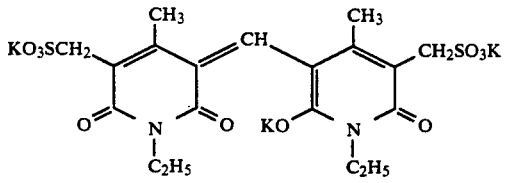

(I-b-2)

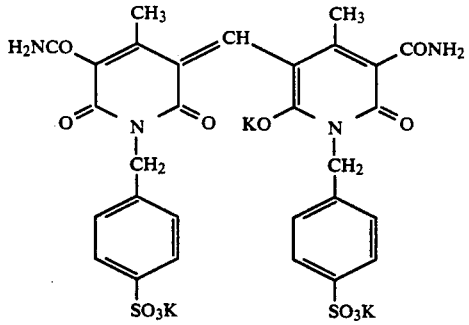

(I-b-3)

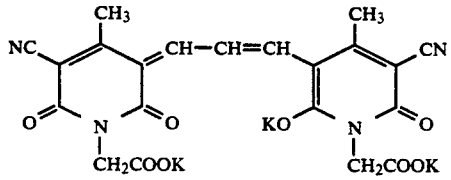

(I-b-4)

-continued
(I-b-5)
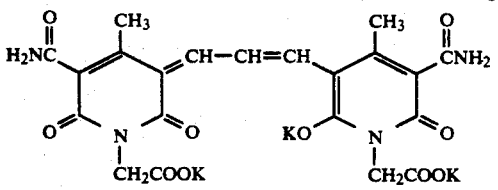
(I-b-6)
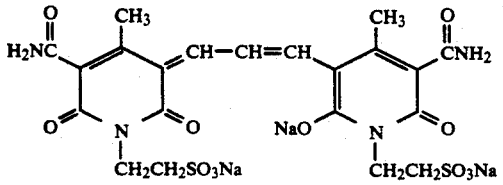
(I-b-7)
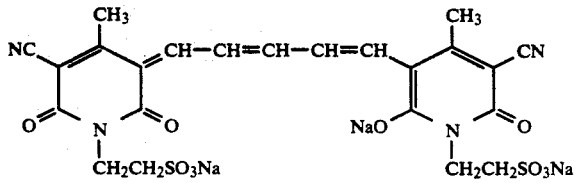
(I-b-8)
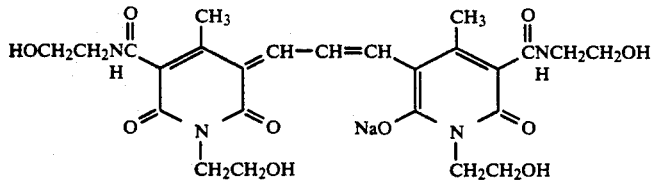
(I-b-9)
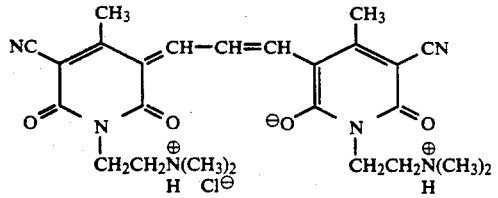
(I-b-10)
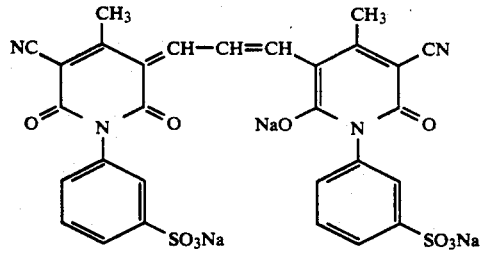
(I-b-11)
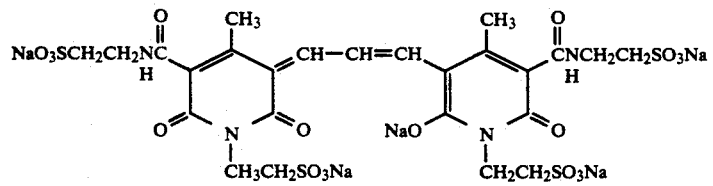
(I-b-12)
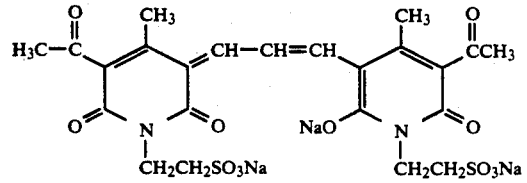

-continued
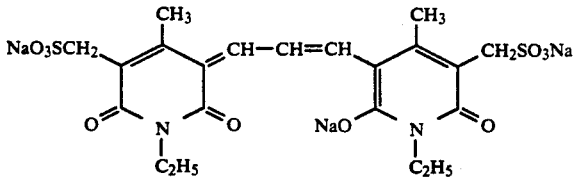
(I-b-13)
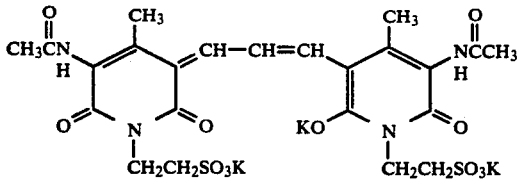
(I-b-14)
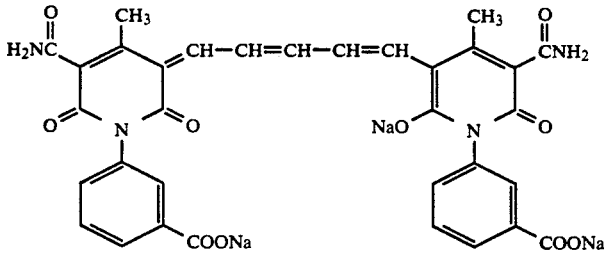
(I-b-15)
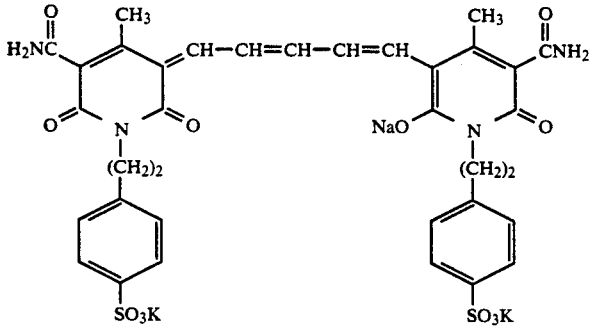
(I-b-16)
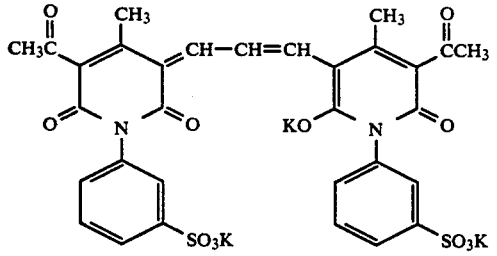
(I-b-17)
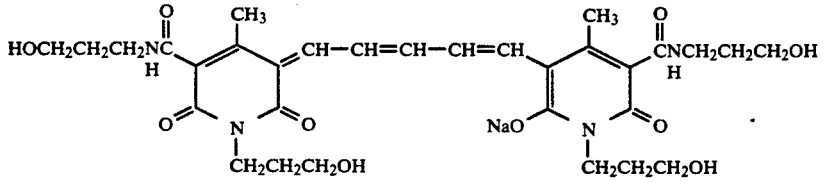
(I-b-18)

-continued

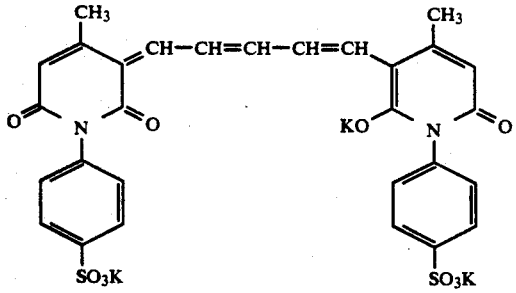

(I-b-19)

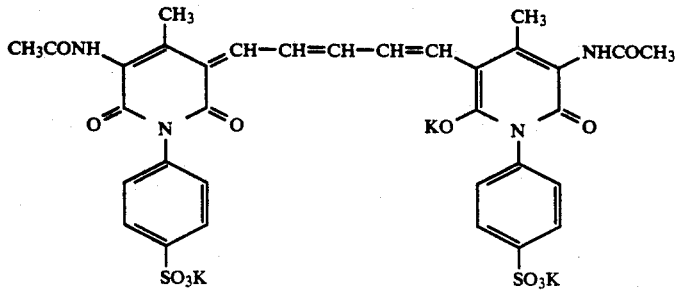

(I-b-20)

The dyes represented by the general formula (I-b) can be synthesized using the methods disclosed in British Patents 1,278,621, 1,512,863 and 1,579,899.

The dyes represented by the general formula (I-c) are described in greater detail below.

Aliphatic groups represented by $R_{21}$, $R_{22}$, $R_{23}$, $R_{24}$, $R_{25}$, $R_{26}$, $R_{27}$, $R_{28}$ and $R_{29}$ may include straight chain, branched, and cyclic alkyl, aralkyl and alkenyl groups. Specific examples of such groups are methyl, ethyl, n-butyl, benzyl, 2-sulfoethyl, 4-sulfobutyl, 2-sulfobenzyl, 2,4-disulfobenzyl, 2-carboxyethyl, carboxymethyl, 2-hydroxyethyl, dimethylaminoethyl, trifluoromethyl, and so on.

Specific examples of aromatic groups represented by $R_{21}$, $R_{22}$, $R_{23}$, $R_{24}$, $R_{25}$, $R_{26}$, $R_{27}$, $R_{28}$ and $R_{29}$ include phenyl, naphthyl, 4-sulfophenyl, 2,5-disulfophenyl, 4-carboxyphenyl, 5,7-disulfo-3-naphthyl, 4-methoxyphenyl, p-tolyl, and so on.

Heterocyclic groups represented by $R_{21}$, $R_{22}$, $R_{24}$ and $R_{25}$ are residues of 5- or 6-membered hetero rings (including condensed rings), with specific examples including 5-sulfopyridine-2-yl, 5-sulfobenzothiazole-2-yl, and so on.

Examples of 5-membered rings formed by combining $R_{30}$ with $R_{21}$, and $R_{31}$ with $R_{24}$ when $Z_{21}$ represents $—NR_{30}$ and $Z_{22}$ represents $—NR_{31}$ include an imidazole ring, a benzimidazole ring, a triazole ring and so on, which may be substituted (such as carboxyl, sulfo, hydroxyl, halogen (e.g., F, Cl, Br), alkyl (e.g., methyl, ethyl), alkoxy (e.g., methoxy, 4-sulfobutoxy), or so on).

Specific examples of dyes represented by the general formula (I-c) are illustrated below. However, the present invention should not be construed as being limited to these examples.

| Compound | $R_{21}$, $R_{24}$ | $R_{22}$, $R_{25}$ | $R_{23}$, $R_{26}$ | $=(L_1—L_2)_{n1}=L_3—(L_4=L_5)_{n2}$ | $Z_{21}$, $Z_{22}$ | $M^{\oplus}$ |
|---|---|---|---|---|---|---|
| I-c-1 | 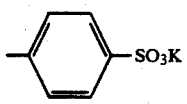 | $—CH_3$ | $—CH_3$ | =CH— | O | H |
| I-c-2 | 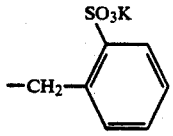 | 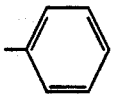 | —COOK | =CH— | O | K |
| I-c-3 | 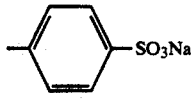 | —H | $—OC_2H_5$ | =CH— | O | H |
| I-c-4 | $—(CH_2)_3SO_3H$ | $—CH_2CH_2OH$ | 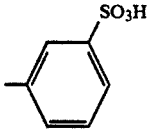 | =CH—CH=CH— | O | H |

-continued

| Compound | $R_{21}$, $R_{24}$ | $R_{22}$, $R_{25}$ | $R_{23}$, $R_{26}$ | $=(L_1-L_2)_{n1}=L_3-(L_4=L_5)_{n2}$ | $Z_{21}$, $Z_{22}$ | $M^{\oplus}$ |
|---|---|---|---|---|---|---|
| I-c-5 | $-(CH_2)_2SO_3K$ | $-COCH_3$ | $-COOK$ | $=CH-CH=CH-$ | O | H |
| I-c-6 | 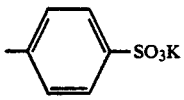 | $-CH_3$ | $-COOC_2H_5$ | $=CH-$ | O | K |
| I-c-7 | 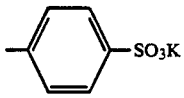 | $-CH_3$ | $-CH_3$ | $=CH-CH=CH-$ | O | H |
| I-c-8 | 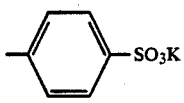 | $-H$ | $-COOK$ | $=CH-CH=CH-$ | O | H |
| I-c-9 | 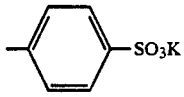 | $-CH_3$ | $-CH_3$ | $=CH+CH=CH\rangle_2$ | O | H |
| I-c-10 | $-CH_2CH_2COOH$ | $-CH_2CH_2OH$ | $-COOH$ | $=CH-CH=CH-$ | O | H |
| I-c-11 | $-CH_2CH_2SO_3K$ | 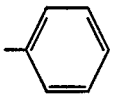 | $-CH_3$ | $=CH-CH=CH-$ | O | H |
| I-c-12 | 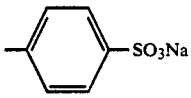 | 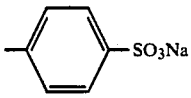 | $-CH_3$ | $=CH-CH=CH-$ | O | H |
| I-c-13 | 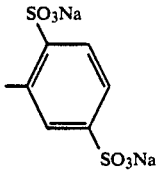 | $-CH_3$ | $-COONa$ | $=CH-CH=CH-$ | O | Na |
| I-c-14 | 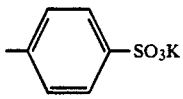 | $-CH_3$ | $-COOK$ | $=CH-CH=CH-$ | O | K |
| I-c-15 | 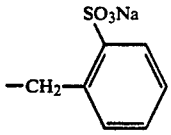 | $-(CH_2)_2SO_3Na$ | $-COONa$ | $=CH-CH=CH-$ | O | H |
| I-c-16 | $-CH_2CH_2SO_3K$ | $-COCH_3$ | $-COOK$ | $=CH-CH=CH-$ | O | H |
| I-c-17 | 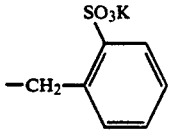 | 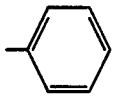 | $-CH_3$ | $=CH-CH=CH-$ | O | K |
| I-c-18 | 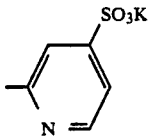 | $-H$ | $-CH_3$ | $=CH-CH=CH-$ | O | H |

-continued

| Compound | $R_{21}$, $R_{24}$ | $R_{22}$, $R_{25}$ | $R_{23}$, $R_{26}$ | $=(L_1-L_2)_{n1}=L_3-(L_4=L_5)_{n2}$ | $Z_{21}$, $Z_{22}$ | $M^{\oplus}$ |
|---|---|---|---|---|---|---|
| I-c-19 | 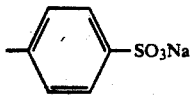 | $-CH_2CH_2OH$ | $-COONa$ | $=CH-CH=CH-$ | O | Na |
| I-c-20 | 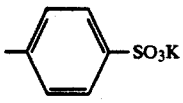 | $-CH_3$ | $-CONHCH_2CH_2OH$ | $=CH-CH=CH-$ | O | K |
| I-c-21 | $-(CH_2)_3SO_3K$ | $-CH_2CH_2COOK$ | 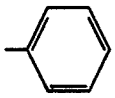 | $=CH-CH=CH-$ | O | H |
| I-c-22 | 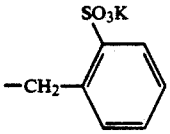 | $-CH_3$ | $-COOK$ | $=CH-CH=CH-$ | O | K |
| I-c-23 | $-CH_2CH_2SO_3K$ | $-CH_3$ | $-COOK$ | $=CH-CH=CH-$ | O | H |
| I-c-24 | 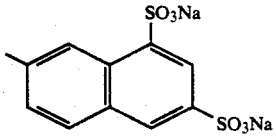 | $-CH_3$ | $-COONa$ | $=CH-CH=CH-$ | O | H |
| I-c-25 | 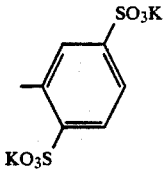 | $-CH_2CH_2OH$ | $-CH_3$ | $=CH-CH=CH-$ | O | H |
| I-c-26 | 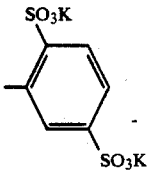 | $-CH_3$ | $-CH_3$ | $=CH(CH=CH)_2$ | O | K |
| I-c-27 | 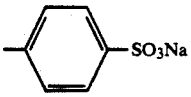 | $-CH_3$ | $-CN$ | $=CH-CH=CH-$ | O | Na |
| I-c-28 | 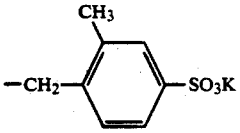 | 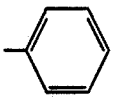 | $-CF_3$ | $=CH-CH=CH-$ | O | K |
| I-c-29 | 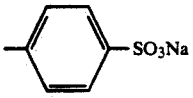 | $-(CH_2)_4SO_3Na$ | $-CH_3$ | $=CH-CH=CH-$ | O | Na |
| I-c-30 | 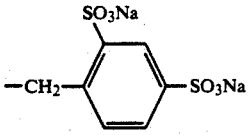 | $-CH_3$ | $-C_4H_9(t)$ | $=CH-CH=CH-$ | O | Na |

The dyes represented by the general formula (I-c) can be synthesized using the methods as disclosed, e.g., in JP-B-39-22069, JP-B-43-3504, JP-B-52-38056, JP-B-54-38129, JP-B-55-10059, JP-A-49-99620, JP-A-59-16834, U.S. Pat. No. 4,181,225, and so on.

The dyes represented by the general formula (I-d) are described in greater detail below.

Aliphatic groups represented by $R_{31}$, $R_{32}$, $R_{33}$ and $R_{34}$ the same groups as defined above with respect to $R_1$, $R_2$, $R_3$ and $R_4$ in the general formula (I-a).

Aromatic groups represented by $R_{31}$, $R_{32}$, $R_{33}$ and $R_{34}$ include the same groups as defined above with respect to $R_1$, $R_2$, $R_3$ and $R_4$ in the general formula (I-a).

Heterocyclic groups represented by $R_{31}$, $R_{32}$, $R_{33}$ and $R_{34}$ include the same groups as defined above with respect to $R_1$, $R_2$, $R_3$ and $R_4$ in the general formula (I-a).

Specific examples of the dyes represented by the general formula (I-d) are illustrated below. However, the present invention should not be construed as being limited to these examples.

| No. | $R_{31}$, $R_{33}$ | $R_{32}$, $R_{34}$ | $=(L_1-L_2)_{n1}=L_3-(L_4=L_5)_{n2}$ | $M^{\oplus}$ |
|---|---|---|---|---|
| I-d-1 | $-C_4H_9(n)$ | $-CH_2COOK$ | $=CH-$ | K |
| I-d-2 | $-CH_2CH_2OH$ | $-C_4H_9(n)$ | $=CH-CH=CH-$ | H |
| I-d-3 | $-CH_2CH_2SO_3K$ | $-C_2H_5$ | $=CH-CH=CH-$ | H |
| I-d-4 | $-CH_2CH_2COOK$ | $-CH_2CH_2COOK$ | $=CH-CH=CH-$ | H |
| I-d-5 | $-CH_3$ | $-CH_3$ | $=CH\leftarrow CH=CH\rightarrow_2$ | H |
| I-d-6 | $-C_4H_5(n)$ | $-CH_2COOK$ | $=CH\leftarrow CH=CH\rightarrow_2$ | H |
| I-d-7 | $-C_6H_5$ | $-CH_2COOK$ | $=CH\leftarrow CH=CH\rightarrow_2$ | H |
| I-d-8 | $-CH_2CH_2SO_3K$ | $-C_4H_9(n)$ | $=CH-$ | H |
| I-d-9 | 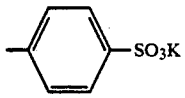 | $-H$ | $=CH-CH=CH-$ | H |
| I-d-10 | $-(CH_2)_3SO_3Na$ | $-H$ | $=CH-CH=CH-$ | H |
| I-d-11 | $-C_6H_5$ | $-(CH_2)_2SO_3K$ | $=CH-$ | H |
| I-d-12 | $-C_6H_5$ | $-(CH_2)_2SO_3K$ | $=CH-CH=CH-$ | H |
| I-d-13 | $-C_6H_5$ | $-(CH_2)_2SO_3K$ | $=CH\leftarrow CH=CH\rightarrow_2$ | H |
| I-d-14 | $-CH_2COOC_2H_5$ | $-C_4H_9(n)$ | $=CH-CH=CH-$ | H |
| I-d-15 | 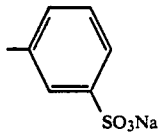 | $-(CH_2)_2SO_3Na$ | $=CH-CH=CH-$ | H |
| I-d-16 | $-CH_3$ | $-(CH_2)_2SO_3K$ | $=CH-$ | H |
| I-d-17 | 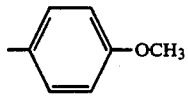 | $-(CH_2)_2SO_3K$ | $=CH-CH=CH-$ | H |
| I-d-18 | 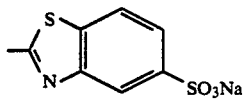 | $-C_2H_5$ | $=CH-CH=CH-$ | H |
| I-d-19 | $-C_6H_{13}(n)$ | $-(CH_2)_2SO_3K$ | $=CH-$ | H |
| I-d-20 | $-(CH_2)_3SO_3Na$ | $-H$ | $=CH-$ | H |

These dyes can be synthesized using methods as disclosed, e.g., in U.S. Pat. Nos. 3,247,127, 3,469,985, 3,653,905 and 4,078,933, and so on.

The dyes represented by the general formula (I-e) are described in greater detail below.

Substituent groups in the dyes represented by the general formula (I-e), namely $R_{35}$, $R_{36}$, $R_{37}$ and $R_{38}$, include alkyl groups (e.g., methyl, ethyl, carboxymethyl, 2-carboxymethyl, 2-hydroxyethyl, methoxyethyl, 2-chloroethyl, benzyl, 2-sulfobenzyl, 4-sulfophenethyl), aryl groups (e.g., phenyl, 4-sulfophenyl, 3-sulfophenyl, 2-sulfophenyl, 4-carboxyphenyl, 3-carboxyphenyl, 4-hydroxyphenyl), and heterocyclic groups (e.g., 2-pyridyl, 2-imidazolyl).

$L_{41}$, $L_{42}$ and $L_{43}$ each represents a methine group. These methine groups may be substituted individually by methyl, ethyl, phenyl, a chlorine atom, sulfoethyl, carboxyethyl, or the like.

$n_{41}$ represents 1, 2 or 3.

However, some of the substituent groups $R_{35}$, $R_{36}$, $R_{37}$ and $R_{38}$ must contain at least one carboxyl or sulfo group, and the sum total of these acidic groups must be at least two. Also, these carboxyl and sulfo groups may assume a salt form (e.g., that of sodium salt, potassium salt, or ammonium salt), as well as a free acid form.

Specific examples of dyes represented by the general formula (I-e) are illustrated below. However, the present invention should not be construed as being limited to these examples.

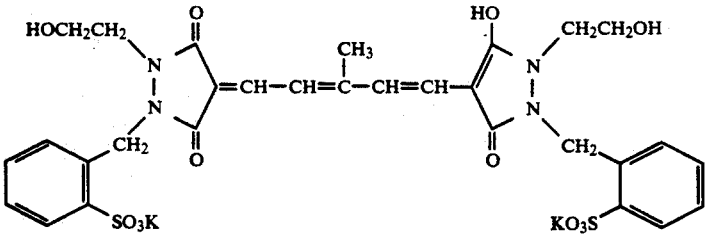
(I-e-1)
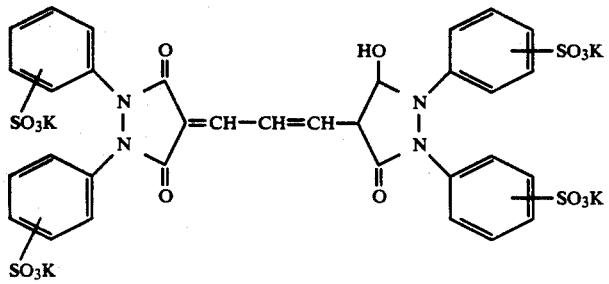
(I-e-2)
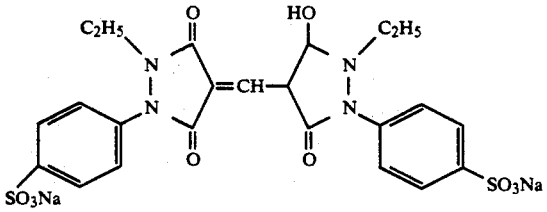
(I-e-3)
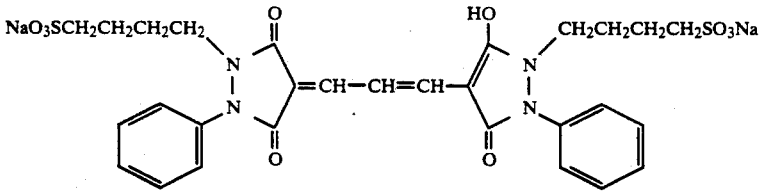
(I-e-4)
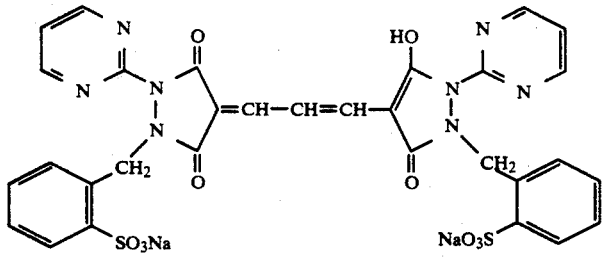
(I-e-5)
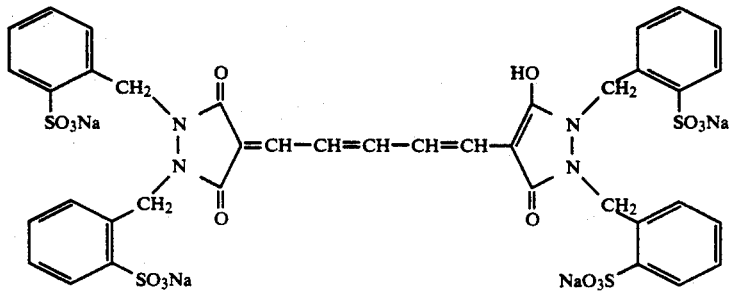
(I-e-6)

-continued

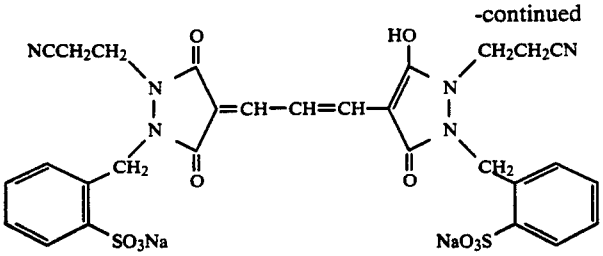

(I-e-7)

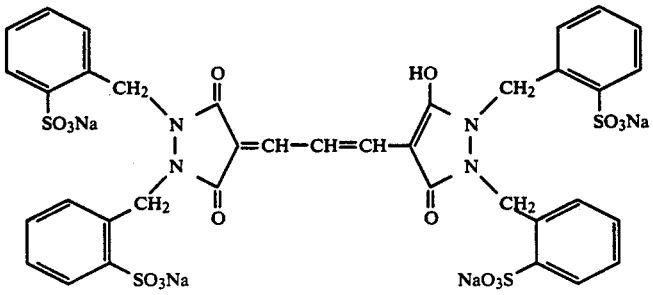

(I-e-8)

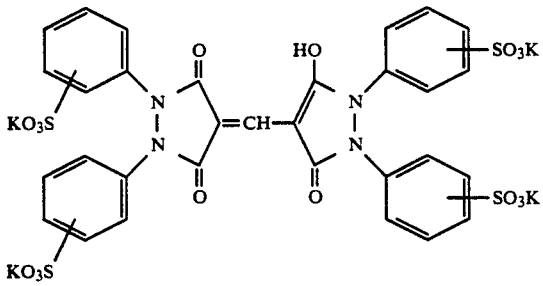

(I-e-9)

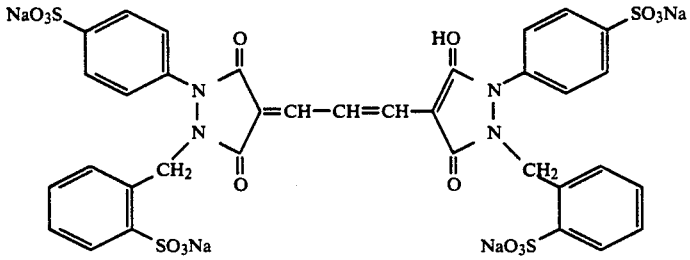

(I-e-10)

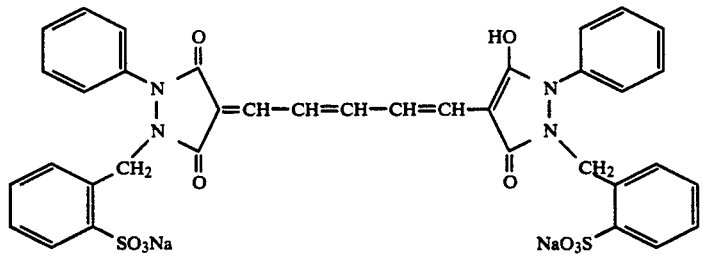

(I-e-11)

Now, dyes represented by the general formula (II) are described in greater detail.

Suitable examples of electron-attracting groups represented by X and Y include a cyano group, a carboxyl group, alkylcarbonyl groups (which preferably contain 7 or less carbon atoms, e.g., acetyl, propionyl, etc., and may be substituted by a halogen atom (e.g., chlorine), or so on), arylcarbonyl groups (the aryl moiety of which is preferably a phenyl or naphthyl group, which may be substituted, e.g., by a sulfo group, a carboxyl group, a hydroxyl group, a halogen atom (e.g., chlorine, bromine), a cyano group, an alkyl group (e.g., methyl, ethyl), an alkoxy group (e.g., methoxy, ethoxy), a carbamoyl group (e.g., methylcarbamoyl), a sulfamoyl group (e.g., ethylsulfamoyl), a nitro group, an alkylsulfonyl group (e.g., methanesulfonyl), an arylsulfonyl group (e.g., benzenesulfonyl), an amino group (e.g., dimethylamino), an acylamino group (e.g., acetylamino, trichloroacetylamino), a sulfonamido group (e.g., methanesulfonamido), or/and so on), alkoxycarbonyl groups (which may have a substituent group, and preferably contain 7 or less carbon atoms, e.g., ethoxycarbonyl, methoxyethoxycarbonyl, etc.), aryloxycarbonyl groups (the aryl moiety of which is preferably a phenyl or naphthyl group, and may have such a substituent group as described above with respect to the arylcarbonyl groups), carbamoyl groups (which may have a substituent group, and preferably contain 7 or less carbon atoms, e.g., methylcarbamoyl, phenylcarbamoyl, 3-sulfophenylcarbamoyl, etc.), alkylsulfonyl groups (which may have a substituent group, e.g., methanesulfonyl, etc.), arylsulfonyl groups (which may have a substituent group, e.g., phenylsulfonyl, etc.), and sulfamoyl groups (which may have a substituent group, e.g., methylsulfamoyl, 4-chlorophenylsulfamoyl, etc.).

Also, X and Y may combine with each other to complete a ring (e.g., a pyrazolone ring, a pyrazolotriazole ring, an oxyindole ring, an isoxazolone ring, a barbituric acid ring, a thiobarbituric acid ring, an indanedione ring, a pyridone ring). Of these rings, a pyrazolone ring is favored over others.

$R_{41}$ and $R_{42}$ each represents a hydrogen atom, a halogen atom (e.g., chlorine, bromine), an alkyl group (which may have a substituent group, and preferably contains 5 or less carbon atoms, e.g., methyl, ethyl, etc.), an alkoxy group (which may have a substituent group, and preferably contains 5 or less carbon atoms, e.g., methoxy, ethoxy, 2-chloroethoxy, etc.), a hydroxyl group, a carboxyl group, a substituted amino group (e.g., acetylamino, methylamino, diethylamino, methanesulfonylamino), a carbamoyl group (which may have a substituent group, e.g., methylcarbamoyl, etc.), a sulfamoyl group (which may have a substituent group, e.g., ethylsulfamoyl, etc.), an alkoxycarbonyl group (e.g., methoxycarbonyl), or a sulfo group.

$R_{43}$ and $R_{44}$ each represents a hydrogen atom, an alkyl group (which preferably contains 8 or less carbon atoms, such as methyl, ethyl, propyl, butyl, etc., and may be substituted, e.g., by a sulfo group, a carboxyl group, a halogen atom, a hydroxyl group, a cyano group, an alkoxy group, an alkylcarbonyl group, an arylcarbonyl group, an acyloxy group, an acylamino group, a carbamoyl group, a sulfamoyl group, an alkylamino group, a dialkylamino group, an alkoxycarbonyl group, an aryloxycarbonyl group, an alkylsulfonyl group, an arylsulfonyl group, a sulfonylamino group, a ureido group, an aryl group, or so on), an alkenyl group (which may have a substituent group, e.g., 3-hexenyl, etc.), an aryl group (preferably a phenyl group, which may be substituted by such a group as to be cited as substituents for the arylcarbonyl groups represented by X and Y), an acyl group (e.g., acetyl, benzoyl), or a sulfonyl group (e.g., methanesulfonyl, phenylsulfonyl).

Further, $R_{43}$ and $R_{44}$ may combine with each other to complete a 5- or 6-membered hetero ring (e.g., a piperidine ring, a morpholine ring, etc.).

Furthermore, $R_{41}$ and $R_{42}$ may combine with $R_{43}$ and $R_{44}$, respectively, to complete a 5- or 6-membered hetero ring.

At least one of the substituents X, Y, $R_{41}$, $R_{42}$, $R_{43}$ and $R_{44}$ contains a sulfo or carboxyl group. These sulfo and carboxyl groups may assume a salt form (e.g., that of sodium salt, potassium salt, triethylammonium salt, pyridinium salt, or ammonium salt), as well as a free-acid form.

A methine group represented by $L_{11}$, $L_{12}$ and $L_{13}$ each may have a substituent group (e.g., methyl, ethyl, cyano, phenyl, chlorine, sulfoethyl). k represents 0 or 1.

Specific examples of dyes represented by the general formula (II) are illustrated below.

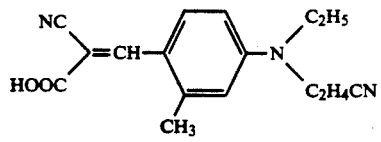

II-1

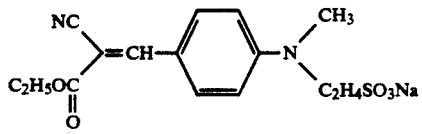

II-2

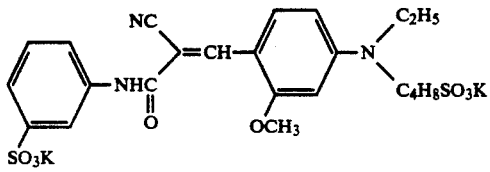

II-3

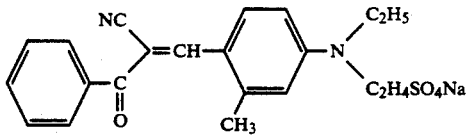

(II-4)

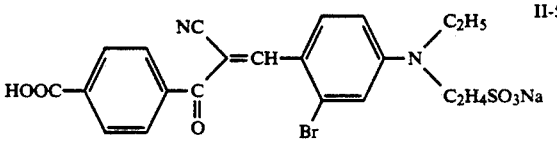

II-5

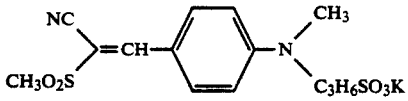

II-6

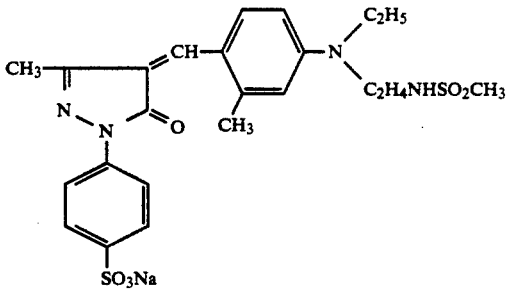

II-7

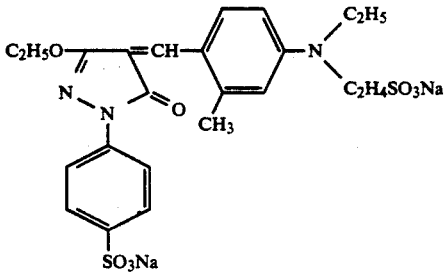

II-8

-continued
II-9
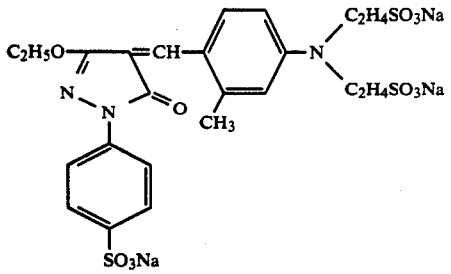
II-10
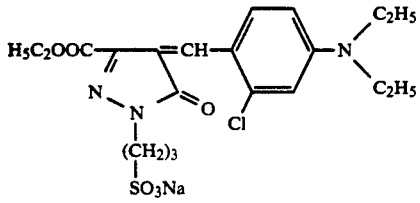
II-11
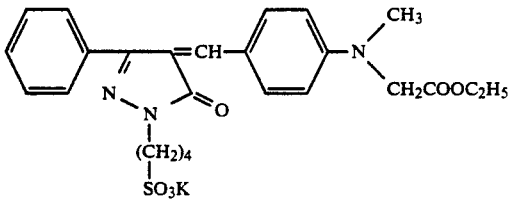
II-12
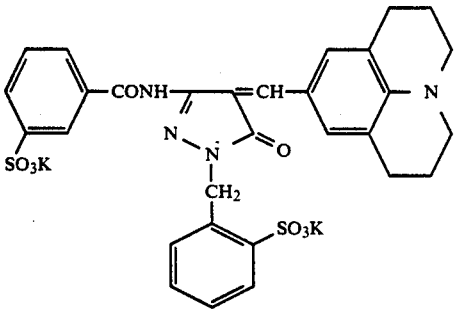
II-13
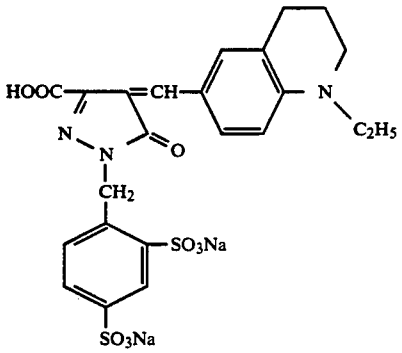
-continued
II-14
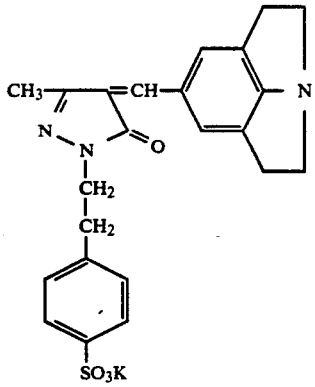
II-15
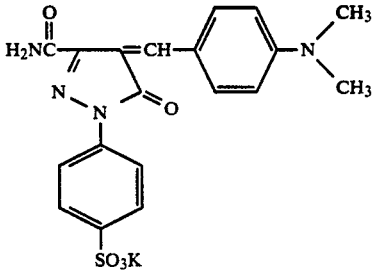
II-16
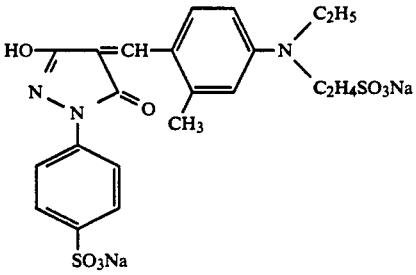
II-17
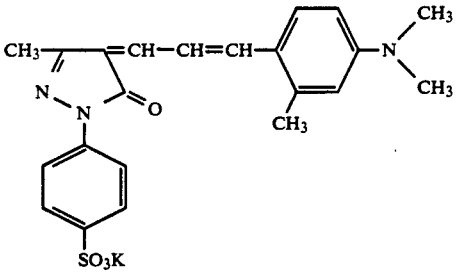
II-18
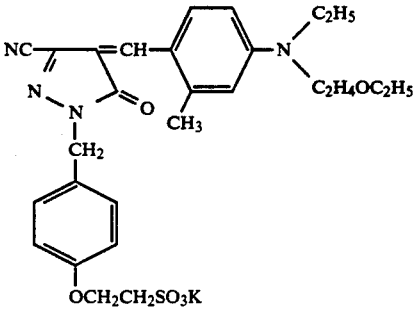

-continued

II-19

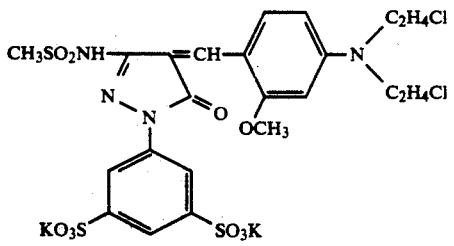

II-20

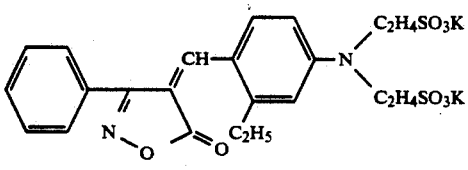

II-21

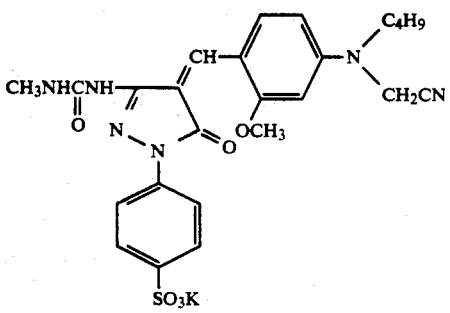

II-22

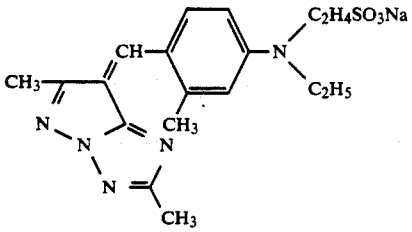

-continued

II-23

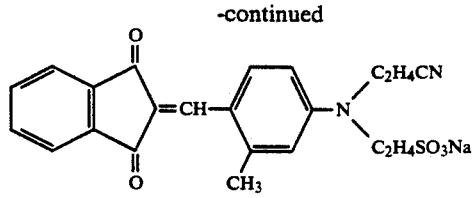

II-24

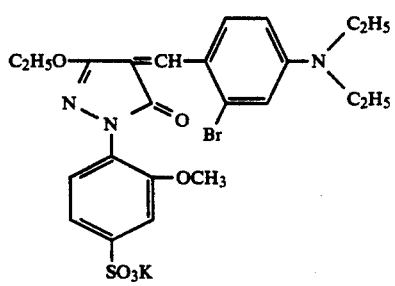

The dyes represented by the general formula (II) can be synthesized easily using the methods as disclosed in JP-A-51-3623 and so on.

The dyes represented by the general formula (III) are illustrated in detail below.

Aryl groups represented by $Ar_1$ and $Ar_2$ are preferably a phenyl or naphthyl group, which may be substituted (e.g., with a sulfo group, a carboxylic group, a hydroxyl group, an alkyl group containing 1 to 6 carbon atoms (e.g., methyl, ethyl, n-propyl, isopropyl), an alkoxy group containing 1 to 6 carbon atoms (e.g., methoxy, ethoxy, butoxy), a carbamoyl group, a sulfamoyl group, a halogen atom (e.g., F, Cl, Br), a cyano group, a nitro group, etc.).

Heterocyclic groups represented by $Ar_1$ and $Ar_2$ are preferably 5- or 6-membered nitrogen-containing groups, e.g., 1-(4-sulfophenyl)-3-carboxy-5-hydroxy-4-pyrazolyl, 1-(4-sulfophenyl)-3-methyl-5-hydroxy-4-pyrazolyl, 1-(2,5-disulfophenyl)-3-carboxy-5-hydroxy-4-pyrazolyl, 1-carboxymethyl-3-carbamoyl-1,2-dihydro-6-hydroxy-4-methyl-2-oxopyridyl, 1-(2-sulfoethyl)-3-cyano-1,2-dihydro-6-hydroxy-4-methyl-2-oxopyridyl, etc.

Specific examples of the dyes represented by the general formula (III) are illustrated below.

III-1

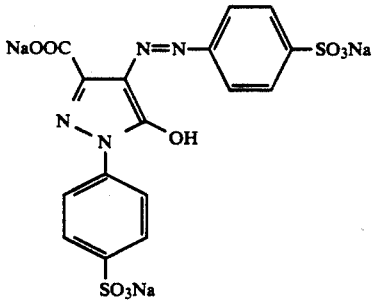

III-2

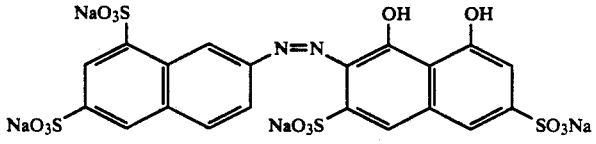

-continued
III-3
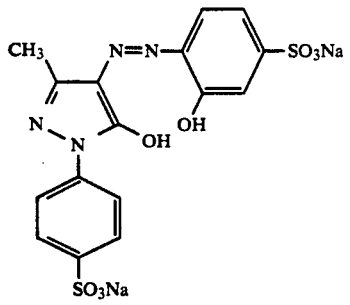
III-4
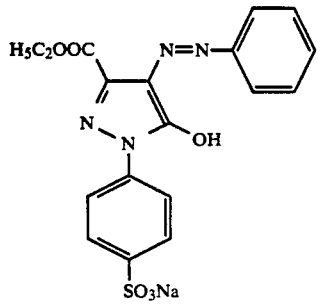
III-5
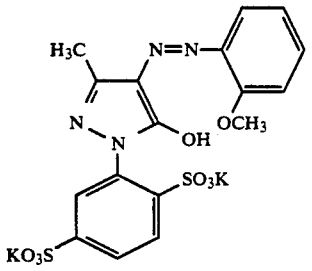
III-6
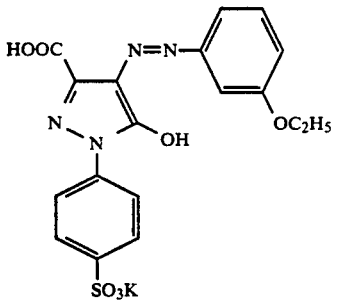
III-7
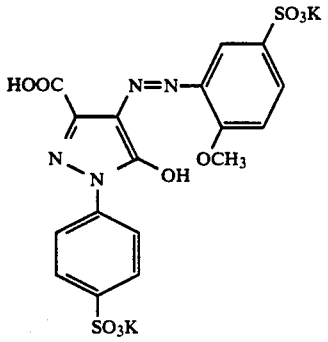

-continued
III-8
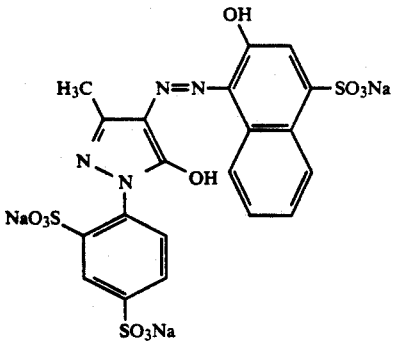
III-9
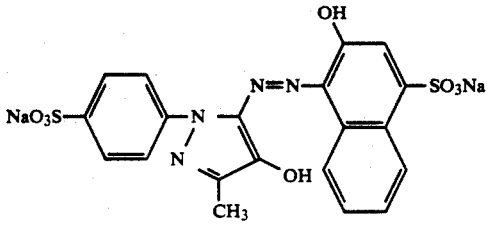
III-10
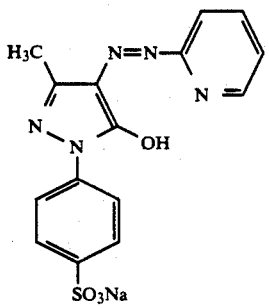
III-11
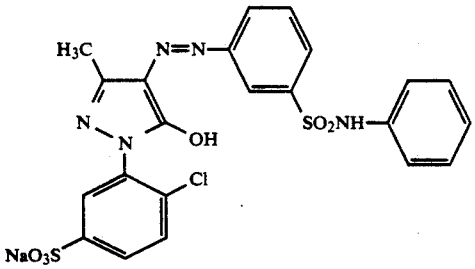
III-12
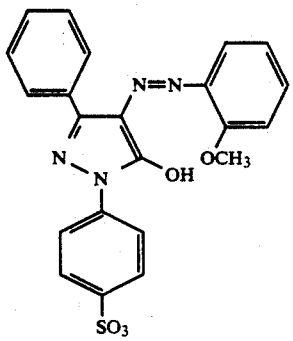

-continued
III-13
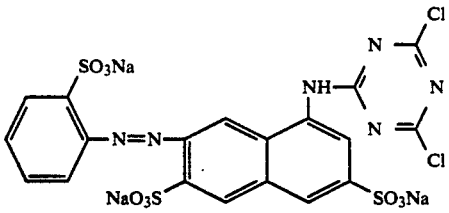
III-14
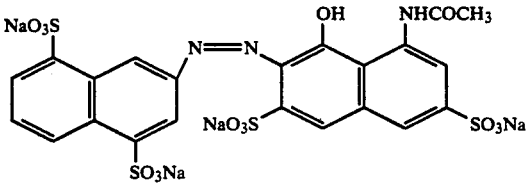
III-15
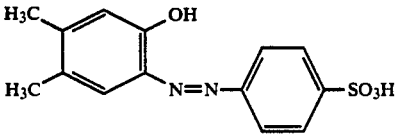
III-16
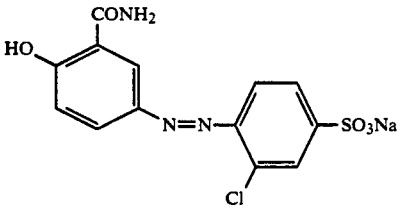
III-17
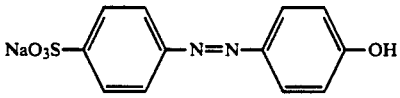
III-18
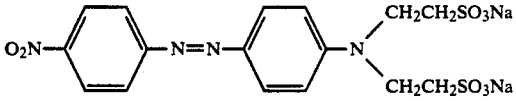
III-19
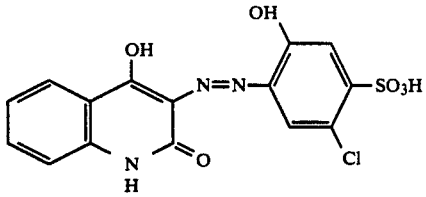
III-20
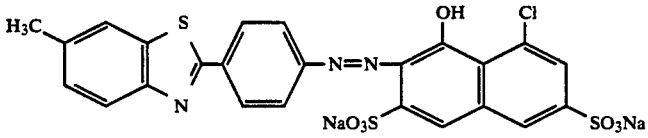
III-24
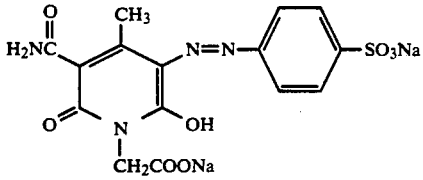

-continued

III-25

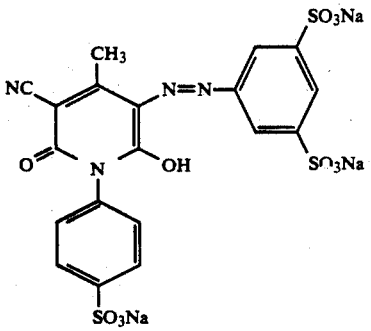

The dyes represented by the general formula (III) can be synthesized using the methods disclosed in British Patents 575,691, 907,125 and 1,353,525.

Specific examples of dyes represented by the general formula (IV) are illustrated below.

IV-1

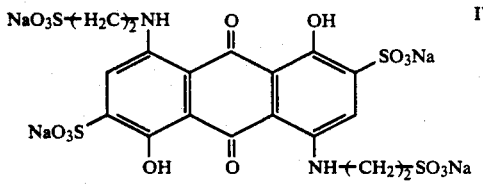

IV-2

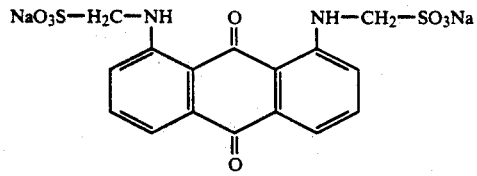

IV-3

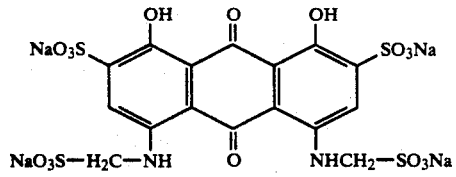

IV-4

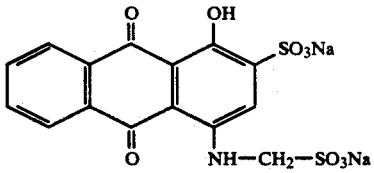

IV-5

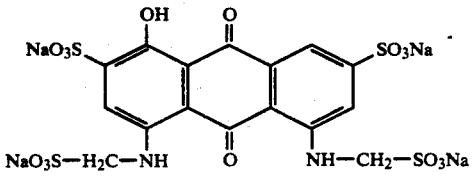

-continued

IV-6

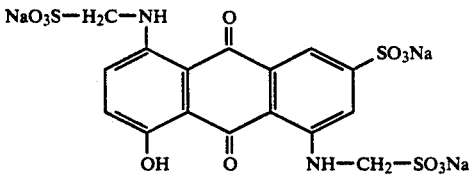

IV-7

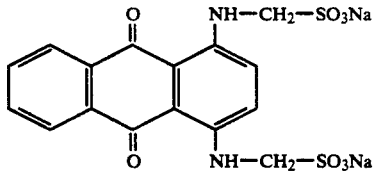

IV-8

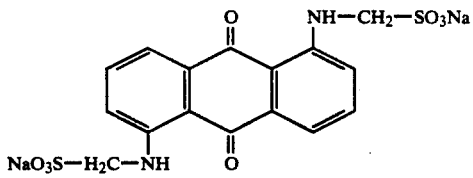

IV-9

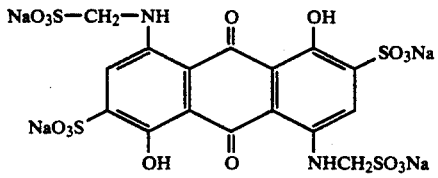

The dyes represented by the general formula (IV) can be synthesized using the method disclosed in U.S. Pat. No. 2,865,752.

Specific examples of dyes represented by the general formula (V) are illustrated below.

V-1
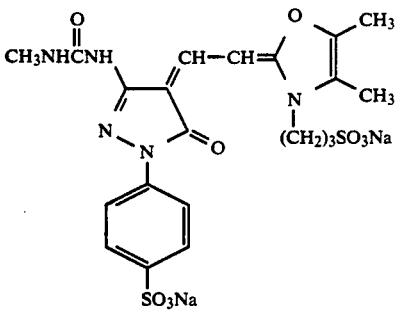
V-2
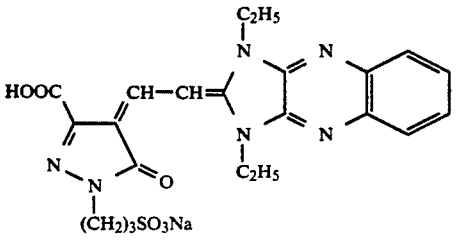
V-3
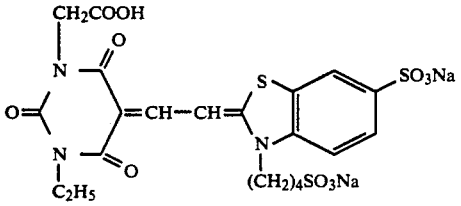
V-4
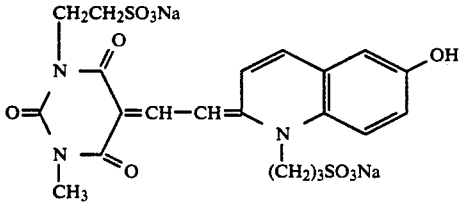
V-5
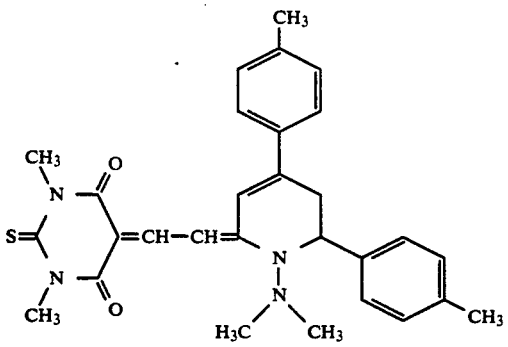
V-6
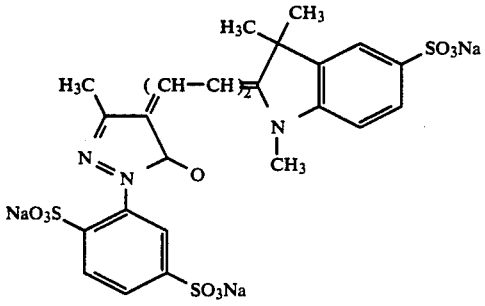

-continued
V-7
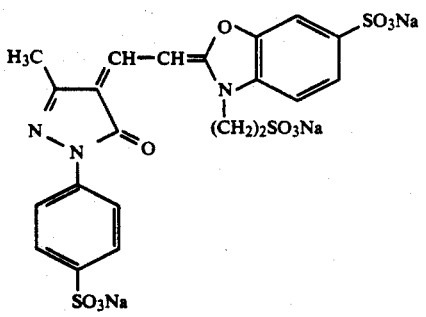
V-8
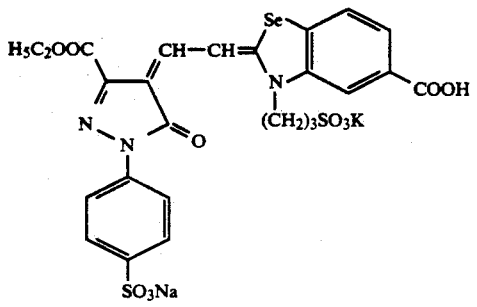
V-9
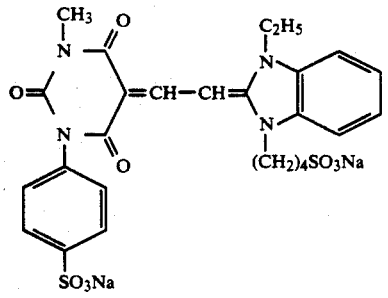
V-10
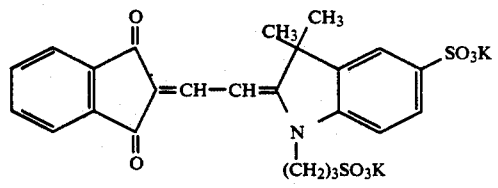
V-11
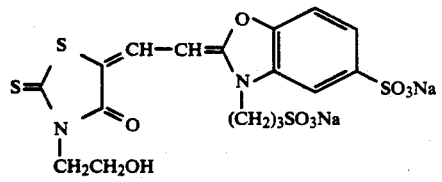
V-12
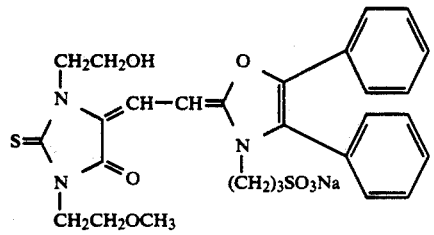

-continued
V-13
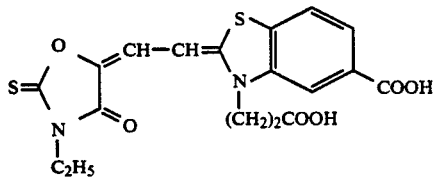
V-14
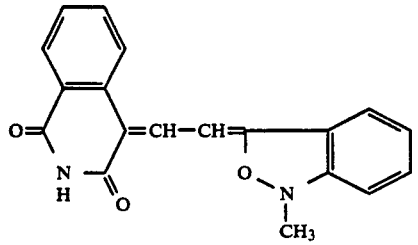
V-15
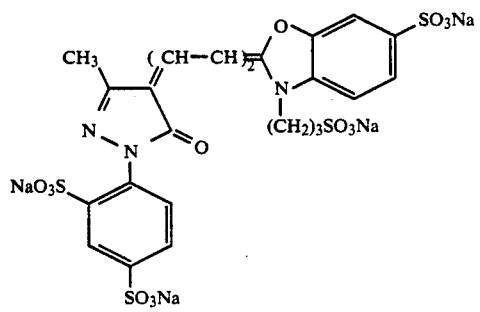
V-16
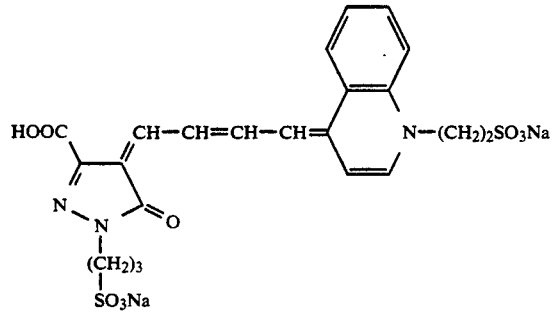
V-17
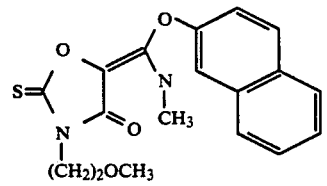
V-18
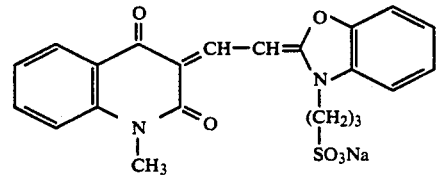

-continued
V-19
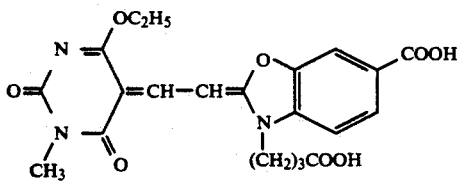
V-20
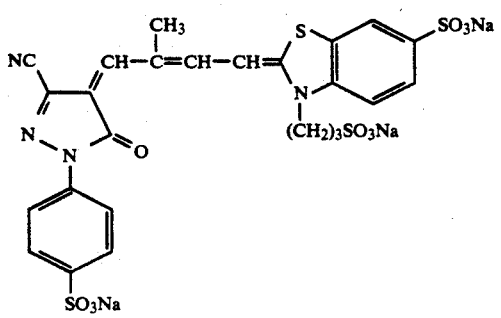
V-21
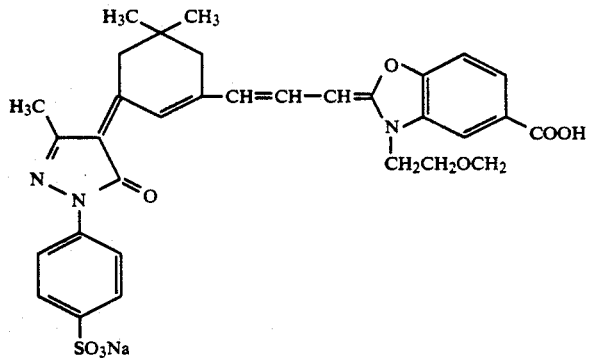
V-22
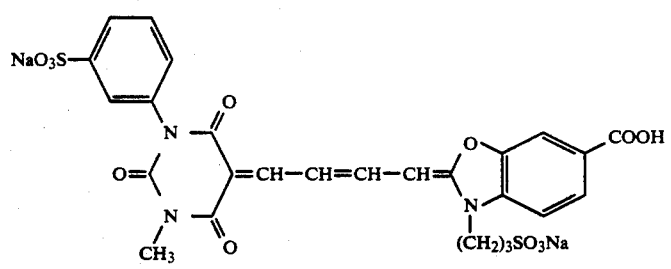
V-23
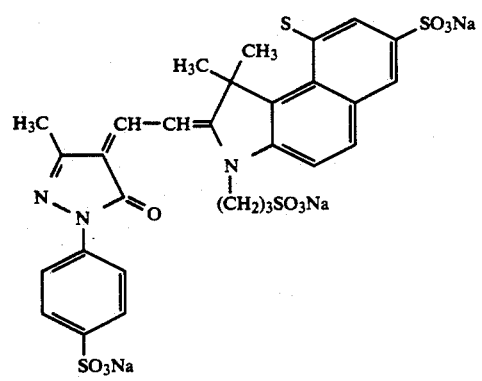

-continued
V-24
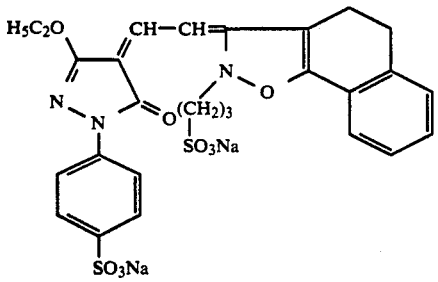
V-25
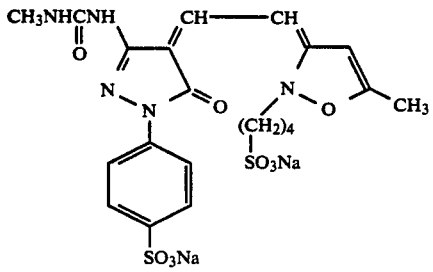
V-26
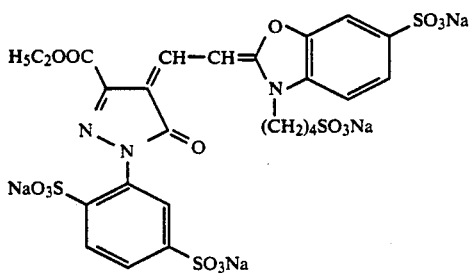
V-27
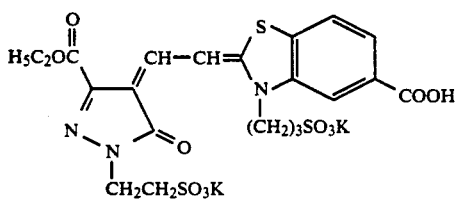
V-28
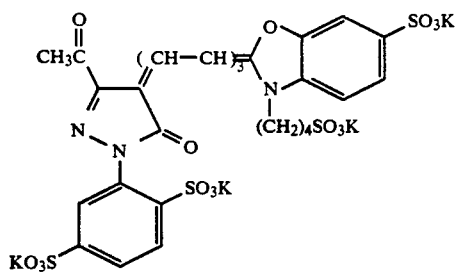
The dyes represented by the general formula (V) can be synthesized by the method disclosed in F. M. Harmer, "The Cyanine Dyes and Related Compounds", Interscience Publishers (1964).
Specific examples of dyes represented by the general formula (VI) are illustrated below.
VI-1
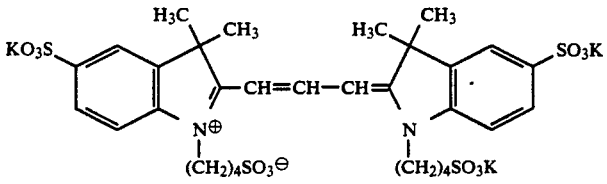

-continued
VI-2
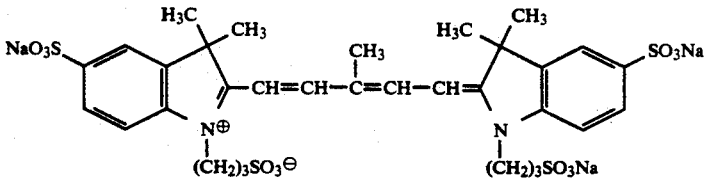
VI-3
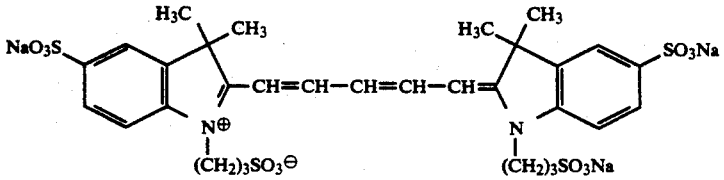
VI-4
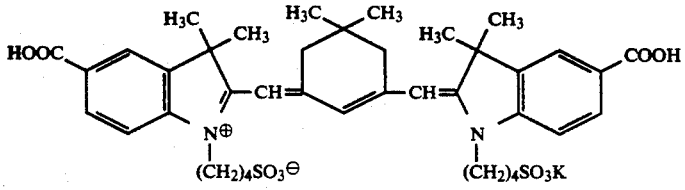
VI-5
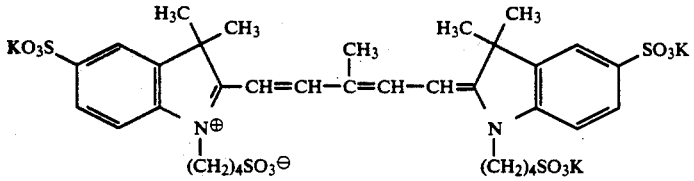
VI-6
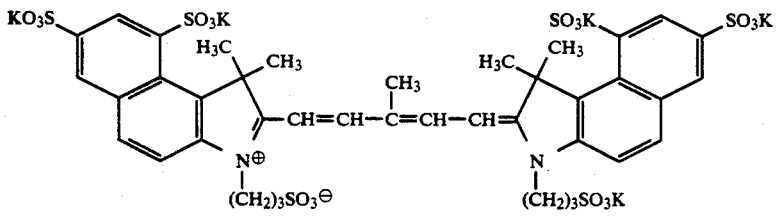
VI-7
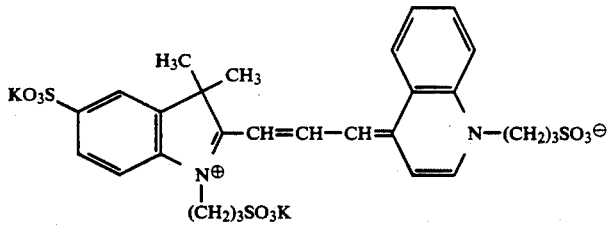
VI-8
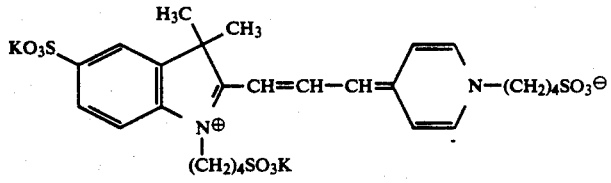
VI-9
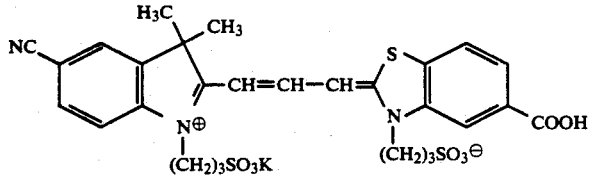

-continued

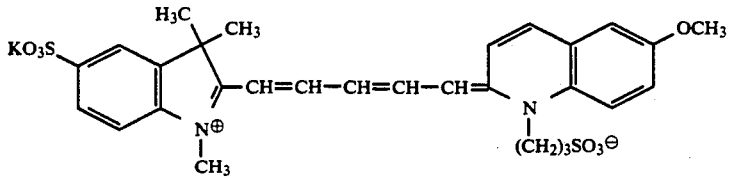

VI-10

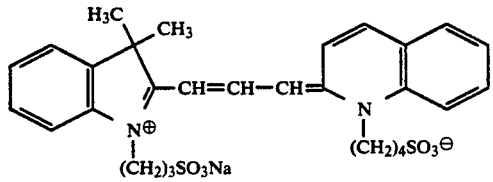

VI-11

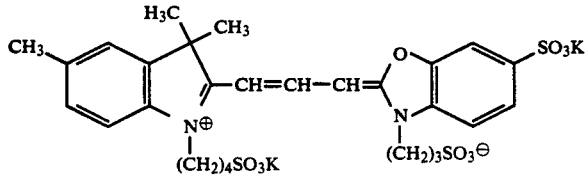

VI-12

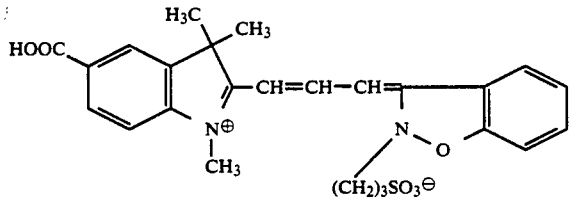

VI-13

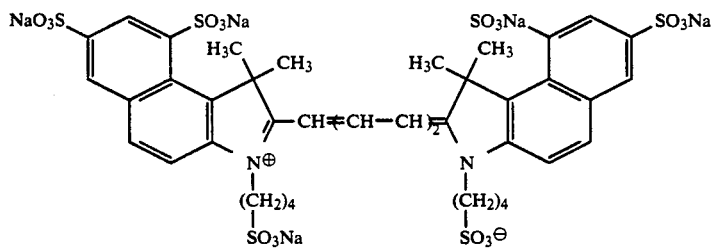

VI-14

The dyes represented by the general formula (VI) can be synthesized by the methods disclosed in F. M. Harmer, "The Cyanine Dyes and Related Compounds", Interscience Publishers (1964).

Water-insoluble but organic solvent-soluble polymers preferably employed in the present invention are those having a glass transition point of 60° C. or above, particularly 90° C. or above.

Examples of such polymers having desirable structures of the foregoing polymers include:

(1) Water-insoluble but organic solvent-soluble homo- or copolymers, which have a repeating unit containing a

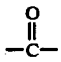

linkage in the main chain or in a side chain.

Examples of those polymers having more preferred structures of the above described polymers are:

(2) Water-insoluble but organic solvent-soluble homo- or copolymers, which have a repeating unit containing a

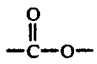

linkage in the main chain or in a side chain, and (3) Water-insoluble but organic solvent-soluble homo- or copolymers, which have a repeating unit containing a

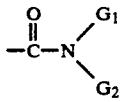

group (wherein $G_1$ and $G_2$ are each a hydrogen atom, or a substituted or unsubstituted alkyl or aryl group, provided that both $G_1$ and $G_2$ cannot simultaneously be hydrogen) in the main or in a side chain.

Most preferred polymers are the above described polymers (3) in which either $G_1$ or $G_2$ is hydrogen, and the other is a substituted or unsubstituted alkyl or aryl group which contains 3 to 12 carbon atoms.

The polymers suitable for the present invention are described in detail below with specific examples being given. However, the present invention should not be construed as being limited to these examples.

(A) Vinyl Polymers

Monomers of the vinyl polymers of the present invention include:

Acrylic acid esters: Specific examples include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition mol number n=9), 1-bromo-2-methoxyethyl acrylate, 1,1-dichloro-2-ethoxyethyl acrylate, and so on.

In addition, the following monomers can be used.

Methacrylic acid esters: Specific examples thereof include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl—N-phenylaminoethyl methacrylate, 2-(3-phenylpropyloxy)ethyl methacrylate, diethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition mol number n=6), allyl methacrylate, methacrylic acid dimethylaminoethylmethyl chloride, and so on.

Vinyl esters: Specific examples thereof include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, and so on.

Acrylamides: Specific examples thereof include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetoneacrylamide, tert-octylacrylamide, and so on.

Methacrylamides: Specific examples thereof include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide, and so on.

Olefins: Specific examples thereof include dicyclopentadiene, ethylene, propylene, 1-butene, 1-pentene, vinyl chloride, vinylidene chloride, isoprene, chloroprene, butadiene, 2,3-dimethylbutadiene, and so on.

Styrenes: Specific examples thereof include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, vinylbenzoic acid methyl ester, and so on.

Vinyl ethers: Specific examples thereof include methyl vinyl ether, butyl vinyl ether, hexyl vinyl ether, methoxyethyl vinyl ether, dimethylaminoethyl vinyl ether, and so on.

Other monomers: Specific examples thereof include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalononitrile, vinylidene, and so on.

The monomers forming the polymers of the present invention (e.g., those described above) can comprise two or more of the above described monomers depending on the purposes (e.g., improvement in solubility). Moreover, acid group-containing monomers, examples of which are given below, can be used as comonomers in order to control the color developability and the solubility so long as they do not render, in substantial sense, the resulting copolymers soluble in water.

Specific examples of such monomers include acrylic acid; methacrylic acid; itaconic acid; maleic acid; itaconic acid monoalkyl esters, such as monomethyl itaconate, monoethyl itaconate, monobutyl itaconate, etc.; maleic acid monoalkyl esters, such as monomethyl maleate, monoethyl maleate, monobutyl maleate, etc.; citraconic acid; styrenesulfonic acid; vinylbenzylsulfonic acid; vinylsulfonic acid; acryloyloxyalkylsulfonic acid, such as acryloyloxymethylsulfonic acid, acryloyloxyethylsulfonic acid, acryloyloxypropylsulfonic acid, etc.; methacryloyloxyalkylsulfonic acids, such as methacryloyloxymethylsulfonic acid, methacryloyloxyethylsulfonic acid, methacryloyloxypropylsulfonic acid, etc.; acrylamidoalkylsulfonic acids, such as 2-acrylamido-2-methylethanesulfonic acid, 2-acrylamido-2-methylpropanesulfonic acid, 2-acrylamido-2-methylbutanesulfonic acid, etc.; methacrylamidoalkylsulfonic acids, such as 2-methacrylamido-2-methylethanesulfonic acid, 2-methacrylamido-2-methylpropanesulfonic acid, 2-methacrylamido-2-methylbutanesulfonic acid, etc.; and so on.

These acids may be an alkali metal salt (e.g., Na salt, K salt) thereof, or an ammonium salt thereof.

When hydrophilic monomers (which are herein intended to include those which are hydrophilic as a monopolymer) of the above described vinyl monomers and other vinyl monomers usable in the present invention are used as comonomers, they are not particularly limited as to the amount present in the resulting copolymers unless the resulting copolymers become hydrophilic. In general, the proportion of such monomers is preferably 40 mol % or less, more preferably 20 mol % or less, and most preferably 10 mol % or less. When hydrophilic comonomers which are copolymerized with the monomers of the present invention contain acid group(s), the proportion of the acid group-containing comonomers is controlled to generally 20 mol % or less, preferably 10 mol % or less, and most preferably 0%, from the standpoint of image keeping quality, as described above.

Advantageous monomers in the polymers of the present invention include those of the acrylate type, the acrylamide type and the methacrylamide type. Of these, monomers of the acrylamide type and those of the methacrylamide type are preferred in particular.

(B) Condensation Polymers and Addition Polymers

Suitable condensation polymers include polyesters prepared from polyhydric alcohols and polybasic acids, and polyamides prepared from diamines, dibasic acids and ω-amino-ω'-carboxylic acids and these are generally known. As for addition polymers, on the other hand, polyurethanes prepared from diisocyanates and dihydric alcohols, and so on are known.

Polyhydric alcohols which can be used effectively include glycols having the formula $OH—R_1—OH$ (wherein $R_1$ represents a hydrocarbon chain containing from 2 to about 12 carbon atoms, especially an aliphatic hydrocarbon chain), and polyalkylene glycols. Polybasic acids which can be used effectively include those having the formula $HOOC—R_0—COOH$ (wherein $R_0$ represents a bonding hand, or a hydrocarbon chain containing from 1 to about 12 carbon atoms).

Specific examples of polyhydric alcohols include ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerol, diglycerol, triglycerol, 1-methylglycerol, erythritol, mannitol, sorbitol, and so on.

Specific examples of polybasic acids include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid phthalic acid, isophthalic acid, terephthalic acid, tetrachlorophthalic acid, mesaconic acid, isopimelic acid, cyclopentadiene-maleic anhydride adduct, rosinmaleic anhydride adduct, and so on.

Specific examples of diamines are hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene, di(4-aminophenyl) ether, and so on.

Specific examples of ⅔-amino-⅔'-carboxylic acids include glycine, β-alanine, 3-aminopropanoic acid, 4-aminobutanoic acid, 5-aminopentancic acid, 11-aminododecanoic acid, 4-aminobenzoic acid, 4-(2-aminoethyl)benzoic acid, 4-(4-aminophenyl)butanoic acid, and so on.

Specific examples of diisocyanates include ethylenediisocyanate, hexamethylenediisocyanate, m-phenylenediisocyanate, p-phenylenediisocyanate, p-xylenediisocyanate, 1,5-naphthylenediisocyanate, and so on.

(C) Others

Polyesters and polyamides obtained through ring opening polymerization are suitable examples.

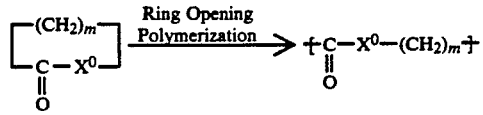

In the above formula, $X^0$ represents —O— or —NH—, and m represents an integer from 4 to 7. The moiety $—CH_2—$ may assume a branched form.

Specific examples of such monomers include β-propiolactone, ε-caprolactone, dimethylpropiolactone, α-pyrrolidone, α-piperidone, ε-caprolactam, α-methyl-ε-caprolactam, and so on.

The above described polymers suitable for the present invention may be used as a mixture of two or more thereof.

The effects of the polymers of the present invention do not depend substantially upon their molecular weights and polymerization degrees. However, the higher the molecular weight becomes, the more likely the following difficulties are to occur. That is, when the polymers have higher molecular weights, a longer time is required to dissolve them in an auxiliary solvent, and emulsifying dispersion becomes more difficult because of the tendency of formation of coarse particles and they have higher viscosity in a dissolved condition. This results in a reduction in color developability and worsening of the coated condition. If an attempt is made to decrease the viscosity of the polymer solution by the addition of a large quantity of auxiliary solvent, problems, or an increase in the number of procedural steps arises. Accordingly, the viscosity measured when 30 g of polymer is dissolved in 100 ml of an auxiliary solvent is preferably 5,000 cps or less, and more preferably 2,000 cps or less, and the molecular weight of a polymer suitable for the present invention is preferably 150,000 or less, and more preferably 100,000 or less.

The term "water-insoluble polymer" in the present invention refers to a polymer having a solubility such that the amount of the polymer which dissolves in 100 g of distilled water is below 3 g, preferably below 1 g.

The proportion of the polymer of the present invention to auxiliary solvent depends on the kind of polymer used, and can be varied over a wide range depending on the solubility of the polymer in the auxiliary solvent used, the degree of polymerization, the solubilities of couplers used in combination therewith, and so on. In dissolving at least three ingredients, namely a coupler, a high boiling coupler solvent and the polymer, in an auxiliary solvent, the auxiliary solvent is generally used in the amount which results in a viscosity sufficiently low that the dispersion into water or an aqueous solution of hydrophilic colloid is facilitated. Since the viscosity of the solution becomes higher the higher the polymerization degree of the dissolved polyme is, it is difficult to determine the ratio of the polymer to the auxiliary solvent specifically since it depends on the kind of polymer. In general, however, it is desirable for the ratio to range from about 1/1 to about 1/50 by weight. On the other hand, the ratio of the polymer to a coupler ranges preferably 1/20 to 20/1, more preferably from 1/10 to 10/1, by weight.

Some specific examples of the water-insoluble polymers which can be used in the present invention are given below. In copolymers, ratios are by mol. Of course, the present invention is not to be construed as being limited to these examples.

P- 1) Polyvinyl acetate
P- 2) Polyvinyl propionate
P- 3) Polymethyl methacrylate
P- 4) Polyethyl methacrylate
P- 5) Polyethyl acrylate
P- 6) Vinyl acetate/vinyl alcohol copolymer (95/5)
P- 7) Poly(n-butyl acrylate)
P- 8) Poly(n-butyl methacrylate)
P- 9) Polyisobutyl methacrylate
P- 10) Polyisopropyl methacrylate
P- 11) Polydecyl methacrylate
P- 12) n-Butyl acrylate/acrylamide copolymer (95/5)
P- 13) Polymethyl chloroacrylate
P- 14) 1,4-Butanediol-adipic acid polyester
P- 15) Ethylene glycol-cebacic acid polyester
P- 16) Polycaprolactone
P- 17) Poly(2-tert-butylphenyl acrylate)
P- 18) Poly(4-tert-butylphenyl acrylate)
P- 19) n-Butyl methacrylate/N-vinyl-2-pyrrolidone copolymer (90/10)
P- 20) Methyl methacrylate/vinyl chloride copolymer (70/30)
P- 21) Methyl methacrylate/styrene copolymer (90/10)
L- P- 22) Methyl methacrylate/ethyl acrylate copolymer (50/50)
P- 23) n-Butyl methacrylate/methyl methacrylate/styrene copolymer (50/30/20)
P- 24) Vinyl acetate/acrylamide copolymer (85/15)
P- 25) Vinyl chloride/vinyl acetate copolymer (65/35)
P- 26) Methyl methacrylate/acrylonitrile copolymer (65/35)
P- 27) Diacetoneacrylamide/methyl methacrylate copolymer (50/50)
P- 28) Vinyl methyl ketone/isobutyl methacrylate copolymer (55/45)
P- 29) Ethyl methacrylate/n-butyl acrylate copolymer (70/30)
P- 30) Diacetoneacrylamide/n-butyl acrylate copolymer (60/40)
P- 31) Methyl methacrylate/cyclohexyl methacrylate copolymer (50/50)
P- 32) n-Butyl acrylate/styrene methacrylate/-diacetoneacrylamide (70/20/10)
P- 33) N-tert-Butylmethacrylamide/methyl methacrylate/acrylic acid copolymer (60/30/10)
P- 34) Methyl methacrylate/styrene/vinyl sulfonamide copolymer (70/20/10)
P- 35) Methyl methacrylate/phenyl vinyl ketone copolymer (70/30)
P- 36) n-Butyl acrylate/methyl methacrylate/n-butyl methacrylate copolymer (35/35/30)
P- 37) n-Butyl methacrylate/pentyl methacrylate/N-vinyl-2-pyrrolidone copolymer (38/38/24)
P- 38) Methyl methacrylate/n-butyl methacrylate/isobutyl methacrylate/acrylic acid copolymer (37/29/25/9)
P- 39) n-Butyl methacrylate/acrylic acid copolymer (95/5)
P- 40) Methyl methacrylate/acrylic acid copolymer (95/5)
P- 41) Benzyl methacrylate/acrylic acid copolymer (90/10)
P- 42) n-Butyl methacrylate/methyl methacrylate/benzyl methacrylate/acrylic acid copolymer (35/35/25/5)
P- 43) n-Butyl methacrylate/methyl methacrylate/benzyl methacrylate copolymer (35/35/30)
P- 44) Poly-3-pentyl acrylate
P- 45) Cyclohexyl methacrylate/methyl methacrylate/n-propyl methacrylate copolymer (37/29/34)
P- 46) Polypentyl methacrylate
P- 47) Methyl methacrylate/n-butyl methacrylate copolymer (65/35)
P- 48) Vinyl acetate/vinylpropionate copolymer (75/25)
P- 49) n-Butyl methacrylate/3-acryloxybutane-1-sodium sulfonate copolymer (97/3)
P- 50) n-Butyl methacrylate/methyl methacrylate/acrylamide copolymer (35/35/30)
P- 51) n-Butyl methacrylate/methyl methacrylate/vinyl chloride copolymer (37/36/27)
P- 52) n-Butyl methacrylate/styrene copolymer (90/10)
P- 53) Methyl methacrylate/N-vinyl-2-pyrrolidone copolymer (90/10)
P- 54) n-Butyl methacrylate/vinyl chloride copolymer (90/10)
P- 55) n-Butyl methacrylate/styrene copolymer (70/30)
P- 56) Poly(N-sec-butylacrylamide)
P- 57) Poly(N-tert-butylacrylamide)
P- 58) Diacetoneacrylamide/methyl methacrylate copolymer (62/38)
P- 59) Cyclohexyl methacrylate/methyl methacrylate copolymer (60/40)
P- 60) N-tert-Butylacrylamide/methyl methacrylate copolymer (40/60)
P- 61) Poly(N-n-butylacrylamide)
P- 62) tert-Butyl methacrylate/N-tert-butylacrylamide copolymer (50/50)
P- 63) tert-Butyl methacrylate/methyl methacrylate copolymer (70/30)
P- 64) Poly(N-tert-butylmethacrylamide)
P- 65) N-tert-Butylacrylamide/methyl methacrylate copolymer (60/40)
P- 66) Methyl methacrylate/acrylonitrile copolymer (70/30)
P- 67) Methyl methacrylate/vinyl methyl ketone copolymer (38/62)
P- 68) Methyl methacrylate/styrene copolymer (75/25)
P- 69) Methyl methacrylate/hexyl methacrylate copolymer (70/30)
P- 70) Poly(benzyl acrylate)
P- 71) Poly(4-biphenyl acrylate)
P- 72) Poly(4-butoxycarbonylphenyl acrylate)
P- 73) Poly(sec-butyl acrylate)
P- 74) Poly(tert-butyl acrylate)
P- 75) Poly[3-chloro-2,2-bis(chloromethyl)propyl acrylate]
P- 76) Poly(2-chlorophenyl acrylate)
P- 77) Poly(4-chlorophenyl acrylate)
P- 78) Poly(pentachlorophenyl acrylate)
P- 79) Poly(4-cyanobenzyl acrylate)
P- 80) Poly(cyanoethyl acrylate)
P- 81) Poly(4-cyanophenyl acrylate)
P- 82) Poly(4-cyano-3-thiabutyl acrylate)
P- 83) Poly(cyclohexyl acrylate)
P- 84) Poly(2-ethoxycarbonylphenyl acrylate)

P- 85) Poly(3-ethoxycarbonylphenyl acrylate)
P- 86) Poly(4-ethoxycarbonylphenyl acrylate)
P- 87) Poly(2-ethoxyethyl acrylate)
P- 88) Poly(3-ethoxypropyl acrylate)
P- 89) Poly(1H,1H,5H-octafluoropentyl acrylate)
P- 90) Poly(heptyl acrylate)
P- 91) Poly(hexadecyl acrylate)
P- 92) Poly(hexyl acrylate)
P- 93) Poly(isobutyl acrylate)
P- 94) Poly(isopropyl acrylate)
P- 95) Poly(3-methoxybutyl acrylate)
P- 96) Poly(2-methoxycarbonylphenyl acrylate)
P- 97) Poly(3-methoxycarbonylphenyl acrylate)
P- 98) Poly(4-methoxycarbonylphenyl acrylate)
P- 99) Poly(2-methoxyethyl acrylate)
P-100) Poly(4-methoxyphenyl acrylate)
P-101) Poly(3-methoxypropyl acrylate)
P-102) Poly(3,5-dimethyladamantyl acrylate)
P-103) Poly(3-dimethylaminophenyl acrylate)
P-104) Polyvinyl tert-butyl ether
P-105) Poly(2-methylbutyl acrylate)
P-106) Poly(3-methylbutyl acrylate)
P-107) Poly(1,3-dimethylbutyl acrylate)
P-108) Poly(2-methylpentyl acrylate)
P-109) Poly(2-naphthyl acrylate)
P-110) Poly(phenyl methacrylate)
P-111) Poly(propyl acrylate)
P-112) Poly(m-tolyl acrylate)
P-113) Poly(o-tolyl acrylate)
P-114) Poly(p-tolyl acrylate)
P-115) Poly(N,N-dibutylacrylamide)
P-116) Poly(isohexylacrylamide)
P-117) Poly(isooctylacrylamide)
P-118) Poly(N-methyl-N-phenylacrylamide)
P-119) Poly(adamantyl methacrylate)
P-120) Poly(benzyl methacrylate)
P-121) Poly(2-bromoethyl methacrylate)
P-122) Poly(2-N-tert-butylaminoethyl methacrylate)
P-123) Poly(sec-butyl methacrylate)
P-124) Poly(tert-butyl methacrylate)
P-125) Poly(2-chloroethyl methacrylate)
P-126) Poly(2-cyanoethyl methacrylate)
P-127) Poly(2-cyanomethylphenyl methacrylate)
P-128) Poly(4-cyanophenyl methacrylate)
P-129) Poly(cyclohexyl methacrylate)
P-130) Poly(dodecyl methacrylate)
P-131) Poly(diethylaminoethyl methacrylate)
P-132) Poly(2-ethylsulfinylethyl methacrylate)
P-133) Poly(hexadecyl methacrylate)
P-134) Poly(hexyl methacrylate)
P-135) Poly(2-hydroxypropyl methacrylate)
P-136) Poly(4-methoxycarbonylphenyl methacrylate)
P-137) Poly(3,5 dimethyladamantyl methacrylate)
P-138) Poly(dimethylaminoethyl methacrylate)
P-139) Poly(3,3-dimethylbutyl methacrylate)
P-140) Poly(3,3-dimethyl-2-butyl methacrylate)
P-141) Poly(3,5,5-trimethylhexyl methacrylate)
P-142) Poly(octadecyl methacrylate)
P-143) Poly(tetradecyl methacrylate)
P-144) Poly(4-butoxycarbonylphenylmethacrylamide)
P-145) Poly(4-carboxyphenylmethacrylamide)
P-146) Poly(4-ethoxycarbonylphenylmethacrylamide)
P-147) Poly(4-methoxycarbonylphenylmethacrylamide)
P-148) Poly(butylbutoxycarbonyl methacrylate)
P-149) Poly(butyl chloroacrylate)
P-150) Poly(butyl cyanoacrylate)
P-151) Poly(cyclohexyl chloroacrylate)
P-152) Poly(ethyl chloroacrylate)
P-153) Poly(ethylethoxycarbonyl methacrylate)
P-154) Poly(ethyl ethacrylate)
P-155) Poly(ethyl fluoromethacrylate)
P-156) Poly(hexylhexyloxycarbonyl methacrylate)
P-157) Poly(isobutyl chloroacrylate)
P-158) Poly(isopropyl chloroacrylate)
P-159) Trimethylenediamine glutaric acid polyamide
P-160) Hexamethylenediamine adipic acid polyamide
P-161) Poly(α-pyrrolidone)
P-162) Poly(ε-caprolactam)
P-163) Hexamethylenediisocyanate-1,4-butanediol polyurethane
P-164) p-Phenylenediisocyanate-ethylene glycol polyurethane Representative examples of the synthesis of polymers suitable for the present invention are given below. Unless otherwise indicated herein, all parts, percents, ratios and the like are by weight.

SYNTHESIS EXAMPLE 1

Synthesis of Polymethyl Methacrylate (P-3)

In a 500 ml three-neck flask, 50.0 g of methyl methacrylate, 0.5 g of sodium polyacrylic acid and 200 ml of distilled water were placed, and heated to 80° C. with stirring in a stream of nitrogen gas. Thereto was added 500 mg of dimethyl azobisisobutyrate as a polymerization initiator to initiate the polymerization reaction.

After the reaction was run for 2 hours, the polymerized solution was cooled. Then, the thus generated polymer beads were filtered off, and washed with water to yield 48.7 g of the intended polymer (P-3).

SYNTHESIS EXAMPLE 2

Synthesis of Poly(N-tert-butylacrylamide (P-57)

In a 500 ml three-neck flask, a mixture of 50.0 g of t-butylacrylamide with 250 ml of toluene were placed, and heated to 80° C. with stirring in a stream of nitrogen gas. Thereto was added 10 ml of a toluene solution containing 500 mg of azobisisobutyronitrile as a polymerization initiator to initiate the polymerization reaction.

After the reaction was run for 3 hours, the polymerized solution was cooled, and poured into 1 liter of hexane. Then, the thus generated solid matter was filtered off, washed with hexane, and dried by heating under reduced pressure. Thus, 47.9 g of the intended polymer (P-57) was obtained.

In order to achieve the object of the present invention, a polymer as described above may be incorporated into every light-sensitive silver halide emulsion layer.

For polymers soluble in an organic solvent, they can be added in the form of the solvent solution. For polymers insoluble in any organic solvent, on the other hand, they can be added in the form of a latex dispersion. Even polymers which are soluble in organic solvents may be added in the form of a latex dispersion, too.

A dispersion of oleophilic fine particles containing the polymer is preferably prepared in a manner as described below.

In one approach, a polymer which has been synthesized using a solution polymerization method, an emulsion polymerization method, a suspension polymerization method or the like, but has not yet been cross-linked, that is, a so-called linear polymer, a high boiling coupler solvent and a coupler are dissolved thoroughly into an auxiliary organic solvent. Then, the resulting solution is dispersed into water, preferably an aqueous solution of a hydrophilic colloid, more preferably an aqueous solution of gelatin, in the form of fine particles with the aid of a dispersing agent and a dispersing means such as ultrasonic waves, a colloid mill or the like, and then incorporated into a silver halide emulsion. In another approach, water or an aqueous solution of a hydrophilic colloid, such as of gelatin, is added to an auxiliary organic solvent containing a dispersing aid such as a surfactant or the like, the polymer used in the present invention, a high boiling coupler solvent and a coupler. The resulting mixture is converted into an oil-in-water type dispersion by phase inversion. After the auxiliary solvent is removed from the thus prepared dispersion through, e.g., distillation, noodle washing or ultrafiltration, the resulting dispersion may be mixed with a photographic emulsion. The term "auxiliary solvent" as used herein signifies a solvent of the kind which is useful at the time of emulsifying dispersion, but which is substantially removed from the light-sensitive material in the drying step of the coating procedure, or using one of the above described methods in the final step of the production of the light-sensitive material. The auxiliary solvent has a low boiling point and is soluble in water to such an extent that the solvent can be removed by washing with water or the like. Specific examples of suitable auxiliary solvents include acetates of lower alcohols, such as ethyl acetate, butyl acetate, etc., ethyl propionate, sec-butyl alcohol, methyl ethyl ketone, methyl isobutyl ketone, β-ethoxyethyl acetate, methyl cellosolve acetate, cyclohexanone, and so on.

In addition, organic solvents which are completely miscible with water, such as methyl alcohol, ethyl alcohol, acetone, tetrahydrofuran, etc., can be used as part of such an auxiliary solvent as described above, if needed.

Also, these organic solvents can be used as a mixture of two or more thereof.

The thus obtained oleophilic fine particles have an average size of preferably from 0.04 to 2 μm, and more preferably from 0.06 to 0.4 μm. The particle size of the oleophilic fine particles can be measured using an apparatus, such as a Nanosizer, produced by Coulter Co., Ltd. (England).

The support used in the present invention comprises a support base covered with a water resisting resin layer in which fine grains of titanium oxide are dispersed in an amount of 14 wt % or more, preferably from 15 wt % to 60 wt % (based on the sum weight of the water resisting resin and the titanium oxide). For dispersion of the titanium oxide grains, it is desirable that the fine grains of titanium oxide pigment should be previously surface treated using a di-, tri- or tetra-hydric alcohol, e.g., 2,4-dihydroxy-2-methylpentane or trimethylol ethane, as disclosed in JP-A-58-17151 and so on, together with an inorganic oxide such as silica, aluminum oxide or the like, or using them separately. The water resisting resin layer containing fine grains of titanium oxide is used in a thickness of from 2 to 200 μm, preferably from 5 to 80 μm. A plurality of water resisting resin layers, including those differing in amount of titanium oxide grains, those containing other white pigments, or/and those not containing any white pigment may be used in combination. In this case, the water resisting resin layer containing the fine grains of titanium oxide in accordance with an embodiment of the present invention is preferably positioned farther from the support base.

It is desirable in the present invention for the coefficient of variation in proportion (%) of the areas occupied by the fine grains of the titanium dioxide pigment should be below 0.20, preferably below 0.15, more particularly below 0.10.

The dispersibility of the fine grains of titanium oxide in the resin layer can be evaluated as follows: The resin molecules present in the layer surface part about 0.1 μm, preferably about 500 Å, in thickness are scattered by an ion sputtering method utilizing a glow discharge, and the thus bared fine grains of pigment are observed under an electron microscope, and examined for areas occupied by projected grains to determine the coefficient of variation in terms of the proportions of the occupied areas. The ion sputtering method is described in detail, e.g., in a paper entitled "The Arts of Surface Treatment Utilizing Plasma" by Yoh-ichi Murayama & Kunihiro Kashiwagi, published in *Kikai no Kenkyu (Research in Machinery)*, Vol. 33, No. 6 (1981).

In order to control the variation coefficient of the white pigment grains to below 0.20, it is desirable that the white pigment should be thoroughly kneaded in the presence of a surfactant, and it is more advantageous that the individual surfaces of the pigment grains are treated with a di-, tri- or tetra-hydric alcohol as described above prior to the kneading.

As for the proportions (%) of areas occupied by the fine grains of white pigment per specified unit area, the most typical determination method comprises subdividing the observed area into adjacent unit areas measuring 6 μm by 6 μm, and measuring the proportion of the area occupied by the projected fine grains in each unit area (represented by Ri %). The variation coefficient of the proportions of the occupied areas can be determined as a ratio of eh standard deviation of Ri (represented by s) to the mean of Ri's (represented by $\overline{R}$), the is, $S/\overline{R}$. The number of unit areas to be examined is preferably at least 6.

That is to say, the variation coefficient, $s/\overline{R}$, can be determined according to the following relationship:

$$\sqrt{\frac{\sum_{i=1}^{n}(Ri-\overline{R})^2}{n-1}} \Big/ \frac{\sum_{i=1}^{n} Ri}{n}$$

White pigments, other than titanium, can be present in the water resisting resin. Specific examples of preferred whit pigments include barium sulfate, calcium sulfate, silicon oxide, zinc oxide, titanium phosphate, aluminum oxide, and so on.

A white support used for the silver halide photographic material to be produced in accordance with the present invention is prepared by covering a support base material with a water resisting resin layer. Suitable examples of the support base material which can be employed include base papers made from natural pulp, synthetic pulp or a mixture thereof; polyester films such as a polyethylene terephthalate film, a polybutylene terephthalate film, etc.; and other synthetic resin films such as a cellulose triacetate film, a polystyrene film, a polypropylene film, a polyolefin film, etc.

The base paper to be used in the present invention can be selected from materials which have generally been used for photographic papers. More specifically, the base paper is formed mainly of natural pulp made from needle-leaved trees, broad-leaved trees or so on, and optionally with additives including a filler such as clay, talc, calcium carbonate, fine particles of urea resin, etc., a sizing agent such as rosin, an alkylketene dimer, a higher fatty acid, paraffin wax, alkenyl succinate, etc., a paper strength reinforcing agent such as polyacrylamide, etc., a sizing agent such as sulfate band, a cationic polymer, etc. In particular, neutralized paper using a reactive sizing agent such as an alkylketene dimer, an alkenyl succinate, etc., and adjusted to pH 5 to 7 (measured with a pH meter using planar GST-5313F as electrodes, made by Toa Electronics) is favored over others. Instead of using natural pulp, synthetic pulp or a pulp which is obtained by mixing natural pulp and synthetic pulp in an arbitrary ratio may be employed.

In addition, the surface of this pulp paper can be subjected to a surface size treatment using a film forming polymer such as gelatin, starch, carboxymethyl cellulose, polyacrylamide, modified polyvinyl alcohol or so on. Examples of modified polyvinyl alcohols usable therein are those modified by a carboxyl group, those modified by a silanol, copolymers with acrylamide, and so on.

The coverage of the film forming polymer used in the surface size treatment is adjusted to 0.1 to 5.0 g/m$^2$, preferably to 0.5 to 2.0 g/m$^2$. An antistatic agent, a brightening agent, a pigment, a defoaming agent and so on can further be added, if needed, to this film forming polymer.

The base paper is made from a pulp slurry comprising pulp as described above, and optional additives such as a filler, a sizing agent, a paper strength reinforcing agent, a fixing agent, etc., using a paper machine, e.g., a Fourdrinier machine, followed by drying and winding. The above described surface size treatment is carried out either before or after the drying, and a calendering treatment is carried out during the period from the conclusion of the drying until the start of the winding. When the surface size treatment is carried out after the drying, the calendering treatment may be performed either before or after the surface size treatment.

Whether a base paper to be used as the support base of the present invention is neutralized or not can be determined by a pH measurement using planar GST-5313F, made by Toa Electronics, as electrodes. The term neutralized paper as used herein is intended to include those papers having a pH value of 5 or above, preferably from 5 to 9.

On the other hand, the water resisting resin layer may form the support by itself, as in the case of vinyl chloride resin.

The term "water resisting resin" as used herein is intended to include those resins having a water absorbing capacity of 0.5 or less, preferably 0.1 or less, expressed in terms of wt %. Examples of such resins include polyalkylenes (such as polyethylene, polypropylene and copolymers thereof), vinyl homo- or copolymers (such as polystyrene, polyacrylate, and copolymers thereof), polyesters and copolymers thereof. Of these resins, polyalkylene resins including low density polyethylene, high density polyethylene, polypropylene, and blend of these resins are preferably used. A brightening agent, an oxidation inhibitor, an antistatic agent, a surface lubricant and so on can be added, if desired.

In addition, as disclosed in JP-A-57-27257, JP-A-57-49946 and JP-A-61-262738, unsaturated organic compounds having one or more of a polymerizable carbon-carbon double bond in the molecule, such as methacrylate compounds, di-, tri- and tetraacrylates, and the like, can be used. After coating on a support base, such a compound is cured by irradiation with electron beams to form a water resisting resin layer. In this case, titanium oxide, other white pigments, and other additives are dispersed into the foregoing unsaturated organic compound. Also, they can be dispersed thereinto in the form of mixture with another resin.

In providing the water resisting resin layer on a support base, lamination processes as described, e.g., in *Shin Laminate Kakoh Binran (Handbook of New Lamination Processes)*, compiled by Kakoh Gijutsu Kenkyukai, such as dry lamination, solventless type dry lamination, and so on, and coating processes such as those of the gravure roll type, wire bar type, doctor blade type, reverse roll type, dipping type, air knife type, calender type, kiss type, squeeze type, fountain type, coating type, and so on can be employed.

The surface of the support is preferably subjected to a corona discharge treatment, glow discharge treatment, a flame treatment or the like, and then provided with a group of protective colloid layers to produce the silver halide photographic material.

It is desired that the support as a whole should have a thickness of about 20 to about 400 μm corresponding to a coverage of 30 to 350 g/m$^2$, preferably about 50 to 200 g/m$^2$.

The color photographic light-sensitive material of the present invention can comprise a support having thereon at least one blue-sensitive silver halide emulsion layer, at least one green-sensitive silver halide emulsion layer, and at least one red-sensitive silver halide emulsion layer. In a typical color photographic paper, the silver halide emulsion layers are usually coated on a support in the above described order. However, coating orders different from the foregoing may be employed, if desired. Also, infrared-sensitive silver halide emulsion layers may be provided in the place of at least one of the foregoing emulsion layers. Color reproduction according to the subtractive color process can be effected by incorporating color couplers in the silver halide emulsion layers. The color couplers are capable of forming dyes, which each bears a complementary color relationship to light to which the corresponding emulsion is sensitized, i.e., the relationship of a yellow dye to blue light, that of a magenta dye to green light, or that of a cyan dye to red light. However, a different correspondence of sensitizing light to hue of developed color may be employed.

The silver halide which can be preferably used in the silver halide emulsions of the present invention includes substantially iodide-free silver chlorobromide and silver chloride. The expression "substantially iodide-free" as used herein means that the iodide content therein is below 1 mol %, preferably below 0.2 mol %. The halide composition of the silver halide emulsion grains may be the same or different. However, uniform properties are achieved by the use of an emulsion where the same halide composition is present in the emulsion grains. The halide distribution inside the silver halide emulsion grains includes grains of the type which have a uniform halide composition throughout, that is to say, have a uniform structure; grains of the type which differ in the halide composition in the inner part (core) and the halide composition of the part surrounding the core (i.e., a shell constructed by one or more layers), that is to say, have a layer structure; or grains of the type which contain parts which differ in halide composition inside or at the surface thereof without having a layer form (e.g., have a structure that the different parts are present at edges, corners or faces in a fused condition when they are present at the grain surface) can be chosen appropriately depending on the purpose of use. For the purpose of achieving high sensitivity, it is more advantageous to use the grains of either of the latter two types than to use the grains having a uniform structure. Further, the grains of latter two types are preferred due to their pressure resisting properties. When the grains have a nonuniform structure as described above, a boundary between the parts which differ in halide composition may have a clear interface, or the interface may be obscured by forming mixed crystals depending on the difference in halide composition. Also, a continuous change in structure may be positively made in the boundary region.

The ratio of silver bromide to silver chloride in the silver chlorobromide emulsion grains having such a structure as described above can be chosen arbitrarily. Though this ratio can vary widely depending on the purpose, it is desirable that silver chloride be present in an amount of at least 2 mol %.

A silver halide emulsion having a high chloride content, or a so-called high chloride content emulsion, can be used to advantage in producing a light-sensitive material suitable for rapid processing. A preferred chloride content in such a high chloride content emulsion is 90 mol % or more, particularly 95 mol % or more.

It is desirable for the foregoing high chloride content emulsion to have, as described above, a structure such that silver bromide-localized phases are present inside or/and at the surface of the grains with or without a layer form existing. In the localized phases, it is to be desired for the bromide content therein to be at least 10 mol %, preferably more than 20 mol %. These localized phases can be present inside the grains, or at the edges, corners or faces of the grain surface. Localized phase formed by epitaxial growth at the corners of each grain is an advantage.

On the other hand, for the purpose of inhibiting with the greatest possible effect the decrease in sensitivity from occurring when pressure is imposed on the sensitive material, it is also advantageous to use grains whose halide composition is substantially uniform throughout, that is to say, have a uniform structure, even for a high chloride content emulsion having a chloride content of 90 mol % or more.

Also, a further increase in the chloride content in a silver halide emulsion results in reducing the amount of development processing solution to be replenished. In this case, an almost pure silver chloride emulsion having a chloride content of from 98 to 100 mol % is used to advantage, too.

The average size of the silver halide grains present in the silver halide emulsions to be used in the present invention (the grain size herein refers to the diameter of the circle having the same area as the projected area of the grains, and the number average is taken in expressing the grain size) ranges preferably from 0.1 to 2 μm.

With respect to the distribution of sizes among the grains, a so-called monodisperse emulsion which has a variation coefficient (the value obtained by dividing the standard deviation of grain size distribution by the average grain size) of 20% or less, desirably 15% or less, is preferred. For the purpose of obtaining a wide tolerance, a blend of monodisperse emulsions differing in average grain size in a single layer, or separately in a multiple layer can be advantageously employed.

The silver halide grains in the photographic emulsions may have a regular crystal form, such as that of a cube, a tetradecahedron or an octahedron; an irregular crystal form, such as that of a sphere, a plate or so on; or a composite form thereof. A mixture of various crystal forms of silver halide grains may be also present. It is desirable in the present invention that the proportion of the silver halide grains having such a regular crystal form as described above to the total of the silver halide grains present in the photographic emulsion should be at least 50%, preferably more than 70%, and more preferably more than 90%.

In addition, it is desirable in the present invention to use an emulsion where the proportion of tabular silver halide grains having an average aspect ratio (ratio of a projected area diameter to thickness) of 5 or more, preferably 8 or more, to the total silver halide grains present in the emulsion is more than 50%, based on the projected area.

The silver chlorobromide emulsion which can be used in the present invention can be prepared using various methods as described in, for example, P. Glafkides, *Chemie et Physique Photographique*, Paul Montel, Paris (1967), G. F. Duffin, *Photographic Emulsion Chemistry*, The Focal Press, London (1966), V. L. Zelikman et al., *Making and Coating Photographic Emulsion*, The Focal Press, London (1964); and so on. Specifically, processes including an acid process, a neutral process and an ammoniacal process may be employed.

Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. On the other hand, the so-called controlled double jet method, in which the pAg of the liquid phase in which the silver halide grains are to be precipitated is maintained constant, may be also employed. According to this method, a silver halide emulsion having a regular crystal form and a substantially uniform distribution of grain sizes can be obtained.

Various polyvalent metal ion impurities can be present during the process of producing silver halide grains or while the silver halide grains are allowed to ripen physically. Examples of compounds usable for the foregoing purpose include cadmium salts, zinc salts, lead salts, copper salts, thallium salts, and single or complex salts of Group VIII elements, such as iron, ruthenium, rhodium, palladium, osmium, iridium, platinum, etc. Of these salts, those of Group VIII elements can be used advantageously. The amounts of these compounds to be added can be varied over a wide range depending on the purpose, but are preferably within the range of $10^{-9}$ to $10^{-2}$ mol per mol of silver halide.

The silver halide emulsions to be used in the present invention are, in general, chemically and spectrally sensitized.

Chemical sensitization can be effected using a sulfur sensitization process comprising the addition of an unstable sulfur compound, a sensitization process utilizing a noble metal compound represented by a gold compound, and a reduction sensitization process, individually or as a combination thereof. Compounds which are preferably used in the present invention for chemical sensitization include those disclosed in JP-A-62-215272, from the right lower column on page 18 to the right upper column on page 22.

Spectral sensitization is carried out for the purpose of spectrally sensitizing the emulsion in a desired wavelength region in each light-sensitive layer in the photographic material of the present invention. This can be achieved by addition of dyes capable of absorbing light in the wavelength regions corresponding to the desired spectral sensitivities respectively, that is to say, spectral sensitizing dyes. Spectral sensitizing dyes which can be used for the above described purpose include those described in, e.g., F. M Harmer, *Heterocyclic Compound—Cyanine Dyes and Related Compounds*, John Wiley & Sons, New York and London (1964). Specific examples of compounds and spectral sensitization processes which can be employed to advantage in the present invention include those disclosed in JP-A-62 -215272, from the right upper column on the page 22 to the page 38.

The silver halide emulsions to be used in the present invention can contain a wide variety of compounds or precursors thereof for the purpose of preventing fog or stabilizing the photographic characteristics during production, storage, or photographic processing. Specific examples of these compounds which can be preferably used in the present invention include those disclosed in the above cited patent, JP-A-62-215272, from the page 39 to the page 72.

In the present invention, either a silver halide emulsion of the kind which forms latent image predominantly at the surface of the grains, or an emulsion of the kind which mainly forms latent image inside the grains may be employed.

When the present invention is applied to color photographic emulsions, a yellow coupler, a magenta coupler and a cyan coupler which form yellow, magenta and cyan colors respectively upon coupling with the oxidation product of an aromatic amine type color developing agent are generally incorporated in the photographic material.

Cyan, magenta and yellow couplers which can be advantageously used in the present invention are those represented by the following general formulae (C-I), (C-II), (M-I), (M-II) and (Y).

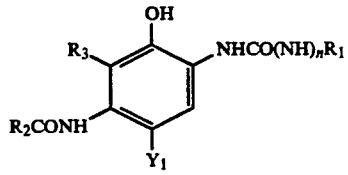

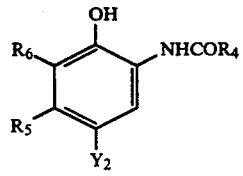

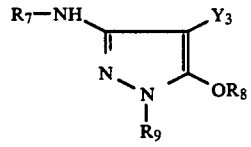

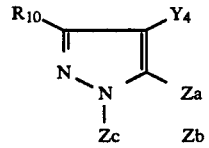

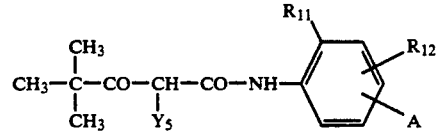

In the above formulae (C-I) and (C-II), $R_1$, $R_2$ and $R_4$ each represents a substituted or unsubstituted aliphatic, aromatic or heterocyclic group; $R_3$, $R_5$ and $R_6$ each represents a hydrogen atom, a halogen atom, an aliphatic group, an aromatic group, or an acylamino group; and further, $R_3$ represents the nonmetal atoms to complete a nitrogen-containing 5- or 6-membered ring by combining with $R_2$. $Y_1$ and $Y_2$ each represents a hydrogen atom, or a group capable of splitting off upon coupling with the oxidation product of a developing agent. n represents 0 or 1.

$R_5$ in the general formula (C-II) is preferably an aliphatic group, with specific examples including methyl, ethyl, propyl, butyl, pentadecyl, tert-butyl, cyclohexyl, cyclohexylmethyl, phenylthiomethyl, dodecyloxyphenylthiomethyl, butanamidomethyl, methoxymethyl, and so on.

Preferred cyan couplers of those represented by the foregoing general formulae (C-I) and (C-II) are described in more detail below.

$R_1$ in the general formula (C-I) is preferably an aryl or heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or/and a cyano group.

When $R_3$ and $R_2$ are not combined with each other for ring formation in the general formula (C-I), $R_2$ is preferably a substituted or unsubstituted alkyl or aryl group, and more preferably a substituted aryloxy-substituted alkyl group, and R3 is preferably a hydrogen atom.

$R_4$ in the general formula (C-II) is preferably a substituted or unsubstituted alkyl or aryl group, and particularly preferably a substituted aryloxy-substituted alkyl group.

$R_5$ in the general formula (C-II) is preferably an alkyl group containing from 2 to 15 carbon atoms, or a methyl group substituted by a group containing at least one carbon atom, with suitable examples including an arylthio group, an alkylthio group, an acylamino group, an aryloxy group and an alkyloxy group.

In the general formula (C-II), $R_5$ is more preferably an alkyl group containing 2 to 15 carbon atoms, especially 2 to 4 carbon atoms.

$R_6$ in the general formula (C-II) is preferably a hydrogen atom or a halogen atom, and particularly preferably a chlorine atom or a fluorine atom.

$Y_1$ and $Y_2$ in the general formulae (C-I) and (C-II) respectively are preferably a hydrogen atom, a halogen atom, an alkoxy group, an aryloxy group, an acyloxy group, or a sulfonamido group.

$R_7$ and $R_9$ in the general formula (M-I) are each an aryl group, and $R_8$ therein is a hydrogen atom, an aliphatic or aromatic acyl group, or an aliphatic or aromatic sulfonyl group. $Y_3$ represents a hydrogen atom or a splitting-off group. Substituent groups which can be present on the aryl groups represented by $R_7$ and $R_9$ (which preferably are a phenyl group) include the same substituents described for $R_1$. When the aryl group has two or more substituent groups, they may be the same or different. $R_8$ is preferably a hydrogen atom, or an aliphatic acyl or sulfonyl group, and particularly preferably a hydrogen atom. In particular, it is desirable for $Y_3$ to be a splitting-off group of the type which contains a sulfur, oxygen or nitrogen atom at the splitting-off site, especially one which contains a sulfur atom at the splitting-off site, as disclosed in U.S. Pat. No. 4,351,897 and WO 88/04795.

In the general formula (M-II), $R_{10}$ represents a hydrogen atom or a substituent group. $Y_4$ represents a hydrogen atom or a splitting-off group, and, particularly preferably, a halogen atom or an arylthio group. Za, Zb and Zc each represents an unsubstituted or substituted methine group, =N— or —NH—, provided that either the Za—Zb bond or the Zb—Zc bond is a double bond, and the L- other is a single bond. When the Zb-Zc bond is a C—C double bond, it may form a part of an aromatic ring. The compound represented by the general formula (M-II) may form a dimer or a higher polymer via $R_{10}$ or $Y_4$, or a substituted methine group when Za, Zb or Zc represents such a methine group.

Of the pyrazoloazole type couplers represented by the general formula (M-II), imidazo[1,2-b]pyrazoles disclosed in U.S. Pat. No. 4,500,630 are preferred from the standpoint of low yellow side absorption of the developed dyes and light fastness thereof, and pyrazolo[1,5-b]-[1,2,4]triazoles disclosed in U.S. Pat. No. 4,540,654 are especially advantageous.

In addition, preferably pyrazolotriazole type couplers in which the 2-, 3- or 6-position of the pyrazolotriazole ring is substituted by a branched alkyl group, as disclosed in JP-A-61-65245; pyrazoloazole type couplers which contain a sulfonamido group in the molecule, as disclosed in JP-A-61-65246; pyrazoloazole type couplers which contain an alkoxyphenylsulfonamido group as a ballast group, as disclosed in JP-A-61-147254; and pyrazolotriazole type couplers in which the 6-position is substituted by an alkoxy or aryloxy group, as disclosed in European Patents (Laid Open) 226,849 and 294,785 can be employed.

In the general formula (Y), $R_{11}$ represents a halogen atom, an alkoxy group, a trifluoromethyl group, or an aryl group; $R_{12}$ represents a hydrogen atom, a halogen atom, or an alkoxy group; A represents $—NHCOR_{13}$, $—NHSO_2—R_{13}$, $—SO_2NHR13$, $—COOR_{13}$, or $—SO_2NR_{13}R_{14}$ (wherein $R_{13}$ and $R_{14}$ each represents an alkyl group, an aryl group, or an acyl group); and $Y_5$ represents a splitting-off group. Substituent groups for the groups represented by $R_{12}$, $R_{13}$ and $R_{14}$ include the same substituents described for the groups represented by $R_1$. A splitting-off group represented by $Y_5$ is preferably one which contains an oxygen or a nitrogen atom, especially a nitrogen atom, at the splitting-off site.

Specific examples of couplers represented by the general formulae (C-I), (C-II), (M-I), (M-II) and (Y) respectively, which can be used in the present invention, are illustrated below.

Specific examples of couplers represented by the general formulae (C-I), (C-II), (M-I), (M-II) and (Y) respectively, which can be used in the present invention, are illustrated below.

(C-1)

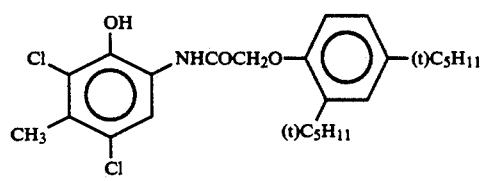

(C-2)

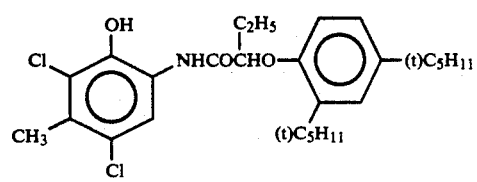

-continued
(C-3)
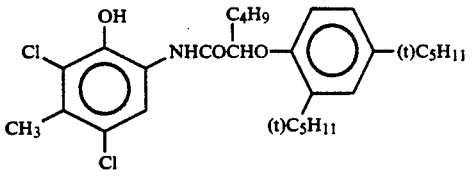
(C-4)
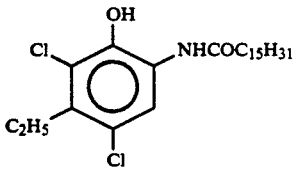
(C-5)
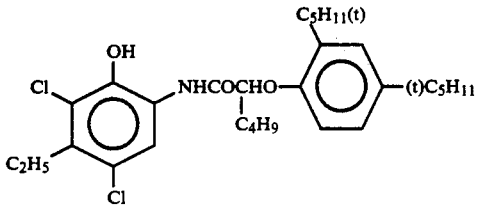
(C-6)
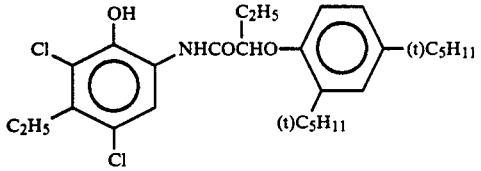
(C-7)
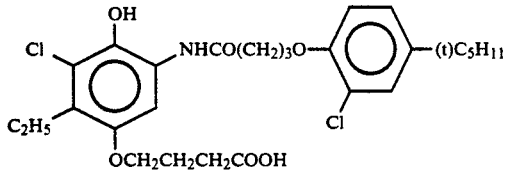
(C-8)
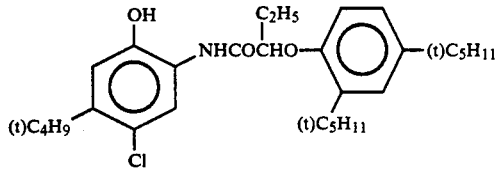
(C-9)
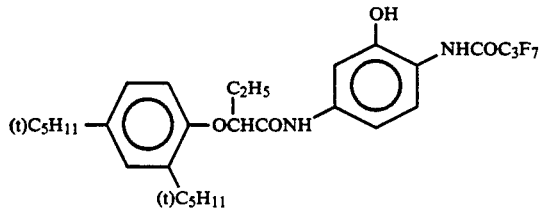
(C-10)
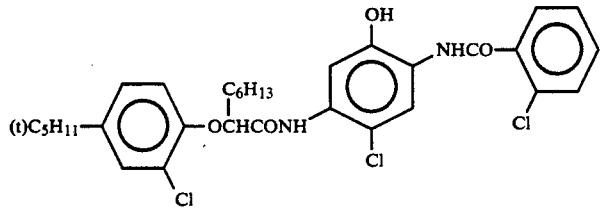

-continued
(C-11)
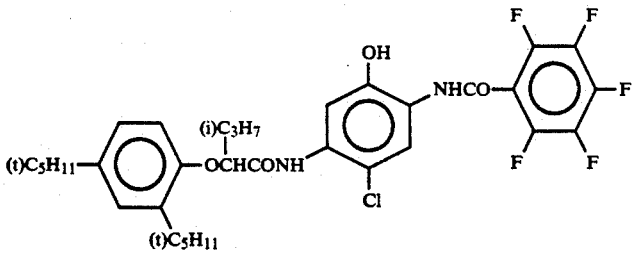
(C-12)
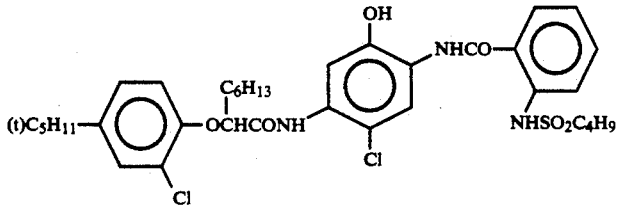
(C-13)
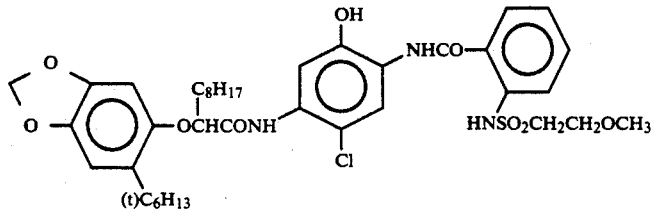
(C-14)
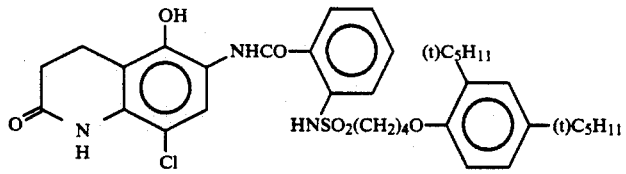
(C-15)
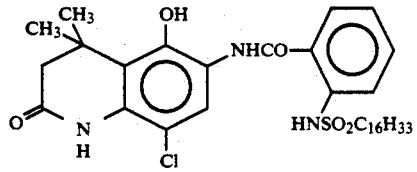
(C-16)
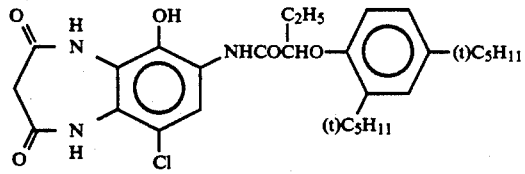
(C-17)
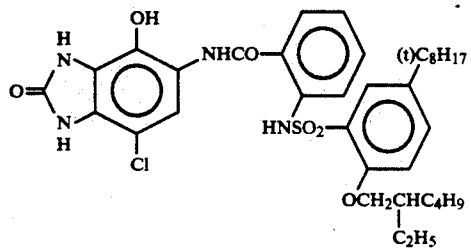

-continued
(C-18)
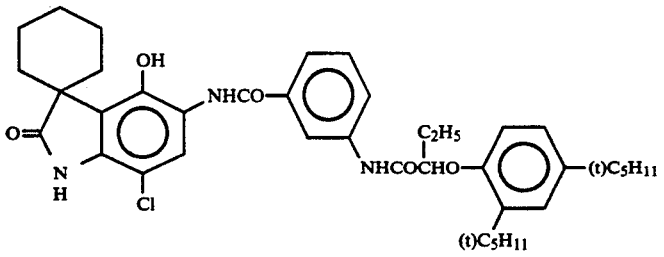
(C-19)
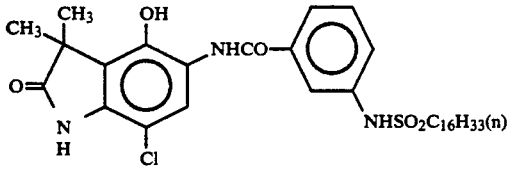
(C-20)
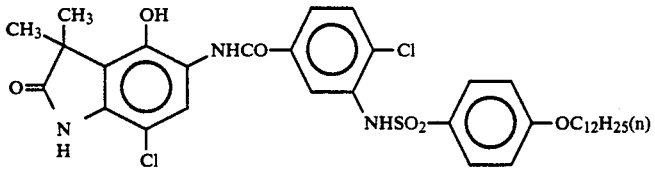
(C-21)
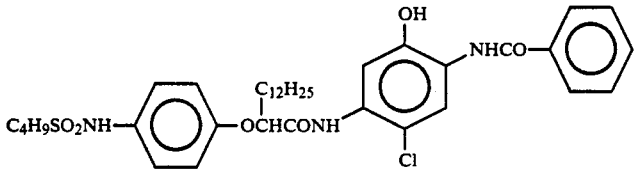
(C-22)
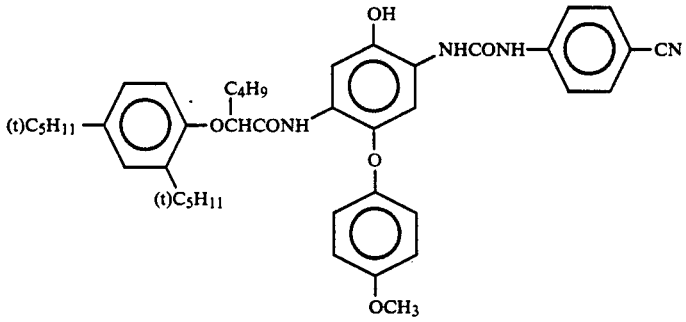
(M-1)
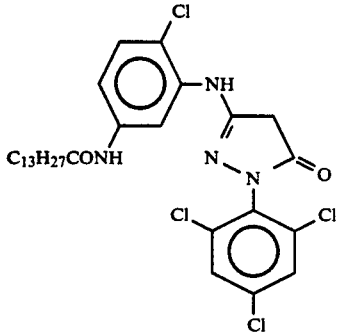

-continued
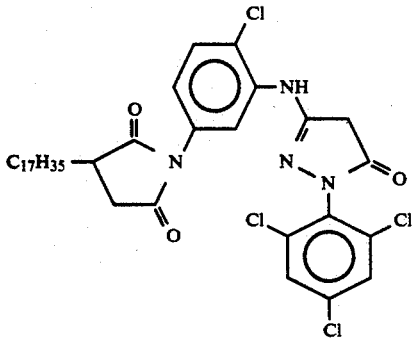
(M-2)
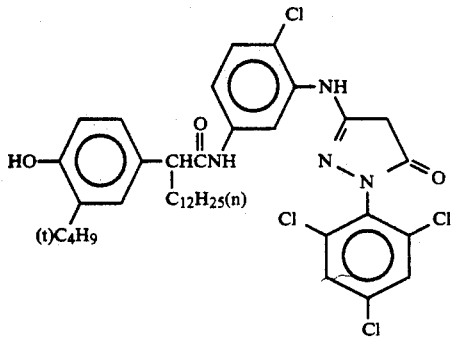
(M-3)
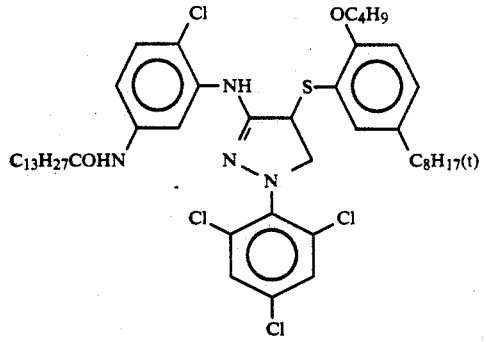
(M-4)
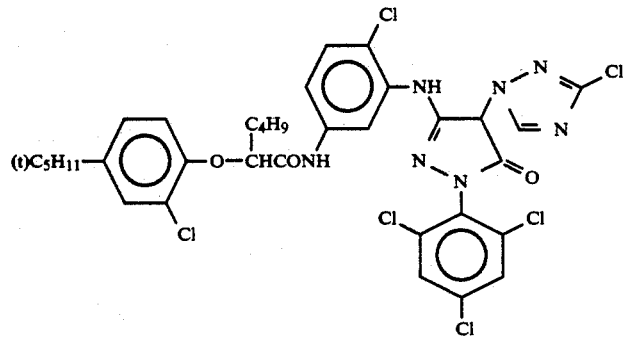
(M-5)

-continued
(M-6)
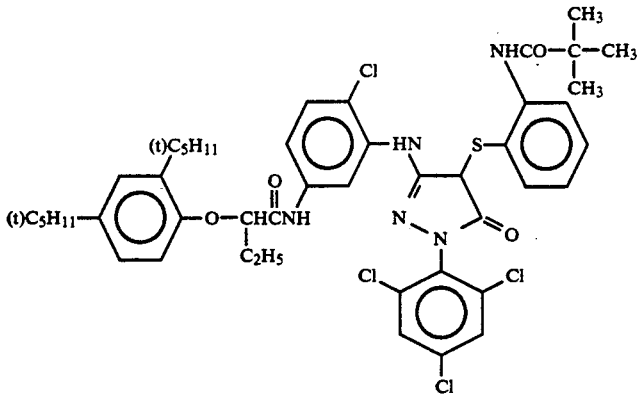
(M-7)
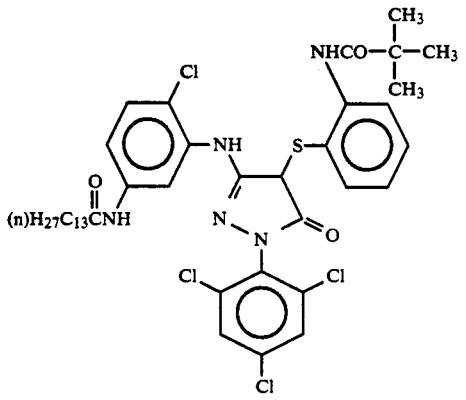
(M-8)
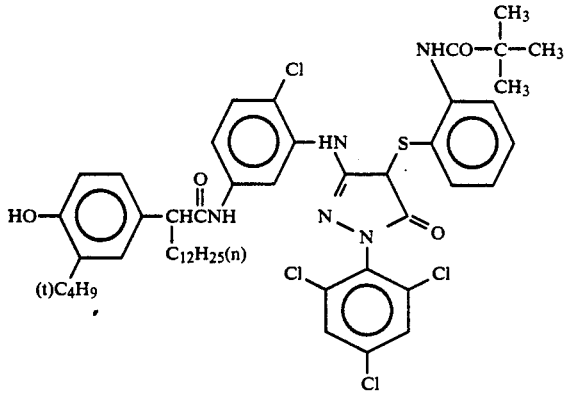

| Compound | $R_{10}$ | $R_{15}$ | $Y_4$ |
|---|---|---|---|
| | | 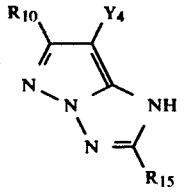 | |
| M-9 | $CH_3$— | 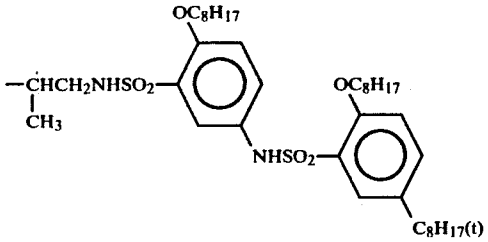 | Cl |
| M-10 | $CH_3$— | 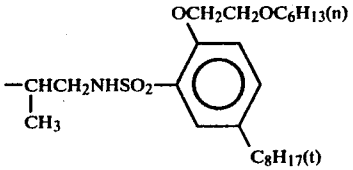 | Cl |
| M-11 | $(CH_3)_3C$— | 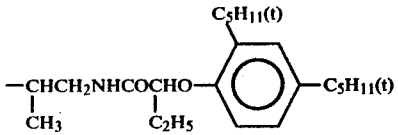 | 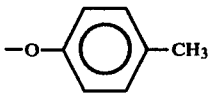 |
| M-12 | 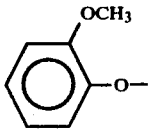 | 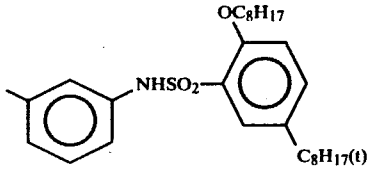 | 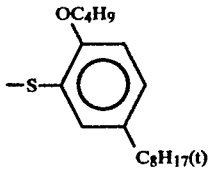 |

-continued
| Compound | $R_{10}$ | $R_{15}$ | $Y_4$ |
|---|---|---|---|
| M-13 | $CH_3$— | 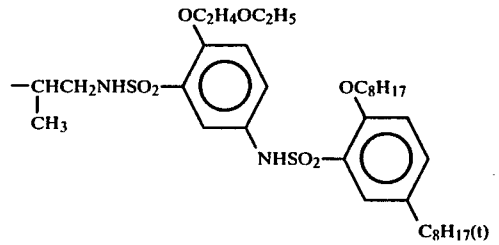 | Cl |
| M-14 | $CH_3$— | 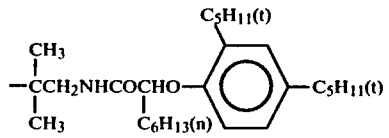 | Cl |
| M-15 | $CH_3$— | 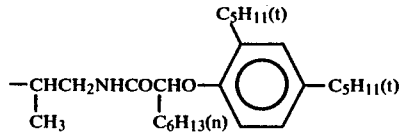 | Cl |
| M-20 | 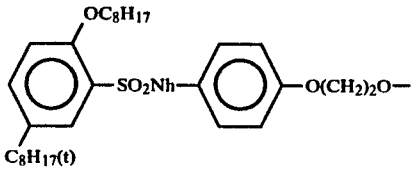 | 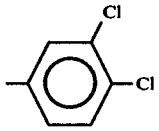 | 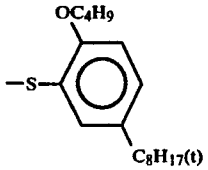 |
| M-21 | 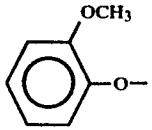 | 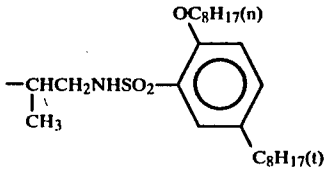 | Cl |

-continued
| Compound | $R_{10}$ | $R_{15}$ | $Y_4$ |
|---|---|---|---|
| | | 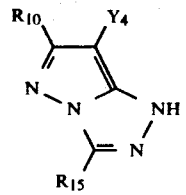 | |
| M-22 | $CH_3$— | 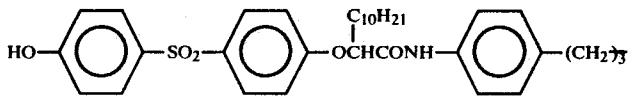 | Cl |
| M-23 | $CH_3$— | 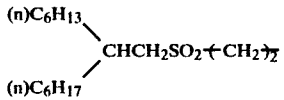 | Cl |
| M-24 | 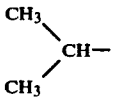 | 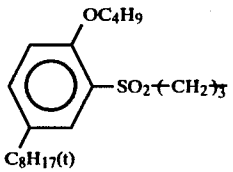 | Cl |
| M-25 | 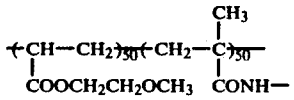 | 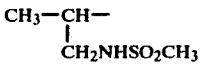 | Cl |
| M-26 | 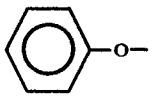 | 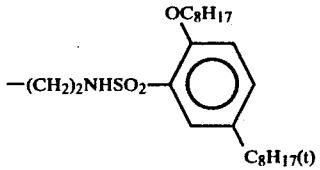 | Cl |

-continued
| Compound | $R_{10}$ | $R_{15}$ | $Y_4$ |
|---|---|---|---|
| M-27 | $CH_3$— | 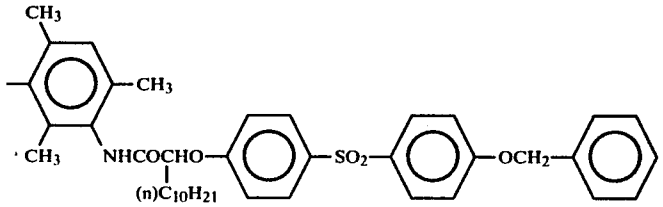 | Cl |
| M-28 | $(CH_3)_3C$— | 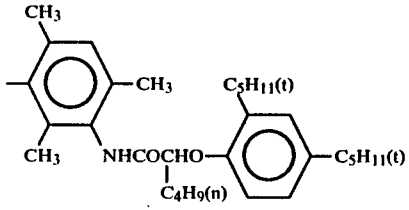 | Cl |
| M-29 | 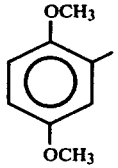 | 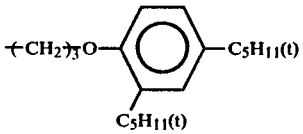 | Cl |
| M-30 | $CH_3$— | 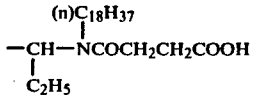 | Cl |
| M-16 | $CH_3$— | 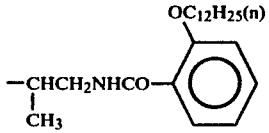 | Cl |
| M-17 | " | 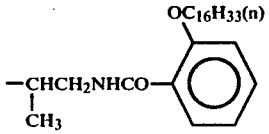 | Cl |

-continued
| Compound | $R_{10}$ | $R_{15}$ | $Y_4$ |
|---|---|---|---|
| M-18 | 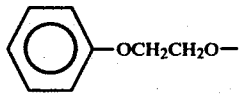 | 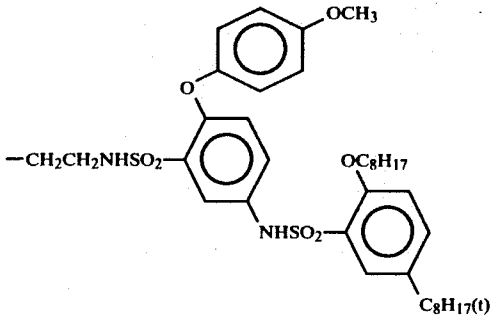 | 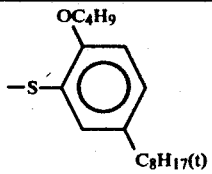 |
| M-19 | $CH_3CH_2O$— | 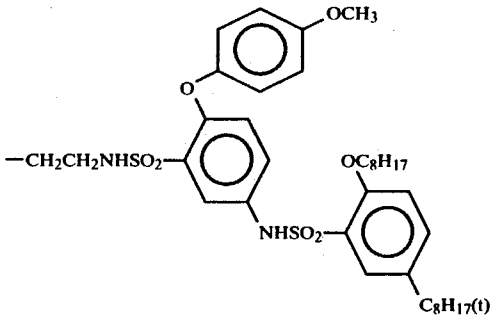 | 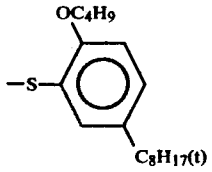 |

(Y-1)
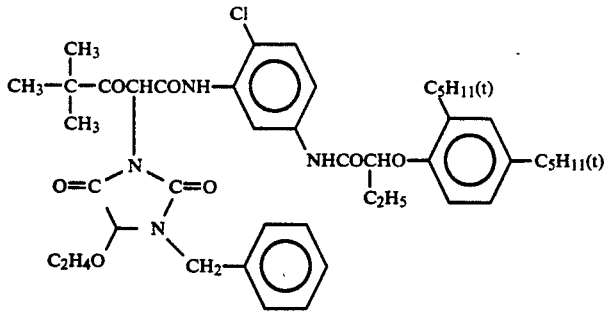
(Y-2)
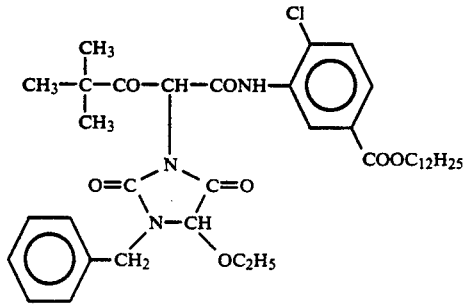
(Y-3)
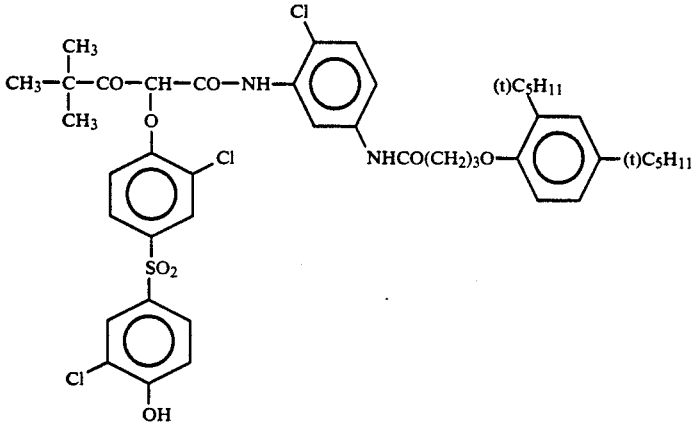
(Y-4)
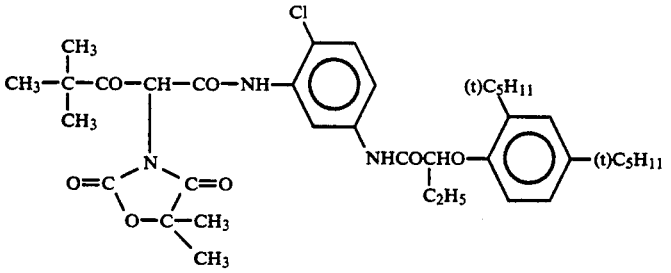
(Y-5)
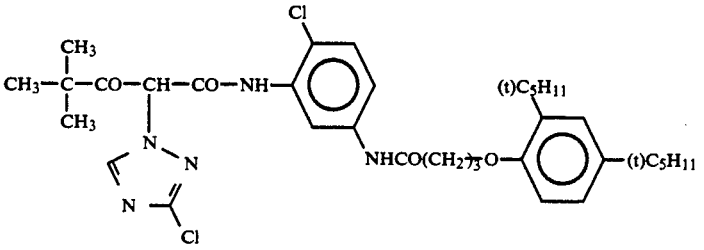

-continued (Y-6)

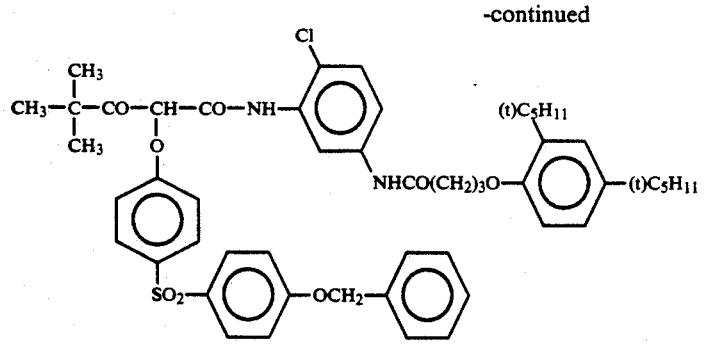

(Y-7)

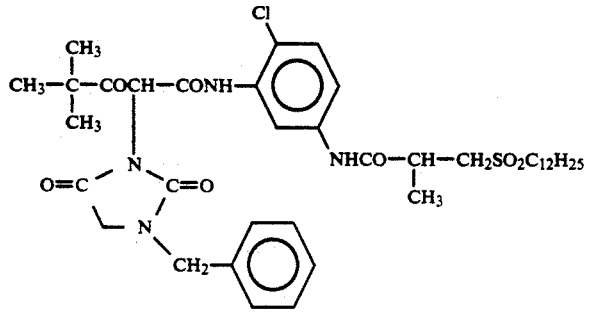

(Y-8)

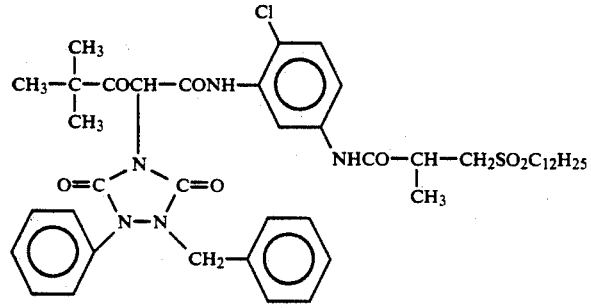

(Y-9)

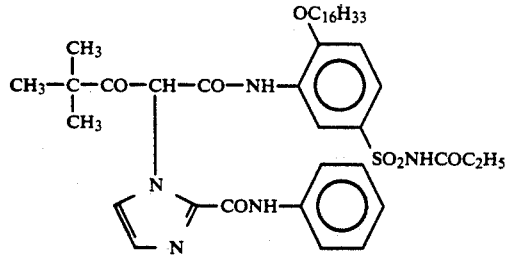

Each of the couplers represented by the foregoing general formulae (C-I), (C-II), (M-I), (M-II) and (Y) is incorporated into a silver halide emulsion layer of the light-sensitive material, in an amount of generally from 0.1 to 1.0 mol, preferably from 0.1 to 0.5 mol, per mol of silver halide present therein.

Various known techniques can be employed to incorporate the above described couplers into the light-sensitive layer. In general, the incorporation can be carried out using an oil-in-water dispersion method known as the oil-protected method. This method comprises dissolving a coupler in solvents, and dispersing the dissolved coupler into a surfactant-containing aqueous gelatin solution in the form of an emulsion; or adding water or an aqueous gelatin solution to a surfactant-containing coupler solution, and causing phase inversion therein to occur and form an oil-in-water dispersion. In case of alkali-soluble couplers, on the other hand, the so-called Fischer's dispersion method can be used. After a low boiling organic solvent is removed from a coupler dispersion by distillation, noodle washing, ultrafiltration or so on, the resulting dispersion may be mixed with a photographic emulsion.

The dispersion medium for couplers as described above can include high boiling organic solvents having a dielectric constant of 2 to 20 (at 25° C.) and a refractive index of 1.5 to 1.7 (at 25° C.) and/or water-insoluble high molecular compounds with advantage.

High boiling organic solvents which can be preferably used include those represented by the following general formulae (A), (B), (C), (D) and (E), respectively.

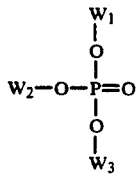

(A)

$W_1—COOW_2$ (B)

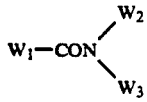

(C)

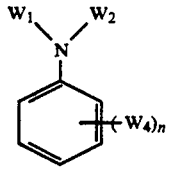

(D)

$W_1—O—W_2$ (E)

In the above formulae, $W_1$, $W_2$ and $W_3$ each represents a substituted or unsubstituted alkyl, cycloalkyl, alkenyl, aryl or heterocyclic group; $W_4$ represents $W_1$, $—OW_1$ or $—SW_1$; n represents an integer from 1 to 5, and when n is 2 or above, $W_4$'s may be the same or different; and further, $W_1$ and $W_2$ in formula (E) may combine and complete a condensed ring.

In addition to those represented by the general formulae from (A) to (E), compounds which have a melting point of 100° C. or below and a boiling point of 140° C. or above, and are immiscible with water and good solvents for couplers can be also employed as high boiling organic solvents to be used in the present invention. It is desirable that high boiling organic solvents used in the present invention should have a melting point of 80° C. or below, and a boiling point of 160° C. or above, particularly 170° C. or above.

Details of these high boiling organic solvents are described in JP-A-62-215272, from the right lower column on page 137 to the right upper column on page 144.

Another technique for incorporating these couplers into emulsion layers comprises impregnating a loadable latex polymer (as disclosed, e.g., in U.S. Pat. No. 4,203,716) with couplers in the presence or the absence of a high boiling organic solvent as described above, or dissolving couplers in a polymer insoluble in water but soluble in an organic solvent, and then dispersing the resulting polymer into a hydrophilic colloid solution in an emulsified condition.

Polymers which are preferably used in the above described techniques include homo- or copolymers disclosed in WO 88/00723, from page 12 to page 30. In particular, acrylamide type polymers are preferred over others as to stabilization of color images.

The light-sensitive material prepared in accordance with the present invention may contain hydroquinone derivatives, aminophenol derivatives, gallic acid derivatives, ascorbic acid derivatives and the like as color fog inhibitors.

Various kinds of discoloration inhibitors can be used in the light-sensitive material of the present invention. Typical examples of organic discoloration inhibitors suitable for cyan, magenta and/or yellow images include hindered phenols represented by hydroquinones, 6-hydroxychromans, 5-hydroxycoumarans, spirochromans, p-alkoxyphenols and bisphenols; gallic acid derivatives; methylenedioxybenzenes; aminophenols; hindered amines; and ether or ester derivatives obtained by silylating or alkylating the phenolic OH groups contained in the above described compounds, respectively. In addition, metal complexes represented by (bis-salicylaldoxamato)nickel complex and (bis-N,N-dialkyldithiocarbamato)nickel complexes can be also used for the above described purpose.

Specific examples of organic discoloration inhibitors are described in the following patent specifications.

That is, hydroquinones are described, e.g., in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxycoumarans and spirochromans are described, e.g., in U.S. Pat. Nos. 3,432,300, 3,573,050, 3,574,627, 3,698,909 and 3,764,337, and JP-A-52-152225; spiroindanes are described, e.g., in U.S. Pat. No. 4,360,589; p-alkoxyphenols are described, e.g., in U.S. Pat. No. 2,735,765, British Patent 2,066,975, JP-A-59-10539 and JP-B-57-19765; hindered phenols are described, e.g., in U.S. Pat. No. 3,700,455, JP-A-52-72224, U.S. Pat. No. 4,228,235 and JP-B-52-6623; gallic acid derivatives, methylenedioxybenzenes and aminophenols are described, e.g., in U.S. Pat. Nos. 3,457,079 and 4,332,886 and JP-B-56-21144, respectively; hindered amines are described, e.g., in U.S. Pat. Nos. 3,336,135 and 4,268,593, British Patents 1,326,889, 1,354,313 and 1,410,846, JP-B-52-1420, JP-A-58-114036, JP-A-59-53846 and JP-A-59-78344; and metal complexes are described, e.g., in U.S. Pat. Nos. 4,050,938 and 4,241,155, and British Patent 2,027,731(A). These compounds can be appropriately used in an amount of, in general, from 5 to 100 wt % to the couplers corresponding thereto, respectively, and emulsified together therewith, followed by incorporation into the light-sensitive layers. Introduction of an ultraviolet absorbent into a cyan color forming layer and both layers adjacent thereto is more effective to prevent cyan dye images from deteriorating due to heat, and light, in particular.

Examples of ultraviolet absorbents usable for the above described purpose include aryl-substituted benzotriazole compounds (as disclosed, e.g., in U.S. Pat. No. 3,533,794), 4-thiazolidone compounds (as disclosed, e.g., in U.S. Pat. Nos. 3,314,794 and 3,352,681), benzophenone compounds (as disclosed, e.g., in JP-A-46-2784), cinnamate compounds (as disclosed, e.g., in U.S. Pat. Nos. 3,705,805 and 3,707,395), butadiene compounds (as disclosed, e.g., in U.S. Pat. No. 4,045,229), and benzoxidol compounds (as disclosed, e.g., in U.S. Pat. Nos. 3,406,070, 3,677,672 and 4,271,307). Also, ultraviolet absorbing couplers (e.g., α-naphthol type cyan dye forming couplers) and ultraviolet absorbing polymers may be employed. These ultraviolet absorbents may be mordanted and thereby fixed in a particular layer.

Of these ultraviolet absorbents, the foregoing aryl-substituted benzotriazole compounds are preferred over other compounds.

In particular, it is preferred for the compounds described below to be used together with the foregoing couplers, especially with pyrazoloazole type couplers.

That is, compounds which produce chemically inert, substantially colorless compounds by combining chemically with an aromatic amine developing agent remaining after the color development processing (Compounds F) and/or compounds which produce chemically inert, substantially colorless compounds by combining chemically with an oxidized aromatic amine developing agent remaining after color development processing (Compounds G) are used individually or in combination to effectively prevent generation of stains upon storage after photographic processing, which is due to formation of dyes through the reaction between couplers and an unoxidized o oxidized color developing agent remaining in the photographic film after the photographic processing, and the occurrence of other side reactions.

Preferred examples of Compound F are compounds capable of reaction with p-anisidine wherein the kinetic constant of the second order reaction, $k_2$ (in 80° C. trioctyl phosphate) ranges from 1.0 liter/mol.sec to $1\times10^{-5}$ liter/mol sec. The measurement of a kinetic constant of the second order reaction can be performed according to the method described in JP-A-63-158545.

When $k_2$ is greater than the upper limit above described , the compound itself becomes unstable, so sometimes it is decomposed through the reaction with gelatin or water. On the other hand, when $k_2$ is smaller than the lower limit of the foregoing range, the reaction with the residual aromatic amine developing agent becomes slow, so it is often impossible to prevent undesirable side effects of the residual aromatic amine developing agent.

Especially preferred compounds of these Compounds (F) are represented by the following general formula (FI) or (FII):

$$R_1-(A)_n-X \qquad \text{(FI)}$$

$$R_2-\underset{\underset{B}{|}}{C}=Y \qquad \text{(FII)}$$

In the above formulae, $R_1$ and $R_2$ each represents an aliphatic, aromatic or heterocyclic group; n represents 1 or 0; A represents a group capable of forming a chemical bond by reaction with an aromatic amine developing agent; B represents a hydrogen atom, an aliphatic group, an aromatic group, a heterocyclic group, an acyl group or a sulfonyl group; X represents a group capable of splitting-off by the reaction with an aromatic amine developing agent; and Y represents a group capable of accelerating the addition of an aromatic amine developing agent to the compound of the general formula (FII). $R_1$ and X in the formula (FI), and Y and $R_2$ or B in the formula (FII) also may combine with each other to complete a cyclic structure.

Typical representative mechanisms in which the foregoing compounds combine chemically with residual aromatic amine developing agents are substitution and addition.

Specific examples of compounds represented by the general formulae (FI) and (FII) respectively include those disclosed in JP-A-63-158545, JP-A-63-283338, European Patents (Laid Open) 298321 and 277589, and so on.

On the other hand, more preferred for Compounds (G), which can combine chemically with an oxidized aromatic amine developing agent remaining after color development to produce a chemically inert, colorless compound, can be represented by the following general formula (GI):

$$R-Z \qquad \text{(GI)}$$

wherein R represents an aliphatic group, an aromatic group, or a heterocyclic group; and Z represents a nucleophilic group, or a group capable of releasing a nucleophilic group through decomposition in the light-sensitive material. In the compounds represented by the general formula (GI), it is preferred that Z is a group having a Pearson's nucleophilic "$CH_3I$" value (R. G. Pearson, et al., *J. Am. Chem. Soc.*, 90, 319 (1968)) of 5 or more, or a group derived therefrom.

Examples of preferred compounds represented by the general formula (GI) are the compounds disclosed in European Patent (Laid Open) 255,722, JP-A-62-143048, JP-A-62-229145, Japanese Patent Application Nos. 63-136724 and 62-214681, European Patents (Laid Open) 298321 and 277589, and so on.

In addition, details of the combination of the foregoing Compounds (G) with the foregoing Compounds (F) are disclosed in European Patent (Laid Open) 277589.

Gelatin is quite advantageous as the binder or the protective colloid to be used for the emulsion layers of the light-sensitive material of the present invention. Of course, other hydrophilic colloids can be employed independently, or together with gelatin.

Gelatins which can be used in the present invention include not only lime-processed gelatin, but also acid processed gelatin. Details of methods for preparing gelatins are described in Arthur Weiss, *The Macromolecular Chemistry of Gelatin*, Academic Press (1964).

The color photographic light-sensitive material of the present invention is preferably subjected to color development, bleach-fix and washing (or stabilization) processings. However, bleach and fixation processings may be carried out in a monobath, or may be carried out separately.

The color developer to be used in the present invention contains a known aromatic primary amine color developing agent. Preferred color developing agents include p-phenylenediamine derivatives. Typical examples of p-phenylenediamine derivatives are described below. However, the present invention should not be construed as being limited to these compounds.

D- 1 N,N-diethyl-p-phenylenediamine
D- 2 2-Amino-5-diethylaminotoluene
D- 3 2-Amino-5-(N-ethyl-N-laurylamino)toluene
D- 4 4-[N-Ethyl-N-(β-hydroxyethyl)amino]aniline
D- 5 2-Methyl-4-[N-ethyl-N-(β-hydroxyethyl-)amino]aniline
D- 6 4-Amino-3-methyl-N-ethyl-N-[β-(methanesulfonamido)ethyl]aniline
D- 7 N-(2-Amino-5-diethylaminophenylethyl)methanesulfonamide
D- 8 N,N-Dimethyl-p-phenylenediamine
D- 9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline 4-Amino-3-methyl-N-ethyl-N-[β-(methanesulfonamido)ethyl]aniline (D-6) is particularly preferred of the above described p-phenylenediamine derivatives.

These p-phenylenediamine derivatives may assume the form of salt, such as the sulfate, hydrochloride, silfite or p-toluenesulfonate. A suitable amount of the aromatic primary amine developing agent to be added is from about 0.1 g to about 20 g, preferably from about 0.5 g to about 10 g, per liter of developer.

It is preferred in the present invention that the developer used not substantially contain benzyl alcohol. The expression "not substantially contain benzyl alcohol" used herein is intended to include cases where benzyl alcohol is present in a concentration of 2 ml/liter or less, more preferably 0.5 ml/liter or less. In the most preferred case, benzyl alcohol is not present at all.

It is also preferred that the developer used in the present invention should substantially not contain sulfite ion. Sulfite ion not only functions as a preservative for a developing agent, but also functions to dissolve silver halides and to lower dye forming efficiency by reaction with an oxidized developing agent. These functions are presumed to be one of causes for an increase in variation of photographic characteristics, which accompanies continuous processing. The expression "substantially not contain sulfite" as used herein means that sulfite ion may be present in a concentration of $3.0\times10^{-3}$ mol/liter or less and, most preferably, sulfite ion is not present at all. In the present invention, however, a small quantity of sulfite ion which is used as antifoggant for a processing kit in which a developing agent is concentrated prior to practical use is not ruled out.

It is to be desired, as described above, for the developer to be used in the present invention substantially not to contain sulfite ion, and it is more preferred that the developer should substantially not contain hydroxylamine also. This is because the variation in hydroxylamine concentration is believed to greatly influence photographic characteristics since hydroxylamine itself has a silver developing activity, as well as functions as a preservative. The expression "substantially not contain hydroxylamine" as used herein is intended to include cases where the concentration of hydroxylamine is $5.0\times10^{-3}$ mol/liter or less. In particular, the case where hydroxylamine is not present at all is preferred over others.

It is much more preferred for the developer used in the present invention to contain organic preservatives in place of the above described hydroxylamine and sulfite ion.

The term organic preservatives refers to those organic compounds which decrease the deterioration rate of aromatic primary amine color developing agents by addition to a processing solution for color photographic materials. More specifically, these compounds include those having the function of preventing color developing agents from being aerially oxidized or the like. Examples of especially effective organic preservatives are hydroxylamine derivatives (other than hydroxylamine itself), hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamide compounds, condensed ring type amines and the like. Specific examples of these preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63 146041, JP-A-63-44657, JP-A-63-44656, U.S. Patents 3,615,503 and 2,494,903, JP-A-52-143020, JP-B-48-30496, and so on.

Examples of other preservatives include various metals disclosed in JP-A-57-44148 and JP-A-57-53749, salicylic acids disclosed in JP-A-59-180588, alkanolamines disclosed in JP-A-54-3532, polyethyleneimines disclosed in JP-A-56-94349, aromatic polyhydroxy compounds disclosed in U.S. Pat. No. 3,746,544, and so on. In particular, the addition of alkanolamines such as triethanolamine, dialkylhydroxylamines such as diethylhydroxylamine, hydrazine derivatives or aromatic polyhydroxy compounds is preferred.

Of the above described organic preservatives, hydroxylamine derivatives (other than hydroxylamine itself) and hydrazine derivatives (including hydrazines and hydrazides) are particularly preferred, and the details of these derivatives are described in JP-A-1-97953, JP-A-1-186939, JP-A-1-186940, and JP-A-1-187557, and so on.

Further, the combined use of the above described hydroxylamine or hydrazine derivatives and amines is of greater advantage from the standpoint of the enhancement of stability of the color developer and, what is more, enhancement of stability upon continuous processing.

Examples of amines which can be used for the foregoing purpose are cyclic amines as disclosed in JP-A-63-239447, amines as disclosed in JP-A-63-138340, and other amines as disclosed in JP-A-1-186939 and JP-A-1-187557.

It is desirable in the present invention that the color developer should contain chlorine ion in a concentration of from $3.5\times10^{-2}$ to $1.5\times10^{-1}$ mol/liter, particularly preferably from $4\times10^{-2}$ to $1\times10^{-1}$ mol/liter. When the chlorine ion concentration is increased beyond $1.5\times10^{-1}$ mol/liter, chlorine ion retards development. Therefore, such a high chlorine ion concentration is undesirable for rapid attainment of high maximum density, which is one of the objects of the present invention. On the other hand, chlorine ion concentrations less than $3.5\times10^{-2}$ mol/liter are undesirable from the viewpoint of prevention of fog.

It is also desirable in the present invention that the color developer should contain bromine ion in a concentration of from $3.0\times10^{-5}$ to $1.0\times10^{-3}$ mol/liter, preferably from $5.0\times10^{-5}$ to $5\times10^{-4}$ mol/liter. When the bromine ion concentration is higher than $1\times10^{-3}$ mol/liter, development is retarded, and further the maximum density and the sensitivity are reduced, whereas when it is lower than $3.0\times10^{-5}$ mol/liter generation of fog is not prevented satisfactorily.

Herein, chlorine ion and bromine ion may be added directly to a developer, or eluted from the light-sensitive materials into the developer during development processing.

In case of direct addition to a color developer, substances which can be used to supply chlorine ion include sodium chloride, potassium chloride, ammonium chloride, lithium chloride, nickel chloride, magnesium chloride, manganese chloride, calcium chloride, and cadmium chloride. Of these salts, sodium chloride and potassium chloride are preferred over others.

Substances which can be used to supply bromine ion include sodium bromide, potassium bromide, ammonium bromide, lithium bromide, calcium bromide, magnesium bromide, manganese bromide, nickel bromide, cadmium bromide, cerium bromide and thallium bromide. Of these salts, potassium bromide and sodium bromide are preferred over others.

In case of the elution from light-sensitive materials, both chlorine and bromine ions may be supplied from silver halide emulsions, or others.

The color developer to be used in the present invention is preferably adjusted to a pH of 9 to 12, particularly a pH of 9 to 11.0.

Other known developer components can be added to the color developer.

In order to maintain the pH of the color developer constant in the above described range, various pH buffers should be used. Suitable examples of pH buffers which can be used include carbonates, phosphates, borates, tetraborates, hydroxybenzoates, glycine salts, N,N-dimethylglycine salts, leucine salts, norleucine salts, guanidine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, and so on. Of these salts, carbonates, phosphates, tetraborates and hydroxybenzoates are particularly favored over others because they have excellent solubility and buffer capacity in this high pH region of beyond 9.0, do not adversely effect photographic properties when added to color developer, and are inexpensive.

Specific examples of these buffers include sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), and so on. However, the present invention should not be construed as being limited to these compounds.

It is desirable that the foregoing buffers should be added to a color developer in a concentration of 0.1 mol/liter or above, particularly from 0.1 to 0.4 mol/liter.

In addition, various kinds of chelating agents can be used in the color developer as a suspending agent for calcium and magnesium ions, or for the purpose of increasing the stability of the color developer. For instance, nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamineo-hydroxyphenylacetic acid, 2-phosphonobutane-1,2,4-tricarboxylic acid, 1-hydroxyethylidene-1,1-diphosphonic acid, N,N'-bis(2-hydroxybenzyl-)ethylenediamine-N,N'-diacetic acid, and so on are suitable. These chelating agents may be used in combination, if desired.

These chelating agents are added in an amount sufficient to block metal ions in the color developer. For example, an amount of from about 0.1 to about 10 g per liter of the color developer will suffice for blocking metal ions.

Development accelerators also can be added, if desired, to the color developer.

Examples of development accelerators which can be used are thioether compounds as disclosed in JP-B-37-16088, JP-B-37-5987, JP-B-38-7826, JP-B-44-12380, JP-B-45-9019 and U.S. Patent 3,813,247, p-phenylenediamine compounds disclosed in JP-A-52-49829 and JP-A-50-15554, quaternary ammonium salts as disclosed in JP-A-50-137726, JP-B-44-30074, JP-A-56-156826 and JP-A-52-43429, amine compounds as disclosed in U.S. Pat. Nos. 2,494,903, 3,128,182, 4,230,796 and 3,253,919, JP-B-41-11431, U.S. Pat. Nos. 2,482,546, 2,596,926 and 3,582,346, polyalkylene oxides as disclosed in JP-B-37-16088, JP-B-42-25201, U.S. Pat. No. 3,128,183, JP-B-41-11431, JP-B-42-23883 and U.S. Pat. No. 3,532,501, 1-phenyl-2-pyrazolidones, imidazoles and so on.

Antifoggants can be added in the present invention also, if desired. Examples of antifoggants include alkali metal halides such as sodium chloride, potassium bromide, potassium iodide and the like, and organic antifoggants can be used. Typical examples of organic antifoggants which can be used are nitrogen-containing heterocyclic compounds, with specific examples including benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

Brightening agent is preferably present in color developers applicable to the present invention. Examples of brightening agents are 4,4 -diamino-2,2'-disulfostilbene compounds and these are used to advantage. These compounds are added in an amount of from 0 to 5 g, preferably from 0.1 to 4 g, per liter of the color developer.

Further, various kinds of surfactants, such as alkylsulfonic acids, arylsulfonic acids, aliphatic carboxylic acids and aromatic carboxylic acids, may be added, if desired.

The processing temperature of the color developer in the present invention ranges from 20 ° to 50° C., preferably from 30° to 40° C. The processing time is within the range of 20 seconds to 5 minutes, preferably 30 seconds to 2 minutes. In replenishment, it is desirable to use a replenisher in the least possible amount. The amount of the replenisher which can be used is appropriately in the range of 20 to 600 ml, preferably 50 to 300 ml, more preferably 60 to 200 ml, and most preferably 60 to 150 ml, per $m^2$ of the light-sensitive material processed.

The desilvering processing applicable to the present invention is described below. In general, the desilvering processing may consist of any steps, e.g., the combination of bleach and fixation steps, of fixation and blix steps, of bleach and blix steps, of a blix step alone, or so on.

The bleaching bath, the bleach-fix bath and the fixer which are applicable to the present invention are described below.

Any bleaching agents can be used in the bleaching or bleach-fix bath. In particular, complex salts of Fe(III) and organic acids (e.g., aminopolycarboxylic acids, such as ethylenediaminetetraacetic acid, diethylenetriaminepentaacetic acid, etc., aminopolyphosphonic acids, phosphonocarboxylic acids, organic phosphonic acids, and other organic acids such as citric acid, tartaric acid, malic acid, etc.); persulfates; hydrogen peroxide; and so on are preferably used.

Of these bleaching agents, organic complex salts of Fe(III) are particularly preferred from the viewpoints of rapid processing and prevention of environmental pollution. Examples of aminopolycarboxylic acids, aminopolyphosphonic acids, organic phosphonic acids and salts thereof, which are useful for forming organic complex salts of Fe(III), include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycol ether diaminetetraacetic acid, and so on. These acids may be in a salt form including such as the sodium salt, potassium salt, lithium salt and ammonium salt. Of these compounds, Fe(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred over others because of their high bleaching power. These ferric ion complexes may be used in the form of the complex salt itself, or the complex salt may be formed in a processing bath by adding thereto both a ferric salt, e.g., ferric sulfate, ferric chloride, ferric nitrate, ammonium ferric sulfate, ferric phosphate or the like, and a chelating agent, such as an aminopolycarboxylic acid, an aminopolyphosphonic acid, a phosphonocarboxylic acid, etc. Moreover, the chelating agents may be used in excess of that needed to form the ferric ion complex salts. Of the ferric ion complexes, aminopolycarboxylic acid Fe(III) complex salts are preferred over others, and they are employed in an amount of from 0.01 to 1.0 mol, particularly from 0.05 to 0.50 mol, per liter of the processing bath.

Various compounds can be used as a bleach accelerator in the bleaching bath, the bleach-fix bath and/or the prebath thereof. For example, the use of compounds containing a mercapto group or a disulfide linkage, as disclosed in U.S. Pat. No. 3,893,858, German Patent 1,290,812, JP-A-53-95630 and *Research Disclosure*, No. 17129 (July, 1978), thiourea compounds as disclosed in JP-B-45-8506, JP-A-52-20832, JP-A-53-32735 and U.S. Pat. NO. 3,706,561, or halides such as iodine ion, bromine ion, and the like is preferred from the standpoint of attainment of excellent bleachability.

In addition, a rehalogenating agent, such as bromides (e.g., potassium bromide, sodium bromide, ammonium bromide), chlorides (e.g., potassium chloride, sodium chloride, ammonium chloride), iodides (e.g., ammonium iodide) or the like, can be present in the bleaching or the bleach-fix bath applicable to the present invention. Moreover, a pH buffering combination comprising one or more of an inorganic or organic acids, and an alkali metal or ammonium salt thereof, including borax, sodium metaborate, acetic acid, sodium acetate, sodium carbonate, potassium carbonate, phosphorous acid, phosphoric acid, sodium phosphate, citric acid, sodium citrate, tartaric acid and so on; a corrosion inhibitor such as ammonium nitrate, guanidine, etc.; and so on can be added, if needed.

Suitable fixing agents to be used in a bleach-fix bath or a fixer include known ones, or water-soluble silver halide solvents such as thiosulfates (e.g., sodium thiosulfate, ammonium thiosulfate), thiocyanates (e.g., sodium thiocyanate, ammonium thiocyanate), thioether compounds (e.g., ethylenebisthioglycolic acid, 3,6-dithia-1,8-octanediol) and thioureas. These compounds can be used alone or as a mixture of two or more thereof.

A special bleach-fix bath comprising a combination of the fixing agent disclosed in JP-A-55-155354 and a large quantity of halide such as potassium iodide can be also employed.

In the present invention, the use of a thiosulfate, especially ammonium thiosulfate, is preferred as a fixing agent. The amount of the fixing agent used per liter of processing bath ranges preferably from 0.3 to 2 mols, and more preferably from 0.5 to 1.0 mol. A suitable pH region for the bleach-fix bath and that of the fixer is from 3 to 10, particularly from 5 to 9.

Various kinds of brightening agents, defoaming agents or surfactants, and organic solvents such as polyvinyl pyrrolidone, methanol and so on can further be present in the bleach-fix bath.

The bleach-fix bath and the fixer should preferably contain, as preservatives, sulfite ion-releasing compounds such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite). These compounds are present in a concentration of from about 0.02 to about 0.05 mol/liter, preferably from 0.04 to 0.40 mol/liter, based on sulfite ion.

Sulfites are generally used as preservatives, but ascorbic acid, carbonyl-bisulfite adducts, carbonyl compounds, and others may be also used.

Further, buffers, brightening agents, chelating agents, defoaming agents, antimolds and so on may be added, if desired.

After the desilvering processing which includes fixation, bleach-fix and like steps, washing and/or stabilization processing is, in general, carried out.

The volume of washing water required can be determined depending on the characteristics of the light-sensitive materials to be processed (e.g., on what kinds of couplers are incorporated therein), the end use purpose of the light-sensitive materials to be processed, the temperature of washing water, the number of washing tanks (the number of stages), the method of replenishing the washing water (as to, e.g., whether a current of water flows in the counter direction, or not), and other various conditions. The relation between the number of washing tanks and the volume of washing water in the multistage countercurrent process can be determined according to the methods described in *Journal of the Society of Motion Picture and Television Engineers*, Vol. 64, pages 248 to 253 (May, 1955). In general, a desirable number of stages in the multistage counter-current process is from 2 to 6, especially from 2 to 4.

The volume of washing water can be sharply decreased using the multistage countercurrent process. Specifically, it can be reduced to from 0.5 to less than 1 liter per $m^2$ of the light-sensitive materials processed. Under these circumstances, the effects of the present invention are produced remarkably. However, the process has a disadvantage, e.g., in that bacteria propagate in the tanks because of an increase in residence time of the water in the tanks. This produces suspended matter, and the resulting suspending matter sticks to the light-sensitive materials processed therein. Means of solving such a problem as described above include the method of lowering calcium and manganese ion concentrations, as disclosed in JP-A-62-288838. Further, bactericides such as isothiazolone compounds and thiabendazole compounds disclosed in JP-A-57-8542; chlorine-containing germicides such as sodium salt of chlorinated isocyanuric acid disclosed in JP-A-61-120145; and germicides such as benzotriazoles disclosed in JP-A-61-267761, copper ion, and so on, as described in Hiroshi Horiguchi, *Bohkin Bohbai no Kagaku (Antibacterial and Moldproof Chemistry)*, Sankyo Shuppan (1986); *Biseibutsu no Mekkin Sakkin Bohbai Gijutsu (Art of Sterilizing and Pasteurizing Microbes, and Proofing Against Molds)*, compiled by Eisei Gijutsukai, published by Kogyo Gijutsukai in 1982; and *Bohkin Bohbaizai Jiten (Encyclopedia of Antibacterials and Antimolds)*, compiled by Nippon Bohkin Bohbai Gakkai (1986).

Surfactants as a draining agent, and chelating agents represented by EDTA as a water softener can additionally be used in the washing water.

Subsequent to the above described washing step, or directly after the desilvering processing without any washing step, the light-sensitive materials can be processed with a stabilizer. Compounds having an image stabilizing function, e.g., aldehyde series compounds represented by formaldehyde, buffers for adjusting the processed films to a pH value suitable for stabilization of dyes, and ammonium compounds, are added to the stabilizer. Further, the foregoing germicides and antimolds can be added thereto in order to prevent bacteria from propagating in the stabilizer, and to keep the processed light-sensitive materials from getting moldy.

Furthermore, a surfactant, a brightening agent and a hardener can be added, too. In subjecting the light-sensitive material of the present invention directly to a stabilization processing without any washing step, all of known methods as disclosed in JP-A-57-8543, JP-A-58-14834, JP-A-60-220435, and so on can be employed.

Moreover, chelating agents such as 1-hydroxyethylidene-1,1-diphosphonic acid, ethylenediaminetetramethylenephosphonic acid and the like, and magnesium and bismuth compounds can be used to advantage in the stabilizing bath.

The so-called rinsing solution can likewise be used as washing water or stabilizing solution used after the desilvering processing.

A suitable pH for the washing water or stabilization step ranges from 4 to 10, more preferably from 5 to 8. The temperature, which can vary depending on the characteristics and the intended use of the light-sensitive materials to be processed, ranges from 15° C. to 45° C., preferably from 20° C. to 40° C. The time can be also arbitrarily chosen but it is more advantageous to finish the washing or stabilization step in a shorter time from the standpoint of saving processing time. A suitable time ranges from 15 seconds to 1 minute and 45 seconds, more preferably from 30 seconds to 1 minute and 30 seconds. From the standpoint of running cost, reduction of waters, handling facility, etc., it is more desirable for the washing or stabilization bath to be replenished in as small an amount as possible.

A desirable replenishing amount ranges from 0.5 to 50 times, preferably from 3 to 40 times, the quantity of the processing solution brought thereinto from the prebath thereof per unit area of the light-sensitive material. In other words, it is below 1 liter, preferably below 500 ml, per $m^2$ of light-sensitive material. The replenishment may be carried out either continuously or intermittently.

The solution used in the washing and/or stabilization step can further be used in prior steps. For instance, the washing water overflow, which is reduced in quantity by adopting the multistage counter-current process, is made to flow into a bleach-fix bath arranged as a prebath, and the bleach-fix bath is replenished with a concentrated solution, resulting in a reduction in the amount of waste solution.

The present invention is now illustrated in greater detail by reference to the following examples. However, the present invention should not be construed as being limited to these examples.

EXAMPLE 1

Anatase-type titanium oxide powder (used as white pigment herein) was dipped in an ethanol solution of 2,4-dihydroxy-2-methylpentane, and then heated to evaporate the ethanol for surface treatment. The resulting white pigment was added to 86 wt parts of a polyethylene composition (density: 0.920 g/cc, melt index (MI): 5.0 g/10 min) in an amount of 14 wt parts, and kneaded therewith. The kneaded matter was extrusion coating in a fused condition to form a 30 μm-thick water resisting resin layer on the surface of white raw paper made from 100% LBKP (broad-leaved tree bleached sulfate pulp) for a photographic printing paper. The other water resisting resin layer on the back of the white raw paper comprised the same polyethylene composition stated above. On the paper support thus laminated on both sides were coated the layers described below in the order shown to prepare a multilayer color photographic paper (Sample (0)). The coating solutions employed were prepared in the following manner.

Preparation of Coating Solution for First Layer

A mixture of 19.1 g of a yellow coupler (ExY), 4.4 g of a color image stabilizer (Cpd-1) and 0.7 g of a color image stabilizer (Cpd-7) was dissolved in a mixed solvent of 27.2 ml of ethyl acetate and 8.2 g of a solvent (Solv-1), and then dispersed in an emulsified condition into 185 ml of a 10% aqueous gelatin solution containing 8 ml of a 10 wt % solution of sodium dodecylbenzenesulfonate. On the other hand, two kinds of silver chlorobromide emulsions (both of which had a cubic crystal form, one of which had an average grain size of 0.88 μm and a variation coefficient of 0.08 with respect to the grain size distribution, and the other of which had an average grain size of 0.70 μm and a variation coefficient of 0.10 with respect to the grain size distribution; both of which contain 0.2 mol % of silver bromide localized at the grain surface) were prepared. The blue-sensitive sensitizing dyes illustrated below were added to the large grain size emulsion in an amount of $2.0\times10^{-4}$ mol per mol silver, and to the small grain size emulsion in an amount of $2.5\times10^{-4}$ mol per mol of silver, and then sulfur sensitization was conducted. The resulting emulsions were mixed together in a ratio (former emulsion to latter emulsion) of 3/7 by mol (based on silver). The thus obtained emulsion was mixed homogeneously with the foregoing emulsified dispersion, and thereto were added the other ingredients described below so as to obtain a coating solution for the first layer having the composition described below.

The coating solutions for from the second to seventh layers were prepared, respectively, in the same manner as that for the first layer. In each layer, the sodium salt of 1-oxy-3,5-dichloro-s-triazine was used as hardener as the coverage of 0.8 g/$m^2$.

The spectral sensitizing dyes used in each layer are illustrated below.

Blue-Sensitive Emulstion Layer

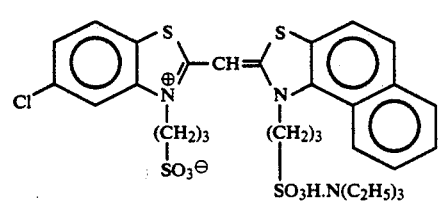

-continued

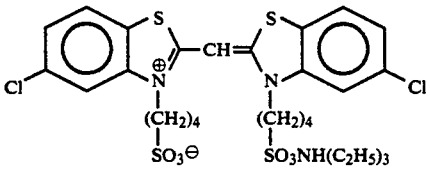

(both were added tot he large grain size emulstion in an amount of $2.0\times10^{-4}$ mol/mol Ag, and to the small grain size emulstion in an amount of $2.5\times10^{-4}$ mol/mol Ag)

Green-Sensitive Emulstion Layer

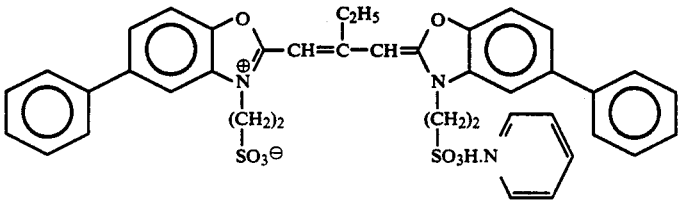

(added to the large grain size emulsion in an amount of $4.0\times10^{-4}$ mol/mol Ag, and to the small grain size emulsion in an amount of $5.6\times10^{-4}$ mol/mol Ag) and

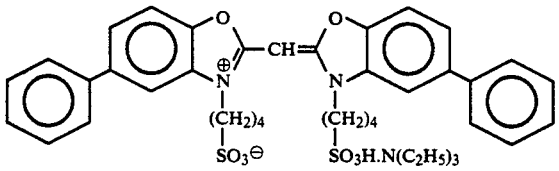

(added to the large grain size emulsion in an amount of $7.0\times10^{-5}$ mol/mol Ag, and to the small grain size emulsion in an amount of $1.0\times10^{-5}$ mol/mol Ag)

Red-Sensitive Emultison Layer

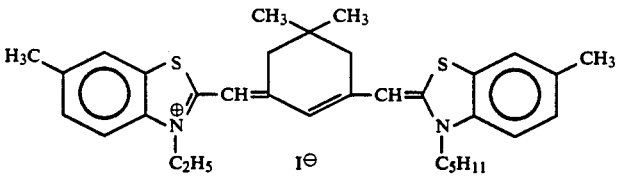

(added to the large grain size emulsion in an amount of $0.9\times10^{-4}$ mol/mol Ag, and to the small grain size emulsion in an amount of $1.1\times10^{-4}$ mol/mol Ag)

The following compound was added to the red-sensitive emulsion layer in an amount of $2.6\times10^{-3}$ mol per mol of silver halide:

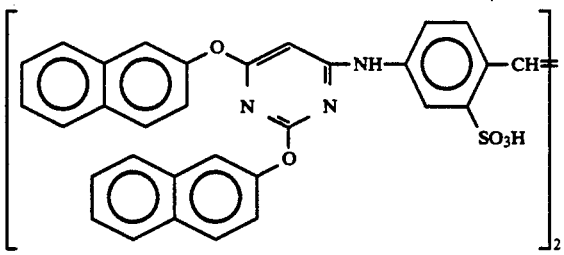

In addition, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol, respectively, per mol of silver halide.

Moreover, 4-hydroxy-6-methyl-1,3,3a,7-tetraazaindene was added to the blue-sensitive emulsion layer and the green-sensitive emulsion layer in amounts of $1\times10^{-4}$ mol and $2\times10^{-4}$ mol, respectively, per mol of silver halide.

The composition of each layer is described below. Each figure on the right side represents the coverage ($g/m^2$) of the ingredient indicated. The figure shown for the silver halide emulsion represents the coverage based on silver.

Support

Polyethylene-laminated paper described above

| | |
|---|---|
| First Layer (blue-sensitive layer): | |
| Silver chlorobromide emulation described above | 0.30 |
| Gelatin | 1.86 |
| Yellow Coupler (ExY) | 0.82 |
| Color Image Stabilizer (Cpd-1) | 0.19 |
| Solvent (Solv-1) | 0.35 |
| Second Layer (color stain inhibiting layer): | |
| Gelatin | 0.99 |
| Color Stain Inhibitor (Cpd-6) | 0.08 |
| Solvent (Solv-1) | 0.16 |
| Solvent (Solv-4) | 0.08 |
| Third Layer (green-sensitive layer): | |
| Silver chlorobromide emulsion (having a cubic crystal form, and being a ⅓ (by mol Ag) | 0.12 |

-continued

| | |
|---|---|
| mixture of an emulsion having an average grain size of 0.55 μm and a variation coefficient of 0.10 with respect to grain size distribution with an emulsion having an average grain size of 0.39 μm and a variation coefficient of 0.08 with respect to grain size distribution, which each contained 0.8 mol % of AgBr localized at the grain surface) | |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer (ultraviolet absorbing layer): | |
| Gelatin | 1.58 |
| Ultraviolet Absorbent (UV-1) | 0.47 |
| Color Stain Inhibitor (Cpd-5) | 0.05 |
| Solvent (Solv-5) | 0.24 |
| Fifth Layer (red-sensitive layer): | |
| Silver chlorobromide emulsion (having a cubic crystal form, and being a ¼ (by mol Ag) mixture of an emulsion having an average grain size of 0.58 μm and a variation coefficient of 0.09 with respect to grain size distribution with an emulsion having an average grain size of 0.45 μm and a variation coefficient of 0.11 with respect to grain size distribution, which each contained 0.6 mol % of AgBr localized at the grain surface) | 0.23 |
| Gelatin | 1.34 |
| Cyan Coupler (ExC) | 0.32 |
| Color Image Stabilizer (Cpd-6) | 0.17 |
| Color Image Stabilizer (Cpd-8) | 0.04 |
| Solvent (Solv-6) | 0.15 |
| Sixth Layer (ultraviolet absorbing layer): | |
| Gelatin | 0.53 |
| Ultraviolet Absorbent (UV-1) | 0.16 |
| Color Stain Inhibitor (Cpd-5) | 0.02 |
| Solvent (Solv-5) | 0.08 |
| Seventh Layer (Protective layer): | |
| Gelatin | 1.33 |
| Acryl-Modified Polyvinyl Alcohol (modification degree: 17%) | 0.17 |
| Liquid Paraffin | 0.03 |

(exY) Yellow Coupler

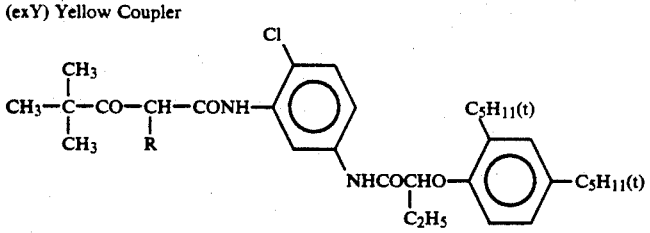

1/1 (by mol) mixture where R =

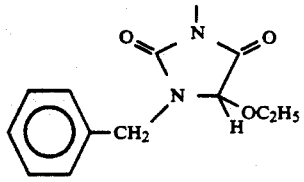

and where R =

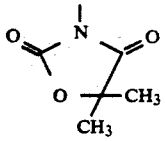

(ExM) Magenta Coupler
1/1 (by mol) mixture of

-continued
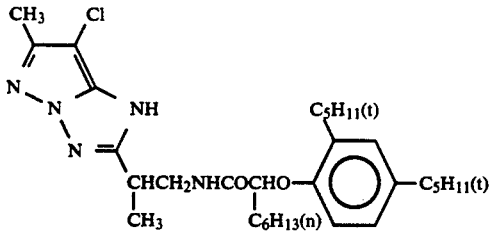
with
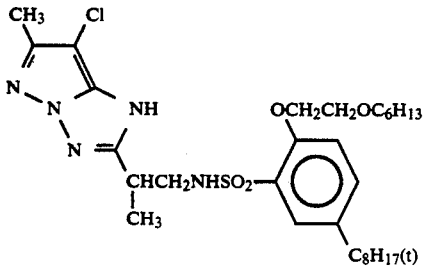
(ExC) Cyan Coupler
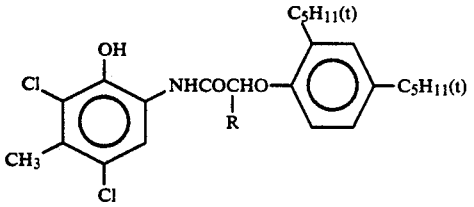
2/4/4 (by weight) mixture of that of R = $C_2H_5$, that of R = $C_4H_9$ and that of R =
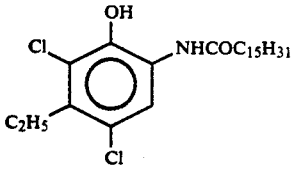
(Cpd-1) Color Image Stabilizer
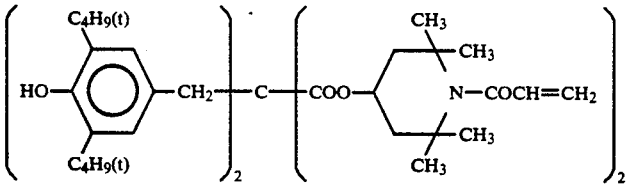
(Cpd-2) Color Image Stabilizer
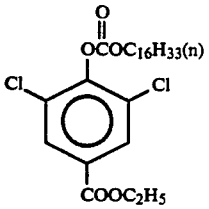
(Cpd-3) Color Image Stabilizer
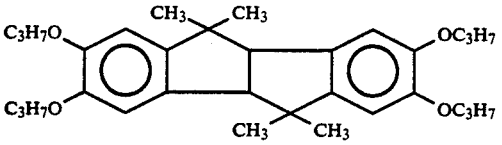
(Cpd-4) Color Image Stabilizer -continued
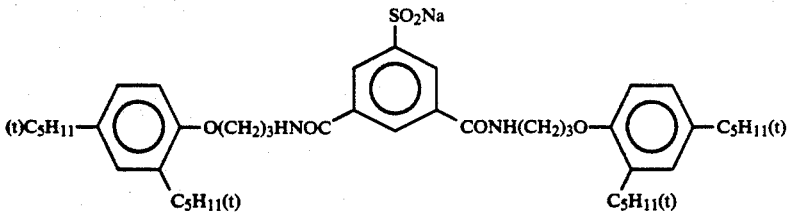
(Cpd-5) Color Stain Inhibitor
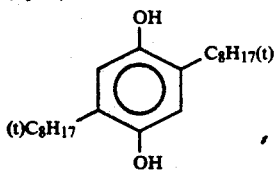
(Cpd-6) Color Image Stabilizer
2/4/4 (by weight) mixture of
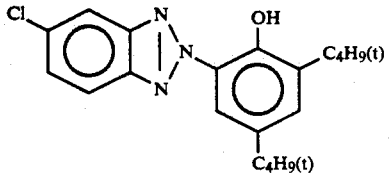
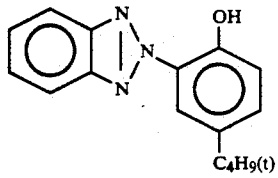
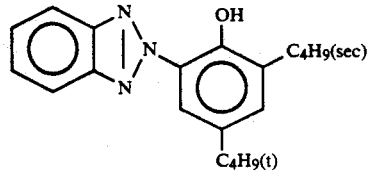
(Cpd-8) Color Image Stabilizer
1/1 (by weight) mixture of
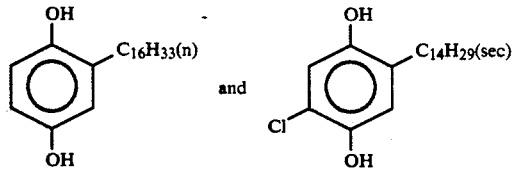
(Cpd-9) Color Image Stabilizer
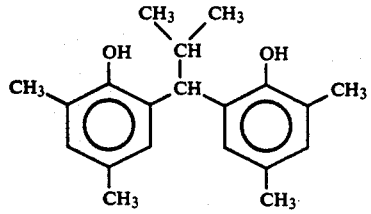
(UV-1) Ultraviolet Absorbent
4/2/4 (by weight) mixture of
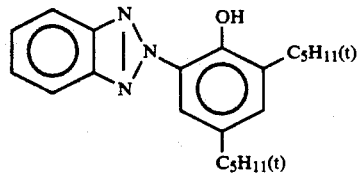

-continued

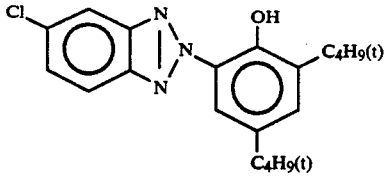

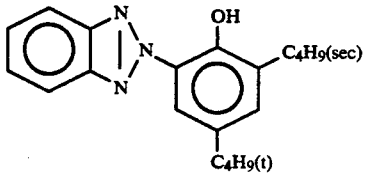

(Solv-1) Solvent

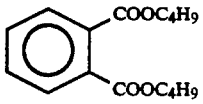

(Solv-2) Solvent

2/1 (by volume) mixture of

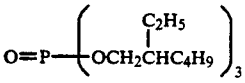

and

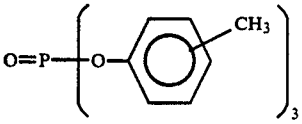

(Solv-4) Solvent

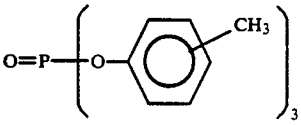

(Solv-5) Solvent

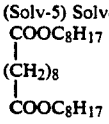

(Solv-6) Solvent

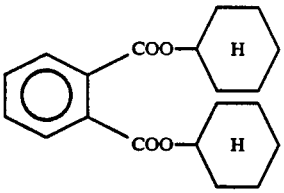

Samples (1) to (15) were prepared in the same manner as Sample (0), except that the amount of titanium oxide in the polyethylene laminate on the first layer side was changed to those shown in Table 1, respectively; the dye (added to the Sixth Layer) for controlling the optical reflection density was changed in kind and amount to those shown in Table 1; and there was a difference as to whether the water-insoluble polymer (P-57) was used or not at the time of emulsifying dispersion of couplers used in the First, the Third and the Fifth Layers.

TABLE 1

| Sample No. | Antiirradiation Dye Kind | Coverage (mg/m²) | Reflection Density at 680 nm | Compound (P-57)* First Layer (g/m²) | Third Layer (g/m²) | Fifth Layer (g/m²) | Titanium Oxide (wt %)** |
|---|---|---|---|---|---|---|---|
| 1 | I-a-27 | 11.0 | 0.5 | — | — | — | 10 |
| 2 | " | 20.5 | 0.7 | — | — | — | " |
| 3 | " | " | " | 0.06 | 0.05 | 0.40 | " |
| 4 | " | 39.0 | 1.0 | " | " | " | " |
| 5 | " | 11.0 | 0.5 | " | " | " | 14 |
| 6 | " | 20.5 | 0.7 | — | — | — | " |
| 7 | " | " | " | — | — | 0.40 | " |

TABLE 1-continued

| Sample No. | Antiirradiation Dye Kind | Coverage (mg/m²) | Reflection Density at 680 nm | Compound (P-57)* First Layer (g/m²) | Third Layer (g/m²) | Fifth Layer (g/m²) | Titanium Oxide (wt %)** |
|---|---|---|---|---|---|---|---|
| 8 | " | " | " | 0.06 | — | 0.40 | " |
| 9 | " | " | " | 0.06 | 0.05 | 0.40 | " |
| 10 | I-a-27 | 14.4 | " | — | — | — | " |
| | I-a-18 | 6.3 | | | | | |
| 11 | I-a-27 | 14.4 | " | 0.06 | 0.05 | 0.40 | " |
| | I-a-18 | 6.3 | | | | | |
| 12 | I-a-18 | 21.0 | " | — | — | — | " |
| 13 | " | " | " | 0.06 | 0.05 | 0.40 | " |
| 14 | I-a-27 | 39.0 | 1.0 | " | " | " | " |
| 15 | " | " | " | " | " | " | 20 |

*Molecular weight of (P-57): 60,000.

**Based on the sum weight of the polyethylene and the titanium oxide coated on the surface of the support on the side of the silver halide light-sensitive layer.

Each of the samples shown in Table 1 above was subjected to wedgewise exposure for sensitometry through color filters, i.e., a blue, green or red filter, by means of a sensitometer (Model FWH, produced by Fuji Photo Film Co., Ltd., equipped with a light source having a color temperature of 3,200° K). The exposure time was set to 0.1 sec, and the exposure was controlled to 250 CMS. After exposure, each sample was subjected to a photographic processing including color development, bleach-fix and rinsing steps. The photographic processing was carried out after a continuous processing (running test) had been performed until an amount of the replenisher used had became twice the volume of the developing tank used.

| Processing Step | Temperature (°C.) | Time (sec) | Amount* Replenished (ml) | Tank Volume (l) |
|---|---|---|---|---|
| Color Developing | 35 | 45 | 161 | 17 |
| Bleach-Fix | 30-36 | 45 | 215 | 17 |
| Stabilization (1) | 30-37 | 20 | — | 10 |
| Stabilization (2) | 30-37 | 20 | — | 10 |
| Stabilization (3) | 30-37 | 20 | — | 10 |
| Stabilization (4) | 30-37 | 30 | 248 | 10 |
| Drying | 70-85 | 60 | | |

*per m² of light-sensitive material (Stabilization was carried out in a 4-stage counter-current process in the direction of from the tank 4 to the tank 1)

The composition of each processing solution used is described below:

| Color Developer: | Tank Solution | Replenisher |
|---|---|---|
| Water | 800 ml | 800 ml |
| Ethylenediaminetetraacetic Acid | 2.0 g | 2.0 g |
| 5,6-Dihydroxybenzene-1,2,4-trisulfonic Acid | 0.3 g | 0.3 g |
| Triethanolamine | 8.0 g | 8.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline-sulfate | 5.0 g | 7.0 g |
| Diethylhydroxyamine | 4.2 g | 6.0 g |
| Brightening Agent (4,4'-diaminostilbene type) | 2.0 g | 2.5 g |
| Water to make | 1,000 ml | 1,000 ml |
| pH (25° C.) adjusted to | 10.05 | 10.45 |

-continued

| Bleach-Fix Bath (Tank solution = Replenisher): | |
|---|---|
| Water | 400 ml |
| Ammonium Thiosulfate (70 wt % aq. soln.) | 100 ml |
| Sodium Sulfite | 17 g |
| Ammonium Ethylene diaminetetraacetato-ferrate(III) | 55 g |
| Disodium Ethylenediaminetetraacetate | 5 g |
| Glacial Acetic Acid | 9 g |
| Water to make | 1,000 ml |
| pH (25° C.) adjusted to | 5.40 |
| Stabilizing Bath (Tank solution = Replenisher): | |
| Formaldehyde (37 wt % aq. soln.) | 0.1 g |
| Formaldehyde-Sulfite Adduct | 0.7 g |
| 5-Chloro-2-methyl-4-isothiazoline-3-one | 0.02 g |
| 2-Methyl-4-isothiazoline-3-one | 0.01 g |
| Copper Sulfate | 0.005 g |
| Water to make | 1,000 ml |
| pH (25° C.) adjusted to | 4.0 |

The sharpness was evaluated using the CTF method where CTF represents a damping degree of the amplitude against the spatial frequency assuming shape of the waves are a square. CTF values at the spatial frequency of 15 lines/mm are set forth in Table 2. The sharpness is higher the greater the CTF value is.

In order to evaluate storage characteristics, one piece of each sample was kept for 2 days under conditions of 40° C., 70% RH, and another piece of each sample was kept for 3 months under conditions of 25° C., 55% RH. Then they were subjected to the same exposure and photographic processing as described above. The difference between the exposure required for the sample piece before storage and that after storage for attaining a developed color density of 1.0 (ΔlogE) was determined. The smaller the values obtained mean that the sensitivity changed less between before and after storage in terms of the absolute value of ΔlogE.

Further, stain due to dyes remaining after processing was examined by visual observation using the three grades described below.

No stain was perceived at all: ∘

Stain was somewhat observed: Δ

Much stain was observed: x

The results obtained are shown in Table 2 below.

TABLE 2

| Sample No. | CTF R | Keeping Quality (40° C., 70% RH for two days) B | G | R | Keeping Quality (25° C., 55% RH for three months) B | G | R | Stain | Note |
|---|---|---|---|---|---|---|---|---|---|
| 1 | 0.10 | 0.02 | 0.04 | 0.05 | 0.02 | 0.03 | 0.04 | Δ | Comparison |
| 2 | 0.13 | 0.03 | 0.05 | 0.09 | 0.04 | 0.05 | 0.07 | x | " |
| 3 | 0.12 | ±0 | 0.01 | 0.02 | ±0 | ±0 | 0.01 | ∘ | " |
| 4 | 0.15 | ±0 | 0.01 | 0.02 | ±0 | ±0 | 0.01 | ∘ | " |
| 5 | 0.16 | ±0 | ±0 | 0.01 | ±0 | ±0 | 0.01 | ∘ | " |
| 6 | 0.25 | 0.03 | 0.04 | 0.08 | 0.04 | 0.05 | 0.07 | x | " |
| 7 | 0.26 | ±0 | 0.01 | 0.02 | ±0 | ±0 | 0.01 | ∘ | Invention |
| 8 | 0.27 | ±0 | 0.01 | 0.02 | ±0 | ±0 | 0.01 | ∘ | " |
| 9 | 0.26 | ±0 | ±0 | 0.01 | ±0 | ±0 | 0.01 | ∘ | " |
| 10 | 0.25 | 0.02 | 0.04 | 0.09 | 0.02 | 0.06 | 0.07 | x | Comparison |
| 11 | 0.26 | ±0 | ±0 | 0.01 | ±0 | ±0 | 0.01 | ∘ | Invention |
| 12 | 0.26 | 0.02 | 0.01 | 0.08 | 0.03 | 0.05 | 0.07 | x | Comparison |
| 13 | 0.26 | ±0 | 0.01 | 0.01 | ±0 | ±0 | 0.01 | ∘ | Invention |
| 14 | 0.32 | ±0 | 0.01 | 0.02 | ±0 | ±0 | 0.01 | ∘ | " |
| 15 | 0.34 | ±0 | 0.01 | 0.02 | ±0 | ±0 | 0.01 | ∘ | " |

As can be seen from the results in Table 2, Samples 7, 11, 13, 14 and 15, that is, the silver halide color photographic materials prepared in accordance with the present invention, had excellent sharpness, keeping quality, and whiteness in the processed photographic material. In contrast to the samples of the present invention, Comparative Samples 1 to 5 had poor sharpness, and Comparative Samples 6, 10 and 12 had inferior keeping quality and stain.

EXAMPLE 2

Samples (16) to (24) were prepared in the same manner as Sample (14) prepared in Example 1, except that Compound (P-57) was replaced by other polymers as set forth in Table 3. The keeping quality and whiteness after processing of these samples were examined using the same methods as in Example 1. The evaluation results are shown in Table 4. The polymers used therein, namely, P-3, P-60, P-64, P-59, P-57 and P-57*, had molecular weights of 40,000, 60,000, 60,000 90,000, 60,000 and 100,000 respectively.

TABLE 3

| Sample No. | Kind of Polymer First Layer | Third Layer | Fifth Layer | Coverage of Polymer (g/m²) First Layer | Third Layer | Fifth Layer |
|---|---|---|---|---|---|---|
| 16 | — | — | — | — | — | — |
| 17 | — | — | P-57 | — | — | 0.40 |
| 18 | P-57 | P-57 | P-57 | 0.06 | 0.05 | 0.40 |
| 19 | — | — | P-3 | — | — | 0.40 |
| 20 | P-3 | P-3 | P-3 | 0.06 | 0.05 | 0.45 |
| 21 | P-60 | P-60 | P-60 | 0.06 | 0.05 | 0.42 |
| 22 | P-64 | P-64 | P-64 | 0.06 | 0.05 | 0.40 |
| 23 | P-59 | P-59 | P-57 | 0.06 | 0.05 | 0.40 |

TABLE 3-continued

| Sample No. | Kind of Polymer First Layer | Third Layer | Fifth Layer | Coverage of Polymer (g/m²) First Layer | Third Layer | Fifth Layer |
|---|---|---|---|---|---|---|
| 24 | *P-57 | *P-57 | *P-57 | 0.06 | 0.05 | 0.40 |

TABLE 4

| Sample No. | CTF R | Keeping Quality (40° C., 70% RH for two days) B | G | R | Keeping Quality (25° C., 55% RH for three months) B | G | R | Stain | Note |
|---|---|---|---|---|---|---|---|---|---|
| 16 | 0.32 | 0.03 | 0.08 | 0.12 | 0.02 | 0.06 | 0.10 | x | Comparison |
| 17 | 0.33 | ±0 | 0.01 | 0.03 | ±0 | 0.01 | 0.02 | ∘ | Invention |
| 18 | 0.33 | ±0 | 0.01 | 0.02 | ±0 | 0.01 | 0.02 | ∘ | " |
| 19 | 0.34 | ±0 | 0.01 | 0.02 | ±0 | ±0 | 0.01 | ∘ | " |
| 20 | 0.33 | ±0 | ±0 | 0.01 | ±0 | ±0 | 0.01 | ∘ | " |
| 21 | 0.34 | ±0 | 0.01 | 0.02 | ±0 | 0.01 | 0.02 | ∘ | " |
| 22 | 0.32 | ±0 | ±0 | 0.01 | ±0 | ±0 | 0.01 | ∘ | " |
| 23 | 0.33 | ±0 | ±0 | 0.01 | ±0 | ±0 | 0.01 | ∘ | " |
| 24 | 0.33 | ±0 | ±0 | 0.01 | ±0 | ±0 | 0.01 | ∘ | " |

As can be seen from the results in Table 4, the samples of the present invention had excellent sharpness, keeping quality and whiteness even when the polymer of the present invention was varied, and even when the polymer of the present invention was incorporated in one emulsion layer or more.

EXAMPLE 3

Samples (25) to (29) were prepared in the same manner as Sample (18) prepared in Example 2, except that the kinds and the amounts of dyes were changed to those shown in Table 5. These samples were evaluated using the same methods as employed in Examples 1 and 2.

The results obtained are shown in Table 6 below.

TABLE 5

| Sample No. | Amount of Added (mg/m²) V-1 | I-a-12 | I-a-27 | Reflection Density 470 nm | 550 nm | 680 nm |
|---|---|---|---|---|---|---|
| 25 | — | 28.0 | 19.5 | 0.15 | 0.90 | 0.71 |
| 26 | — | 23.0 | 38.0 | 0.16 | 0.91 | 1.02 |
| 27 | 1.0 | 13.0 | " | 0.15 | 0.72 | 1.03 |
| 28 | 2.0 | " | " | 0.21 | 0.72 | 1.02 |
| 29 | 5.0 | " | " | 0.32 | 0.73 | 1.02 |

TABLE 6

| Sample No. | Keeping Quality (40° C., 79% RH, two days) B | G | R | Keeping Quality (25° C., 55% RH, three months) B | G | R | Stain | CFT B | G | R | Observation | Note |
|---|---|---|---|---|---|---|---|---|---|---|---|---|
| 25 | 0.01 | 0.01 | 0.02 | 0.01 | 0.01 | 0.01 | ∘ | 28 | 37 | 27 | Cyan color in sample for CTF was markedly blurred | Invention |
| 26 | ±0 | ±0 | 0.01 | ±0 | ±0 | 0.01 | ∘ | 28 | 37 | 32 | Cyan color in sample for CTF was markedly blurred | " |
| 27 | ±0 | 0.01 | 0.01 | 0.01 | 0.01 | 0.01 | ∘ | 27 | 32 | 33 | Yellow color in sample for CTF was markedly blurred | " |
| 28 | ±0 | ±0 | 0.01 | ±0 | ±0 | 0.01 | ∘ | 30 | 32 | 33 | Blur was almost inconspicuous | " |
| 29 | 0.01 | 0.01 | 0.01 | 0.01 | 0.01 | 0.01 | ∘ | 33 | 32 | 33 | Blur was not conspicuous at all | " |

As can be seen from the results in Table 6, the samples whose reflection densities at 550 nm were below those at 680 nm, especially the sample whose reflection density at 470 nm was greater than 0.2, of the samples prepared in accordance with the present invention were superior in sharpness and acquired color balance with respect to blur.

In accordance with the present invention, therefore, silver halide color photographic materials can be obtained having excellent sharpness, moreover, a change in sensitivity upon long range storage after preparation did not occur and excellent whiteness was achieved even when subjected to rapid processing.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising:

a reflective support having thereon at least one light-sensitive silver halide emulsion layer, wherein the reflective support comprises a support substrate covered with a water resistant resin layer, wherein the water resistant resin layer, on the side of said silver halide light-sensitive layer, contains titanium oxide grains in an amount of 14 wt % or more, wherein the photographic material contains at least one dye of formula (I-a)':

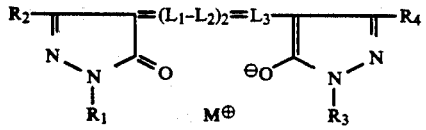

wherein $R_1$ and $R_3$ each represents a phenyl group containing at least two sulfo groups; $R_2$ and $R_4$ each represents an aliphatic group, an aromatic group, $—OR_5$, $—COOR_5$, $—NR_5R_6$, $—CONR_5R_6$, $—NR_5CONHR_5R_6$, $—SO_2R_7$, $—COR_7$, $NR_6COR_7$, $—NR_6SO_2R_7$, or a cyano group (wherein $R_5$ and $R_6$ each represents a hydrogen atom, or an aliphatic or aromatic group; $R_7$ represents an liphatic or aromatic group; and further, $R_5$ and $R_6$, or $R_6$ and $R_7$ maybe combined with each other to complete a 5- or 6-membered ring); and $L_1$, $L_2$ and $L_3$ each represents a methine group; and $M^{\oplus}$ represents a hydrogen ion, or another monovalent cation, so that the photographic material has an optical reflection density of 0.70 or above at 680 nm, and wherein the light-sensitive silver halide emulsion layer contains at least one non-diffusible oil-soluble coupler, which forms a dye on coupling with the oxidation product of an aromatic primary amine color developing agent, dispersed therein together with at least one water-insoluble homopolymer or copolymer, wherein the water-insoluble homopolymer or copolymer is water-insoluble, organic solvent-soluble homopolymer or copolymer which has a repeating unit containing a

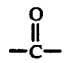

linking in the main chain or in a side chain, and wherein the light-sensitive silver halide emulsion layer containing the water-insoluble homopolymer or copolymer comprises a silver halide emulsion having a chloride content of 90 mol % or more.

2. The silver halide color photographic material of claim 1, wherein the optical reflection density at 550 nm is below that at 680 nm.

3. The silver halide color photographic material of claim 1, wherein the optical reflection density at 680 nm is 0.70 to 2.0.

4. The silver halide color photographic material of claim 3, wherein the optical reflection density at 680 nm is 0.8 to 1.9.

5. The silver halide color photographic material of claim 4, wherein the optical reflection density at 680 nm is 1.0 to 1.8.

6. The silver halide color photographic material of claim 1, wherein the ratio of the optical reflection density at 550 nm and the optical reflection density at 680 nm is 1 or less.

7. The silver halide color photographic material of claim 1, wherein the optical reflection density at 470 nm is 0.2 or more.

8. The silver halide color photographic material of claim 1, wherein the water-insoluble polymer has a glass transition point of 60° C. or above.

9. The silver halide color photographic material of claim 1, wherein the water-insoluble homo- or copolymer is a water-insoluble, organic solvent-soluble homo- or copolymer containing a

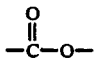
linkage in the main chain or in a side chain, or a water-insoluble, organic solvent-soluble homo- or copolymer which has a
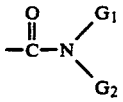
group in the main chain or a side chain, wherein $G_1$ and $G_2$ are each a hydrogen atom or a substituted or unsubstituted alkyl or aryl group, provided that both $G_1$ and $G_2$ cannot simultaneously be a hydrogen atom.
* * * * *